US007732373B2

(12) United States Patent
Tatewaki et al.

(10) Patent No.: US 7,732,373 B2
(45) Date of Patent: Jun. 8, 2010

(54) REVERSIBLE THERMOSENSITIVE RECORDING MEDIUM, AS WELL AS REVERSIBLE THERMOSENSITIVE RECORDING LABEL, REVERSIBLE THERMOSENSITIVE RECORDING MEMBER, IMAGE PROCESSING APPARATUS AND IMAGE PROCESSING METHOD

(75) Inventors: Tadafumi Tatewaki, Shizuoka (JP); Satoshi Arai, Numazu (JP); Nobuyoshi Sugiyama, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 242 days.

(21) Appl. No.: 11/724,895

(22) Filed: Mar. 16, 2007

(65) Prior Publication Data

US 2007/0232489 A1 Oct. 4, 2007

(30) Foreign Application Priority Data

Mar. 17, 2006 (JP) ..... 2006-074368
May 19, 2006 (JP) ..... 2006-139746

(51) Int. Cl.
*B41M 5/42* (2006.01)

(52) U.S. Cl. ..... 503/201; 503/226

(58) Field of Classification Search ..... None
See application file for complete search history.

(56) References Cited

U.S. PATENT DOCUMENTS 5,942,377 A 8/1999 Torii et al.
5,981,115 A 11/1999 Furuya et al.
5,981,429 A 11/1999 Kawamura et al.
6,090,748 A 7/2000 Furuya et al.
6,154,243 A 11/2000 Tatewaki et al.
6,261,992 B1 7/2001 Furuya et al.
6,579,826 B2 6/2003 Furuya et al.
6,770,592 B2 8/2004 Suzuki et al.
6,818,591 B2 11/2004 Arai et al.
6,969,695 B2 11/2005 Kuboyama et al.
6,989,349 B2 1/2006 Tatewaki et al.
2002/0107145 A1 8/2002 Suzuki et al.
2005/0014645 A1 1/2005 Shimbo et al.
2005/0176582 A1 8/2005 Arai et al.

FOREIGN PATENT DOCUMENTS

EP 1211090 A1 6/2002
EP 1491354 A1 12/2004
JP 60-193691 10/1985

(Continued)

OTHER PUBLICATIONS

Aug. 17, 2007 European Search Report in connection with corresponding European patent application No. EP 07 10 4354.

*Primary Examiner*—Bruce H Hess
(74) *Attorney, Agent, or Firm*—Cooper & Dunham LLP

(57) ABSTRACT

To provide a reversible thermosensitive recording medium comprising a support, a thermosensitive recording layer formed on the support, and a protective layer formed on the thermosensitive recording layer, wherein the thermosensitive recording layer contains an electron donative coloring compound and an electron acceptive compound, and the color tone reversibly changes depending on the temperature, and the protective layer contains a polymer of a composition containing two kinds of acrylate compounds selected from an acrylate compound having a pentaerythritol group and an acrylate compound having a dipentaerythritol group.

23 Claims, 13 Drawing Sheets

FOREIGN PATENT DOCUMENTS

| | | |
|---|---|---|
| JP | 61-237684 | 10/1986 |
| JP | 62-55650 | 3/1987 |
| JP | 62-138556 | 6/1987 |
| JP | 62-138568 | 6/1987 |
| JP | 62-140881 | 6/1987 |
| JP | 63-107584 | 5/1988 |
| JP | 63-173684 | 7/1988 |
| JP | 1-133781 | 5/1989 |
| JP | 2-188293 | 7/1990 |
| JP | 2-188294 | 7/1990 |
| JP | 4-78573 | 3/1992 |
| JP | 5-124360 | 5/1993 |
| JP | 6-210954 | 8/1994 |
| JP | 9-142037 | 6/1997 |
| JP | 2708464 | 10/1997 |
| JP | 10-95175 | 4/1998 |
| JP | 11-334220 | 12/1999 |
| JP | 3690638 | 6/2005 |

REVERSIBLE THERMOSENSITIVE RECORDING MEDIUM, AS WELL AS REVERSIBLE THERMOSENSITIVE RECORDING LABEL, REVERSIBLE THERMOSENSITIVE RECORDING MEMBER, IMAGE PROCESSING APPARATUS AND IMAGE PROCESSING METHOD

BACKGROUND

1. Technical Field of the Invention

This disclosure relates to a reversible thermosensitive recording medium capable of forming and erasing color developed images by controlling thermal energy using a reversible thermosensitive color developing composition which utilizes the coloring reaction between an electron donative coloring compound and an electron acceptive compound, and to a reversible thermosensitive recording label, a reversible thermosensitive recording member, an image processing apparatus and an image processing method, each using the reversible thermosensitive recording medium.

2. Description of the Related Art

Heretofore, thermosensitive recording media have been widely known that utilize the coloring reaction between an electron donative coloring compound (hereinafter also referred to as a "color coupler or leuco dye") and an electron acceptive compound (hereinafter also referred to as a "developer") and, with the development of office automation, the thermosensitive recording media have widely been used as output sheets for facsimiles, word processors, and scientific measurement instruments. Recently, they have also been used as magnetic thermosensitive cards such as prepaid cards or reward cards. It is required for the thermosensitive recording medium, which is put into practical use, to reconsider recycling or reduction of the amount taking account of environmental problems. However, because of irreversible color development, the thermosensitive recording medium can not be repeatedly used by erasing recorded images, and new information can be merely added at the segment where images are not recorded and the area of recordable segment is limited. Therefore, the current measure to overcome this difficulty is to reduce the amount of information to be recorded or to make a new card at the time when no recording area is available. Thus, it is required to develop a reversible thermosensitive recording medium capable of being overwritten as often as desired, against the backdrop of the problems associated with recent garbage and deforestation.

Various reversible thermosensitive recording media have been proposed in response to these requirements. For example, polymer type reversible thermosensitive recording media utilizing a physical change such as transparency or white turbidity are disclosed (see, for example, Japanese Patent Application Laid-Open (JP-A) Nos. 63-107584 and 04-78573). Also, a dye type reversible thermosensitive recording medium, which utilizes a chemical change, is disclosed. Specifically, there are proposed a reversible thermosensitive recording medium using a combination of gallic acid and phloroglucinol as a developer (see JP-A No. 60-193691), a reversible thermosensitive recording medium using a compound such as phenolphthalein or thymolphthalein as a developer (see JP-A No. 61-237684), reversible thermosensitive recording media wherein a thermosensitive recording layer contains a homogenous compatible material of a color coupler, a developer and a carboxylate ester (JP-A Nos. 62-138556, 62-138568, and 62-140881), a reversible thermosensitive recording medium using an ascorbic acid derivative as a developer (see JP-A No. 63-173684), and a reversible thermosensitive recording medium using a salt of bis(hydroxyphenyl)acetic acid or gallic acid with a higher aliphatic amine as a developer (see JP-A Nos. 02-188293 and 02-188294).

Also, there are developed a reversible thermosensitive color developing composition wherein color development and erasure can be easily conducted under heating and cooling conditions by using an organophosphoric acid compound having a long-chain aliphatic hydrocarbon group, an aliphatic carboxylic acid compound or a phenol compound as a developer and using the compound in combination with a leuco dye as a color coupler and the color developed state and the color erased state can be stably stabilized at normal temperature, and also color development and erasure can be repeated, and a reversible thermosensitive recording medium using the same as a thermosensitive recording layer (see JP-A Nos. 05-124360, 06-210954, and 10-95175).

However, in a conventional reversible thermosensitive recording medium, in case of forming images by heating with a heating element such as thermal head, sticking occurs because of a large frictional force between the heating element and the thermosensitive recording layer, and also periodic irregularity corresponding to dot density of the thermal head is formed on the surface because the surface is likely to be deformed by heat and pressure of a heating element. Therefore, the deformation amount increased while image formation and erasure is repeated, thus making it possible to form clear images.

To solve this problem, there is proposed a method of decreasing a friction coefficient of the surface by providing a protective layer made of a silicone resin or a silicone rubber (see JP-A No. 62-55650). However, because of insufficient adhesion between the protective layer and the thermosensitive recording layer, there arises a problem that peeling is caused by a repeated mechanical action and thus images deteriorate. To improve adhesion, there is proposed a reversible thermosensitive recording medium wherein an intermediate layer made mainly of a resin and a protective layer made mainly of a heat resistant resin are sequentially provided on a thermosensitive recording layer (see JP-A No. 01-133781). According to this proposal, adhesion is improved by the intermediate layer and deformation of the surface of the reversible recording medium is suppressed by the protective layer made of the heat resistant resin. However, in this disposal, when printing and erasing are repeated many times, scratch occurred by sticking or a portion of the protective layer is peeled off and adheres to the thermal head, and accumulation of the peeled material lowers thermal conduction from the thermal head, thus making it difficult to form clear images.

To solve these problems, there is also proposed a reversible thermosensitive recording medium comprising a thermosensitive recording layer and a protective layer, which has not a peak temperature of tan δ (tan δ is a ratio of a dynamic (storage) elastic modulus G' to a dynamic elastic loss modulus G", G"/G') at 250° C. or lower or the corresponding dynamic relaxing phenomenon temperature, formed on the thermosensitive recording layer (see JP-A No. 09-142037). According to this proposal, even if image formation and erasure by a heating element such as thermal head is conducted by the protective layer, periodic occurrence of surface irregularity corresponding to dot density of the thermal head can be considerably suppressed.

However, in case the time of energy to be applied is adjusted to a short-pulse of several milliseconds so as to reduce the time it takes for image processing at the thermal head and applied pressure is increased by a heating element such as thermal head so as to obtain clear images, there arises a problem that cracking occurs on the surface of the protective layer when image formation and erasure is repeated, with speeding up of image processing of an image processing apparatus which conducts image formation and erasure. Also, there arises a problem that the surface state of the protective layer becomes worse as a result of an increase of the amount of cracking and transferability in the image processing apparatus becomes worse, and thus sticking occurs and images deteriorate.

To solve these problems, there is proposed a reversible thermosensitive recording medium comprising a protective layer formed by irradiation with ultraviolet ray at irradiation energy of 150 mJ/cm$^2$ to 1,500 mJ/cm$^2$ so that the protective layer contains an ultraviolet curable resin composition and the ultraviolet curable composition contains an acrylate ester of a bisphenol A diglycidyl ether polymer as an epoxy acrylate having a bisphenol A skeleton, or a dipentaerythritol monohydroxypentaacrylate, and also a tan δ peak temperature of the protective layer, or the corresponding dynamic relaxing phenomenon temperature becomes 155° C. or lower (see JP-A No. 11-334220).

However, the reversible thermosensitive recording media, which have hitherto been proposed, are widely used for applications of magnetic thermosensitive cards such as prepaid cards and reward cards. In these applications, as described above, only an interaction between a thermal head and a reversible thermosensitive recording medium in an image processing apparatus, which conduct image formation and erasure, was discussed and bending of the reversible thermosensitive recording medium by an operator was not assumed at all because of the size of the form and the thickness of the card.

However, recently, the area of applications of the reversible thermosensitive recording medium has quickly been extending to OA equipment such as conference materials for trial printing or single use, and to components control and process control in the factory. In these fields, as compared with a conventional card, display area is widely used within a range from signboard (A6) size to A5 size, A4 size and A3 size. Therefore, since the reversible thermosensitive recording medium is handled in such a manner as in case of a paper, which is not assumed at all in applications of conventional magnetic thermosensitive cards such as prepaid cards and reward cards, a conventional protective layer, whose physical strength with a thermal head is considered to be important, is too hard and cracking occurs in the surface of the medium at the time of handling before repeated printing, and thus images deteriorate. In case images are repeatedly formed and erased, a new problem which has never been anticipated arises, for example, the reversible thermosensitive recording medium curls to the side of the thermosensitive recording surface, and thus it is required to quickly solve these problems.

BRIEF SUMMARY

In this disclosure there is provided a reversible thermosensitive recording medium which does not cause surface cracking even when handled like a paper and does not curl when used repeatedly, and also can keep compatibility between printability, adhesion and transferability of a conventional medium and can repeatedly conduct color development and erasure, and there are provided a reversible thermosensitive recording label, a reversible thermosensitive recording member, an image processing apparatus and an image processing method, each using the reversible thermosensitive recording medium.

This disclosure reflects the finding that, in a reversible thermosensitive recording medium comprising a support, a thermosensitive recording layer formed on the support, and a protective layer formed on the thermosensitive recording layer, when the protective layer is made of two kinds of acrylates having a pentaerythritol group or a dipentaerythritol group used in combination and one compound is an acrylate compound (A) in which a pentaerythritol group or a dipentaerythritol group is directly banded with a polymerizable group having an ester bond, while the other compound is an acrylate compound (B) having a hydrocarbon group, which may have a substituent having an ester bond, between a pentaerythritol group or a dipentaerythritol group and a polymerizable group having an ester bond, thereby enhancing the effect, and also when a mixing mass ratio of the above two kinds of acrylate compounds (A) and (B), (A)/(B), is adjusted within a range from 1.0/9.0 to 5.0/5.0, surface cracking does not occur even when handled like a paper and it becomes possible to improve resistance to cracking and curl, and adhesion.

Some aspects of this disclosure are as follows.

<1> A reversible thermosensitive recording medium including:

a support, a thermosensitive recording layer formed on the support, and a protective layer formed on the thermosensitive recording layer, wherein the thermosensitive recording layer contains an electron donative coloring compound and an electron acceptive compound, and the color tone reversibly changes depending on the temperature, and wherein the protective layer contains a polymer of a composition containing two kinds of acrylate compounds selected from an acrylate compound having a pentaerythritol group and an acrylate compound having a dipentaerythritol group.

<2> The reversible thermosensitive recording medium according to <1>, wherein, among the two kinds of acrylate compounds, one compound is an acrylate compound (A) in which either a pentaerythritol group or a dipentaerythritol group is directly bonded to a polymerizable group having an ester bond, and the other compound is an acrylate compound (B) having a chain hydrocarbon group which may have a substituent having an ester bond, between either a pentaerythritol group or a dipentaerythritol group and a polymerizable group having an ester bond.

<3> The reversible thermosensitive recording medium according to <2>, wherein the mixing mass ratio of two kinds of acrylate compounds (A) and (B), (A)/(B), is from 1.0/9.0 to 5.0/5.0.

<4> The reversible thermosensitive recording medium according to <1>, wherein the two kinds of acrylate compounds are represented by the following structural formulas (1) and (2):

Structural Formula (1)

Acrylate (A): 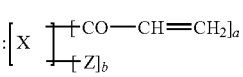

Structural Formula (2)

Acrylate (B): 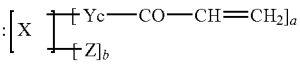

in the structural formulas (1) and (2), X represents a pentaerythritol group or a dipentaerythritol group, Y represents —$CH_2O$—, —$CH_2CH_2O$—, —$CH_2CH_2CH_2O$—, —$CH_2CH_2CH_2CH_2O$—, —$CH_2CH_2CH_2CH_2CH_2O$—, —$CH_2CH(CH_3)O$—, or —CO—$CH_2CH_2CH_2CH_2CH_2O$—, Z represents —H or —CO—CH=$CH_2$, a represents 1 to 5, b represents 1 to 5, and c represents 1 to 12.

<5> The reversible thermosensitive recording medium according to <1>, wherein the electron acceptive compound is a phenol compound represented by one of the following structural formulas (3) and (4):

Structural Formula (3)

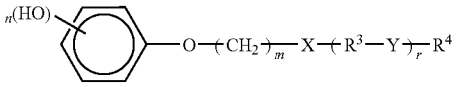

in the structural formula (3), X and Y represent a divalent organic group containing a hetero atom, $R^3$ represents a divalent hydrocarbon which may have a substituent, $R^4$ represents a monovalent hydrocarbon group which may have a substituent, n represents an integer of 1 to 3, m represents an integer of 1 to 20, and r represents an integer of 0 to 3; and Structural Formula (4)

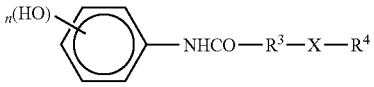

in the structural formula (4), n represents an integer of 1 to 3, X represents a divalent organic group containing a hetero atom, $R^3$ represents a divalent hydrocarbon which may have a substituent, and $R^4$ represents a monovalent hydrocarbon group which may have a substituent.

<6> The reversible thermosensitive recording medium according to <1>, wherein a layer in contact with the surface of the support side of the protective layer contains an acrylate compound having either a pentaerythritol group or a dipentaerythritol group.

<7> The reversible thermosensitive recording medium according to <6>, wherein the acrylate compound having either a pentaerythritol group or a dipentaerythritol group is an acrylate compound (C) represented by the following structural formula (5):

Structural Formula (5)

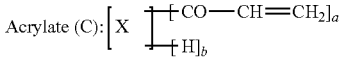

in the structural formula (5), X represents a pentaerythritol group or a dipentaerythritol group, a represents 1 to 5, and b represents 1 to 5.

<8> The reversible thermosensitive recording medium according to <7>, wherein the content of the acrylate compound (C) corresponds to a ratio, dry mass of the acrylate compound (C)/dry mass of the layer containing the acrylate compound (C), of 0.01 to 0.10.

<9> The reversible thermosensitive recording medium according to <6>, wherein the layer in contact with the surface of the support side of the protective layer is a thermosensitive recording layer.

<10> The reversible thermosensitive recording medium according to <6>, wherein the layer in contact with the surface of the support side of the protective layer is an intermediate layer between the thermosensitive recording layer and the protective layer.

<11> The reversible thermosensitive recording medium according to <1>, wherein the reversible thermosensitive recording medium comprises at least a heat insulating layer containing hollow particles between the thermosensitive recording layer and the support.

<12> The reversible thermosensitive recording medium according to <11>, wherein the hollow particles has porosity of 70% or more and have a maximum particle size (D100) of 5.0 μm to 10.0 μm, and also a ratio of the maximum particle size to a particle size (D50) at 50% frequency, (D100/D50), is from 2.0 to 3.0 and the material constituting the hollow particles is a copolymer containing at least either acrylonitrile or methacrylonitrile as a monomer unit.

<13> The reversible thermosensitive recording medium according to <1>, wherein the reversible thermosensitive recording medium is processed into a form of label, sheet or roll.

<14> The reversible thermosensitive recording medium according to <1>, wherein the reversible thermosensitive recording medium comprises at least one of irreversible visual information and a printable section in at least a portion of at least one of a surface of the reversible thermosensitive recording medium on which an image is to be formed, and the opposite surface thereof.

<15> A reversible thermosensitive recording label including:

one of an adhesive layer and a binder layer on a surface opposite to the surface of the thermosensitive recording medium according to <1> on which an image to be formed.

<16> A reversible thermosensitive recording member including:

an information storage section, and a reversible display section, wherein the reversible display section comprises a reversible thermosensitive recording medium according to <1>.

<17> The reversible thermosensitive recording member according to <16>, wherein the information recording section is any one selected from a magnetic thermosensitive recording layer, a magnetic stripe, an IC memory, an optical memory, a hologram, an RF-ID tag card, a disc, a disc cartridge, and a tape cassette.

<18> An image processing apparatus including:

at least one of an image forming unit configured to heat a reversible thermosensitive recording medium to thereby form an image on the reversible thermosensitive recording medium, and an image erasing unit configured to heat a reversible thermosensitive recording medium to thereby erase an image formed on the reversible thermosensitive recording medium, wherein the reversible thermosensitive recording medium is a reversible thermosensitive recording medium according to <1>.

<19> The image processing apparatus according to <18>, wherein the image forming unit is one of a thermal head and a laser irradiation device.

<20> The image processing apparatus according to <18>, wherein the image erasing unit is any one selected from a thermal head, a ceramic heater, a heat roll, a hot stamp, a heat block, and a laser irradiation device.

<21> An image processing method including:

at least one of heating a reversible thermosensitive recording medium to thereby form an image on the reversible thermosensitive recording medium, and heating a reversible thermosensitive recording medium to thereby erase an image formed on the reversible thermosensitive recording medium, wherein the reversible thermosensitive recording medium is a reversible thermosensitive recording medium according to <1>.

<22> The image processing method according to <21>, wherein the images is formed using one of a thermal head and a laser irradiation device.

<23> The image processing method according to <21>, wherein the image is erased using any one selected from a thermal head, a ceramic heater, a heat roll, a hot stamp, a heat block, and a laser irradiation device.

<24> The image processing method according to <22>, further comprising forming a new image while erasing the image using the thermal head.

The reversible thermosensitive recording medium of the present invention comprises a support, a thermosensitive recording layer formed on the support, and a protective layer formed on the thermosensitive recording layer, wherein the thermosensitive recording layer contains an electron donative coloring compound and an electron acceptive compound, and the color tone reversibly changes depending on the temperature, and the protective layer contains a polymer of a composition containing two kinds of acrylate compounds selected from an acrylate compound having a pentaerythritol group and an acrylate compound having a dipentaerythritol group. With this configuration, even when handled like a paper sheet, surface cracking does not occur and the medium does not curl when used repeatedly, and also compatibility between printability, adhesion and transferability of a conventional medium can be kept and color development and erasure can be stably repeated.

The reversible thermosensitive recording label of the present invention has either an adhesive layer or a binder layer on the surface opposite to the surface the thermosensitive recording medium of the present invention on which an image is to be formed. The reversible thermosensitive recording label has either the adhesive layer or binder layer and therefore can be widely applied to a thick support of a vinyl chloride card with a magnetic stripe, on which the thermosensitive recording layer is directly formed, a container having a sheet size larger than a card size, a sticker, and a large screen.

The reversible thermosensitive recording member of the present invention comprises an information storage section and a reversible display section, the reversible display section being made of the reversible thermosensitive recording medium of the present invention, and therefore causes no surface cracking even when handled like a paper and the medium does not curl when used repeatedly, and also compatibility between printability, adhesion and transferability of a conventional medium can be kept and color development and erasure can be stably repeated. In the information recording section, desired various informations such as character information, image information, music information and video information are recorded and erased by a recording system according to the kinds such as magnetic thermosensitive recording layer, magnetic stripe, IC memory, optical memory, RF-ID tag card, disk, disk cartridge, tape cassette and hologram.

The image processing apparatus of the present invention comprises at least image forming unit configured to heat the reversible thermosensitive recording medium of the present invention thereby forming images, or image erasing configured to erase the images. In the image processing apparatus, the reversible thermosensitive recording medium of the present invention is heated by the image forming unit heat thereby forming images on the reversible thermosensitive recording medium. On the other hand, the reversible thermosensitive recording medium of the present invention is heated by the image erasing unit thereby erasing the images formed on the reversible thermosensitive recording medium. In the present invention, since the reversible thermosensitive recording medium of the present invention is used as the reversible thermosensitive recording medium, surface cracking does not occur even when handled like a paper and the medium does not curl even when used repeatedly, and also compatibility between printability, adhesion and transferability of a conventional medium can be kept and color development and erasure can be stably repeated, and thus highly practical rewriting recording can be conducted.

According to the image processing method of the present invention, either formation of images or erasure of images is conducted by heating the reversible thermosensitive recording medium of the present invention. In the mage processing method, the reversible thermosensitive recording medium of the present invention is heated thereby forming images on the reversible thermosensitive recording medium. On the other hand, the reversible thermosensitive recording medium of the present invention is heated thereby erasing the images formed on the reversible thermosensitive recording medium. In the present invention, since the reversible thermosensitive recording medium of the present invention is used as the reversible thermosensitive recording medium, surface cracking does not occur even when handled like a paper and the medium does not curl even when used repeatedly, and also compatibility between printability, adhesion and transferability of a conventional medium can be kept and color development and erasure can be stably repeated, and thus images having high color development density can be formed.

DETAILED DESCRIPTION OF THE INVENTION

Reversible Thermosensitive Recording Medium

Figure 1:
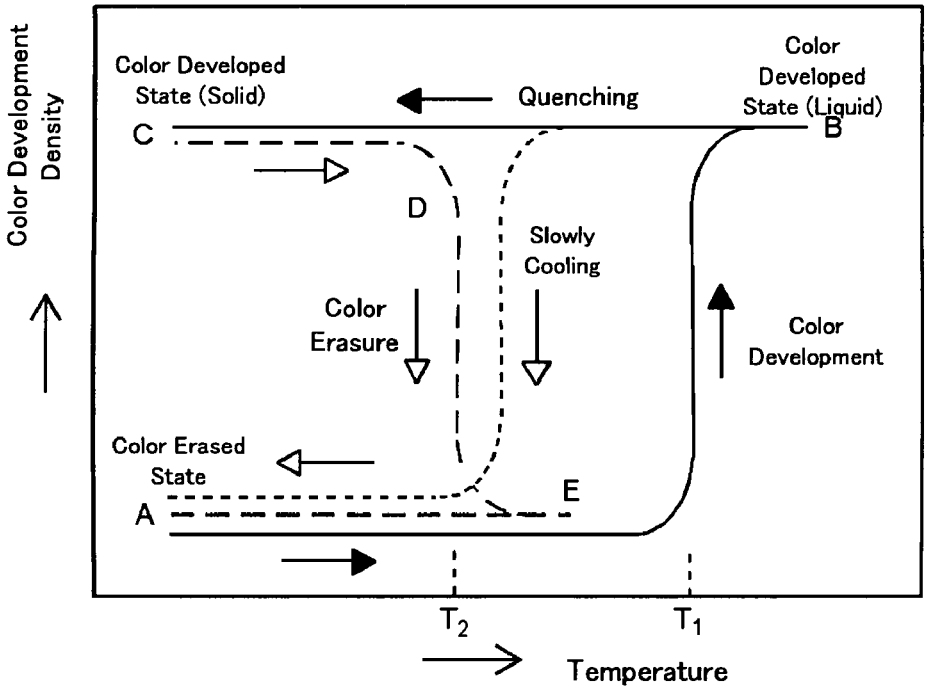
FIG. 1 is a graph showing color developing and erasing characteristics (color developing and erasing phenomenon) in a reversible thermosensitive recording medium of the present invention.

The reversible thermosensitive recording medium of the present invention comprises a support, a thermosensitive recording layer formed on the support and a protective layer formed on the thermosensitive recording layer, and also comprises an under layer, an intermediate layer and, if necessary, other layers.

<Protective Layer>

The reversible thermosensitive recording medium, which has hitherto been proposed, is widely used for applications of magnetic thermosensitive cards such as prepaid cards and reward cards. In the field of magnetic thermosensitive cards, only an interaction between a thermal head and a reversible thermosensitive recording medium in an image processing apparatus which conduct image formation and erasure has been discussed. However in the fields of OA equipment and components control and process control of the factory, since the reversible thermosensitive recording medium is handled in such a manner as in case of a paper, which is not assumed at all in the field of a conventional magnetic thermosensitive card, a conventional protective layer, whose physical strength with a thermal head is considered to be important, is too hard and cracking occurs in the surface of the medium at the time of handling before repeated printing, and thus images deteriorate. In case images are repeatedly formed and erased, a new problem which has never been anticipated arises, for example, the reversible thermosensitive recording medium curls to the side of the thermosensitive recording surface, and thus it is required to quickly solve these problems.

Regarding the mechanism wherein cracking occurs on the surface of the medium in case of handling by the operator, since the operator holds the reversible thermosensitive recording medium like a paper thereby bending or folding the paper, flexibility of the protective layer as an outermost layer cannot follow flexibility of the support and cracking occurs on the surface of the protective layer, and thus propagation of cracking occurs in a direction of the support.

To produce a reversible thermosensitive recording medium like paper, the total thickness must be reduced as compared with applications of magnetic thermosensitive cards such as prepaid cards and reward cards. The reason is as follows. That is, when the sheet has a large thickness, the operator feels heavy and operation efficiency decreases. However, since a thin base material lacks stiffness, the reversible thermosensitive recording medium curls toward the thermosensitive recording surface when images are repeatedly formed and erased. In case of this mechanism, although a material capable of forming a coating layer having high hardness as the protective layer so as to increase the physical strength with the thermal head due to repeating, in the field of the card, the base material exerts a strong force to return its original state ageist a force of shrinkage of the protective layer because of a large thickness of the base material, and therefore the card is less likely to curl. However, in the fields of OA equipment and applications of components control and process control in the factory, since the thickness of the base material is decreased in view of operability, it was made clear that, in case of using a conventional protective layer, curling occurs because a force of shrinkage of the protective layer is more than a force to return its original state of the base material against heat of the thermal head.

That is, it was found that, in the prior art documents relating to conventional designing of protective layers, which haveen hitherto been disclosed, a conventional concept of hardening the protective layer so as to increase the physical strength with the thermal head cannot cope in a new way of use in new fields.

The present inventors have intensively studied and found that the above problem can be solved by imparting flexibility to the protective layer so as to be as flexible as the support. However, in case of a protective layer made of ultraviolet curable resin composition having simply high flexibility, cracking and curl can be improved, but it is difficult to simultaneously achieve printability, adhesion, transferability, and stability upon repeating of color development and erasure of a conventional medium.

Thus, the present inventors can solve a new problem such as surface cracking caused upon handling of the operator, which has never been anticipated, when the protective layer contains a polymer of an ultraviolet curable resin composition containing two kinds of acrylate compounds selected from an acrylate compound having a pentaerythritol group and an acrylate compound having a dipentaerythritol group.

It was found that the above problem can be solved when, among two kinds of acrylate compounds, one compound is an acrylate compound (A) in which either a pentaerythritol group or a dipentaerythritol group is directly bonded to a polymerizable group having an ester bond, and the other compound is an acrylate compound (B) having a chain hydrocarbon group, which may have a substituent having an ester bond, between either a pentaerythritol group or a dipentaerythritol group and a polymerizable group having an ester bond.

The acrylate compound (A) is very effective to printability, adhesion, transferability, and stability upon repeating of color development and erasure, while a hydrocarbon group, which may have a substituent having an ester bond of the acrylate compound (B) imparts flexibility to a coating film, and is very effective to prevent cracking and curl.

Two kinds of acrylate compounds (A) and (B) are preferably compounds represented by the following structural formulas (1) and (2):

Structural Formula (1)

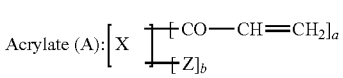

Structural Formula (2)

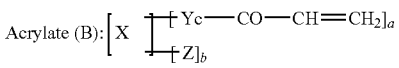

in the structural formulas (1) and (2), X represents a pentaerythritol group or a dipentaerythritol group, Y represents —$CH_2O$—, —$CH_2CH_2O$—, —$CH_2CH_2CH_2O$—, —$CH_2CH_2CH_2CH_2O$—, —$CH_2CH_2CH_2CH_2CH_2O$—, —$CH_2CH(CH_3)O$—, or —CO—$CH_2CH_2CH_2CH_2CH_2O$—, Z represents —H or —CO—CH═$CH_2$, a represents 1 to 5, b represents 1 to 5, and c represents 1 to 12.

When the mixing mass ratio of two kinds of acrylate compounds (A) and (B), (A)/(B), is from 1.0/9.0 to 5.0/5.0, it is remarkably effective to keep compatibility between printability, adhesion, transferability, stability upon repeating of color development and erasure, and resistance to cracking and curl. The mixing mass ratio of two kinds of acrylates (A) and (B), (A)/(B), is more preferably from 1.0/9.0 to 5.0/5.0, still more preferably from 1.5/8.5 to 4.5/5.5, and particularly preferably from 2.0/8.0 to 4.0/6.0. When the mixing mass ratio of the acrylate compounds (A) and (B), (A)/(B), is more than 5.0/5.0, since sufficient flexibility cannot be imparted to the coating film, the effect of preventing cracking and curl is not obtained. On the other hand, when the mixing mass ratio of the acrylate compounds (A) and (B), (A)/(B), is less than 1.0/9.0, although sufficient flexibility can be imparted to the coating film, the effect of improving curl, printability, transferability, and stability upon repeating of color development and erasure are no obtained.

The total content of the two acrylate compounds in the composition is preferably from 50% by mass to 100% by mass, and more preferably from 60% by mass to 100% by mass.

Fillers may be added to the protective layer and the fillers can be roughly classified into inorganic fillers and organic fillers. Examples of the inorganic fillers include carbonates such as calcium carbonate and magnesium carbonate; silicates such as silicic anhydride, hydrous silicic acid, hydrous aluminum silicate, and hydrous calcium silicate; hydroxides such as alumina and iron oxide; metal oxides such as zinc oxide, indium oxide, alumina, silica, zirconia oxide, tin oxide, cerium oxide, iron oxide, antimony oxide, barium oxide, calcium oxide, barium oxide, bismuth oxide, nickel oxide, magnesium oxide, chromium oxide, manganese oxide, tantalum oxide, niobium oxide, titanium oxide, thorium oxide, hafnium oxide, molybdenum oxide, iron ferrite, nickel ferrite, cobalt ferrite, barium titanate, and potassium titanate; metal sulfides and sulfuric acid compounds, such as zinc sulfide and barium sulfate; metal carbides such as titanium carbide, silicone carbide, molybdenum carbide, tungsten carbide, and tantalum carbide; and metal nitrides such as aluminum nitride, silicon nitride, boron nitride, zirconium nitride, vanadium nitride, titanium nitride, niobium nitride, and gallium nitride.

Examples of materials of the organic fillers include silicone resins, cellulose resins, epoxy resins, nylon resins, phenol resins, polyurethane resins, urea resins, melamine resins, polyester resins, polycarbonate resins, styrene resins such as polystyrene, polystyrene-isoprene and polystyrene-vinylbenzene, acrylic resins such as vinylidene chloride-acryl, acrylurethane and ethyleneacryl, polyethylene resins, formaldehyde resins such as benzoguanamine formaldehyde and melamineformaldehyde, polymethyl methacrylate resins, and vinyl chloride resins. These materials can be used alone or in combination, or may be composite particles. Examples of the shape include spherical, granular, tabular, and needle-like shapes.

Also, lubricants may be added to the protective layer, and specific example of the lubricants include synthetic waxes such as ester wax, paraffin wax, and polyethylene wax; vegetable waxes such as hardened castor oil; animal waxes such as hardened beef tallow; higher alcohols such as stearyl alcohol and behenyl alcohol; higher fatty acids such as margaric acid, lauric acid, myristic acid, palmitic acid, stearic acid, behenic acid, and FROMEN acid; higher fatty acid esters such as sorbitan fatty acid esters; amides such as stearic acid amide, oleic acid amide, lauric acid amide, ethylenebisstearamide, methylenebisstearamide, and methylolstearamide.

The protective layer may contain releasing agents and ultraviolet absorbers, and also may contain other components, if necessary.

Examples of the releasing agent include silicone having a polymerizable group, silicone grafted polymer, wax, zinc stearate, and silicone oil.

The amount of the releasing agent to be added is preferably from 0.01% by mass to 50% by mass, more preferably from 0.1% by mass to 40% by mass, and still more preferably from is 1% by mass to 30% by mass, based on the total mass of the resin component of the protective layer. When the amount is less than 0.01% by mass, it becomes impossible to obtain the effect of the addition. On the other hand, when the amount exceeds 50% by mass, there may arise a problem such as adhesion to the lower layer.

The protective layer may contain, as the other components, additives, such as conventionally known surfactants, leveling agents, and/or antistatic agents.

As a device for dispersing a solvent and a coating solution used in a coating solution of the protective layer, a drying method and a curing method, for example, known methods used in a thermosensitive recording layer described hereinafter can be used.

The thickness of the protective layer is preferably from 0.1 μm to 20 μm, more preferably from 0.5 μm to 10 μm, and still more preferably from 1.5 μm to 6 μm. When the thickness is less than 0.1 μm, the protective layer is broken when erasure and printing of recorded images are repeated, and thus sufficient durability is not obtained. Also, the protective layer may be easily attacked by a chemical thereby to lose a function for serving as a reversible thermosensitive recording medium. On the other hand, when the thickness is more than 20 μm, only blurred images having poor dot reproducibility (fineness of printed image) are obtained, and also energy used for printing and erasure may increase because of poor thermal conductivity, resulting in increase of burden on the device.

In the present invention, the layer in contact with the surface of the support side of the protective layer preferably contains an acrylate compound having either a pentaerythritol group or a dipentaerythritol group, thereby making it possible to further improve compatibility between adhesion and resistance to cracking.

Examples of the layer in contact with the surface of the support side of the protective layer include a thermosensitive recording layer, and an intermediate layer between the thermosensitive recording layer and the protective layer. The thermosensitive recording layer and the intermediate layer will be described hereinafter.

The acrylate compound having either a pentaerythritol group or a dipentaerythritol group is preferably an acrylate compound (C) represented by the following structural formula (5). As a result, a hydroxyl group (a hydroxyl group moiety formed by bonding a pentaerythritol group or a dipentaerythritol group with a hydrogen group) of the acrylate compound (C) is bonded with the components in the protective layer thereby increasing an interlayer binding force, and thus making it possible to further improve compatibility between resistance to cracking and curl, and adhesion:

Structural Formula (5)

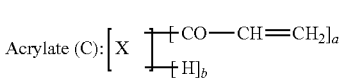

in the structural formula (5), X represents a pentaerythritol group or a dipentaerythritol group, a represents 1 to 5, and b represents 1 to 5.

The content of the acrylate compound (C) preferably corresponds to a ratio, dry mass of the acrylate compound (C)/dry mass of the layer containing the acrylate compound (C), of 0.01 to 0.10. As a result, it is remarkably effective to keep compatibility between resistance to cracking and curl, and adhesion.

The content of the acrylate compound (C) preferably corresponds to a ratio, dry mass of the acrylate compound (C)/dry mass of the layer containing the acrylate compound (C), of 0.01 to 0.10, and more preferably 0.01 to 0.08, and still more preferably 0.01 to 0.07. When the ratio, dry mass of the acrylate compound (C)/dry mass of the layer containing the acrylate compound (C), is less than 0.01, it is impossible to obtain a remarkable effect on keeping of compatibility between adhesion and resistance to cracking. On the other hand, when the ratio is more than 0.10, stability upon repeating of color development and erasure may become worse.

<Thermosensitive Recording Layer>

The thermosensitive recording layer comprises an electron donative coloring compound and an electron acceptive compound, and the color tone reversibly changes depending on the temperature.

In the present invention, when the thermosensitive recording layer is the layer in contact with the surface of the support side of the protective layer, the thermosensitive recording layer preferably contains either an acrylate compound having a pentaerythritol group or an acrylate compound having a dipentaerythritol group and, specifically, it preferably contains an acrylate compound (C) represented by the structural formula (5).

The phrase "the color tone reversibly changes depending on the temperature" in the thermosensitive recording layer means a phenomenon of reversibly causing a visual change by the temperature change, and also means that relatively color developed and erased state can be formed by a difference in a rate of heating and a rate of cooling after heating. In this case, visible change is classified into a change in the state of color and a change in a shape, and a material causing a change in the state of color is mainly used in the present invention. The change in the state of color includes changes in light transmittance, reflectance, absorption wavelength and scattering degree, and an actual reversible thermosensitive recording material displays by a combination of these changes. More specifically, the reversible thermosensitive recording material is not specifically limited as long as transparency and color tone reversibly change and can be appropriately selected according to the purposes and includes, for example, a reversible thermosensitive recording material which becomes the state of first color at a first specific temperature higher than a normal temperature, and becomes the state of second color by heating at a second specific temperature higher than the first specific temperature, followed by cooling. Among these, a reversible thermosensitive recording material, wherein the state of color changes at the first specific temperature and the second specific temperature, is particularly preferable.

Examples of the reversible thermosensitive recording material include a reversible thermosensitive recording material which become a transparent state at the first specific temperature and becomes an opaque state at the second specific temperature (JP-A No. 55-154198), reversible thermosensitive recording materials wherein color is developed at the second specific temperature and color is erased at the first specific temperature (JP-A Nos. 04-224996, 04-247985, and 04-267190), a reversible thermosensitive recording material which becomes an opaque state at the first specific temperature and becomes a transparent state at the second specific temperature (JP-A No. 03-169590), and reversible thermosensitive recording materials wherein black, red and blue colors are developed at the first specific temperature and colors are erased at the second specific temperature (JP-A Nos. 02-188293 and 02-188294).

The reversible thermosensitive recording medium of the present invention can form relatively color developed and erased state by either a heating temperature or a rate of cooling after heating. Herein, a basic color developing and erasing phenomenon of a composition comprising a color coupler and a developer will be described. FIG. 1 shows a relation between the color development density and the temperature of the reversible thermosensitive recording medium. As the temperature of a recording medium in a color erased state (A) raises, color development occurs at a temperature T1 at which melting begins to attain a molten color developed state (B). In case of quenching from the color developed state (B), the temperature can be decreased to room temperature while maintaining the color developed state to attain a solidified color developed state (C). It depends on the rate of cooling from the molten state whether or not this color developed state is obtained. Color erasure occurs during cooling in case of slow cooling, and the state of comparatively low concentration is formed by the color erased state (A), which is the same as the original state, or a quenched color developed state (C). On the other hand, as the temperature of the quenched color developed state (C) is raised again, color erasure occurs at a temperature T2 lower than the color developing temperature (from D to E) and the state return to the color erased state (A), which is the same as the original state, when cooling is initiated from this state. Actual color developing temperature and color erasure temperature change with a combination of a developer and a color coupler to be used, and therefore can be selected according to the purposes. The concentration of the molten color developed state and the color development density obtained when quenched do not agree necessarily, and may be different.

In the reversible thermosensitive recording medium, the color developed state (C) obtained by quenching from the molten state is a state where a developer and a color coupler are mixed while molecules thereof can be catalytically reacted, and a solid state is often formed. It is considered that the state is a state where a developer and a color coupler are aggregated and color development is maintained, and color development is stabilized by formation of this aggregated structure. On the other hand, the color erased state is a state where both of them are phase separated. This state is considered to be a state where molecules of at least one compound are aggregated t and a developer are separated and stabilized by aggregation or crystallization. In many cases, when the both of them are phase separated and the developer is crystallized, complete color erasure occurs. Regarding color erasure by slow cooling from the molten state shown in FIG. 1 and color erasure by heating from the color erased and developed state, the aggregated structure changes at this temperature, and phase separation and crystallization of the developer occur.

In the reversible thermosensitive recording medium of the present invention, color development recording may be formed by heating to the temperature, at which melting and mixing is conducted, by a thermal head, followed by quenching. Color erasure is conducted by two methods, for example, a method of slowly cooling from a heated state and a method of heating to the temperature which is slightly lower than the color developing temperature. However, these methods are the same in that both of them are phase separated or at least one of them is temporarily maintained at the crystallization temperature. Quenching is conducted in the formation of a color developed state so as not to maintain at the phase separation temperature or the crystallization temperature. Herein, quenching and slow cooling are relative to one composition and the boundary varies according to a combination of the color coupler and the developer.

—Electron Acceptive Compound—

The electron acceptive compound (developer) is not specifically limited as long as it can reversibly conduct color development and erasure by means of heat as a factor, and can be appropriately selected according to the purposes. For example, a compound having one or more structures selected from (i) a structure having developing capability of conducting color development of an electron donative coloring compound (color coupler) (for example, phenolic hydroxyl group, carboxylic acid group, phosphoric acid group, etc.), and (ii) a structure of controlling a molecular cohesive force (for example, structure linked with a long chain hydrocarbon group) in the molecule is preferable. The linking moiety may be present via a divalent or multivalent linking group containing hetero atom, and also a long chain hydrocarbon group may have at least either the same linking group or an aromatic group. Particularly preferable compounds are a phenol compound represented by the following structural formula (3) and a phenyl compound represented by the following structural formula (4):

Structural Formula (3)

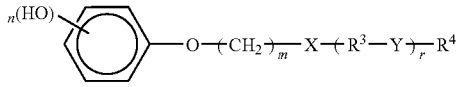

in the structural formula (3), X and Y represent a divalent organic group containing a hetero atom, $R^3$ represents a divalent hydrocarbon which may have a substituent, $R^4$ represents a monovalent hydrocarbon group which may have a substituent, n represents an integer of 1 to 3, m represents an integer of 1 to 20, and r represents an integer of 0 to 3; and Structural Formula (4)

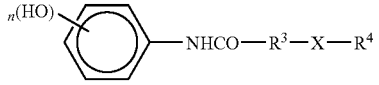

in the structural formula (4), n represents an integer of 1 to 3, X represents a divalent organic group containing a hetero atom, $R^3$ represents a divalent hydrocarbon which may have a substituent, and $R^4$ represents a monovalent hydrocarbon group which may have a substituent; and $R^3$ in the structural formulas (3) and (4) represents a divalent hydrocarbon group having 1 to 20 carbon atoms which may be substituted with a substituent.

$R^3$ is preferably as follows:

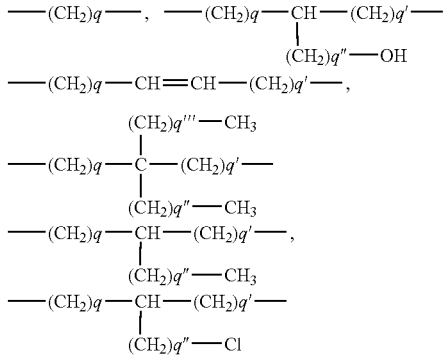

wherein q, q', q" and q'" each represents an integer which satisfies the number of carbon atoms as for $R^3$, and $—(CH_2)_q—$ is particularly preferable.

$R^4$ in the structural formulas (3) and (4) represents an aliphatic hydrocarbon group having 1 to 24 carbon atoms which may be substituted with a substituent, and the number of carbon atoms is preferably from 8 to 18.

The aliphatic hydrocarbon group may be linear or branched, and may have an unsaturated bond. Examples of the substituent bonded to a hydrocarbon group include hydroxyl group, halogen atom, and alkoxy group. Since stability of color development of color erasure deteriorate when the sum of the number of carbon atoms of $R^3$ and $R^4$ is 7 or less, the number of carbon atoms is preferably 8 or more, and more preferably 11 or more.

$R^4$ is preferably as follows:

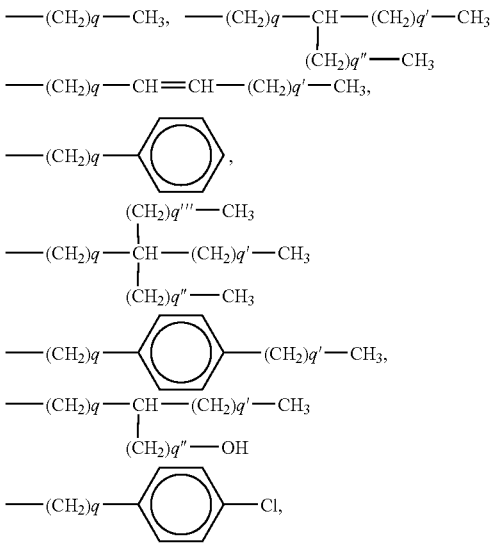

wherein q, q', q" and q'" each represents an integer which satisfies the number of carbon atoms as for $R^4$, and $—(CH_2)_q—CH_3$ is particularly preferable.

X and Y in the structural formulas (3) and (4) represent a divalent organic group containing a hetero atom, particularly preferably a divalent organic group having a nitrogen atom or an oxygen atom and, for example, represents a divalent organic group having at least one group represented by the following structural formulas.

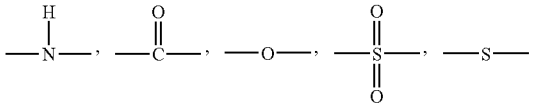

The divalent organic group preferably includes groups represented by the following structural formulas.

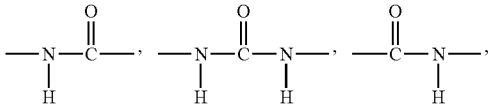

-continued

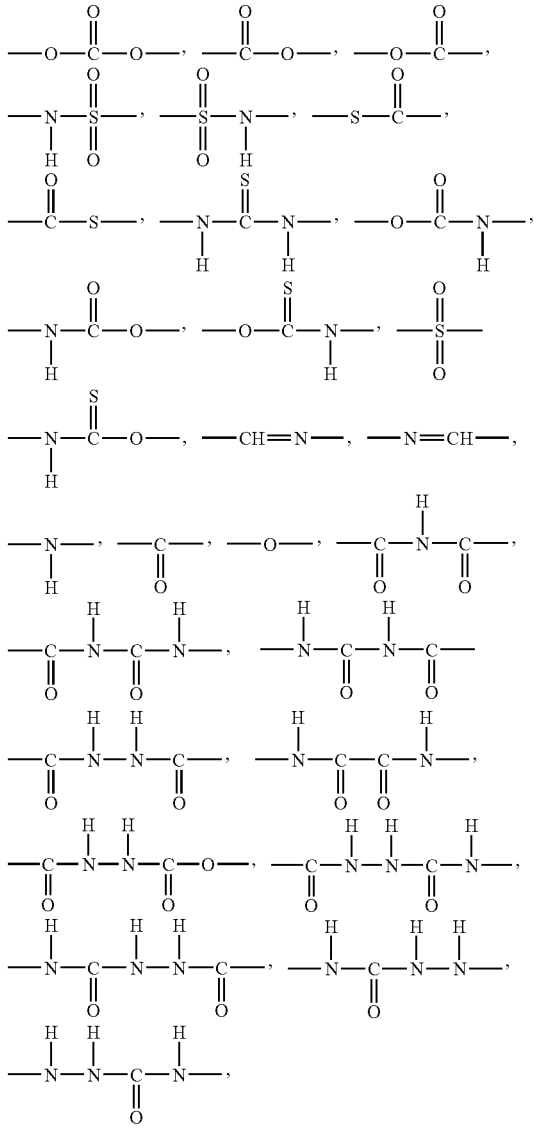

Among these groups, particularly preferable groups are those represented by the following structural formulas.

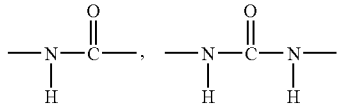

Examples of phenol compounds represented by the structural formula (3) include compounds represented by the following structural formulas (3-1) to (3-4):

Structural Formula (3-1)

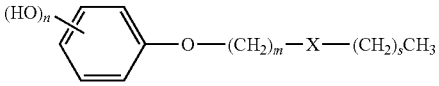

-continued

Structural Formula (3-2)

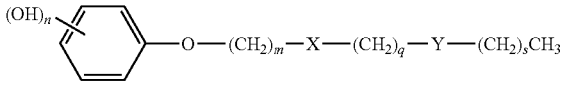

Structural Formula (3-3)

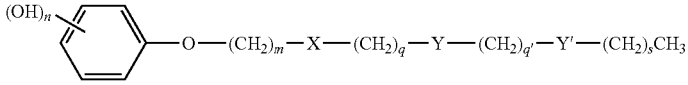

Structural Formula (3-4)

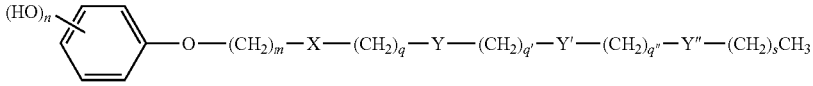

in the structural formulas (3-1) to (3-4), q, q', q" and s each independently represents an integer of 0 to 20 and the sum of these integers is 8 or more, and Y, Y' and Y" represent a divalent organic group containing a hetero atom and these substituents may be the same or different.

As the phenol compound represented by the structural formula (3), for example, examples of the structural formulas (3-1) and (3-2) include compounds shown in Table 1. Also in case of compounds represented by the structural formulas (3-3) and (3-4), specific examples of X and Y include, but are not limited to, the same substituents as those shown in Table 1.

TABLE 1

| n | m | X | q | Y | s |
|---|---|---|---|---|---|
| 1(p-) | 1 | —NHCO— | 0 | — | 16 |
| 1(p-) | 2 | —NHCO— | 0 | — | 16 |
| 1(p-) | 2 | —NHCONH— | 0 | — | 16 |
| 1(p-) | 3 | —NHCONH— | 0 | — | 16 |
| 1(p-) | 1 | —NHCONHSO□— | 0 | — | 16 |
| 1(p-) | 3 | —NHCOO— | 0 | — | 16 |
| 1(p-) | 1 | —NHCSO— | 0 | — | 16 |
| 1(p-) | 1 | —NHCSNH— | 0 | — | 16 |
| 1(p-) | 2 | —CONH— | 0 | — | 16 |
| 1(p-) | 1 | —CONH— | 0 | — | 16 |
| 1(p-) | 3 | —COO— | 0 | — | 16 |
| 1(p-) | 8 | —O— | 0 | — | 16 |
| 1(p-) | 1 | —CONH— | 0 | — | 16 |
| 1(p-) | 2 | —CONHNH— | 0 | — | 16 |
| 1(p-) | 3 | —OCONH— | 0 | — | 16 |
| 1(p-) | 2 | —OCO— | 0 | — | 16 |
| 1(p-) | 1 | —NHCO— | 2 | —NHCO— | 16 |
| 1(p-) | 1 | —NHCO— | 4 | —NHCONH— | 17 |
| 1(p-) | 1 | —NHCO— | 5 | —OCONH— | 17 |
| 1(p-) | 2 | —NHCO— | 4 | —CONH— | 17 |
| 1(p-) | 2 | —NHCO— | 4 | —O— | 17 |
| 1(p-) | 2 | —NHCO— | 4 | —$SO_2$— | 17 |
| 1(p-) | 6 | —CONH— | 5 | —CONHCO— | 12 |
| 1(p-) | 1 | —CONH— | 4 | —NHCONH— | 17 |
| 1(p-) | 2 | —CONH— | 2 | —NHCO— | 16 |
| 1(p-) | 4 | —CONH— | 6 | —NHCOO— | 11 |
| 1(p-) | 1 | —CONH— | 6 | —$SO_2$— | 11 |
| 1(p-) | 1 | —CONH— | 6 | —S— | 11 |
| 1(p-) | 1 | —COO— | 2 | —NHCO— | 16 |
| 1(p-) | 1 | —COO— | 3 | —CONH— | 16 |
| 1(p-) | 3 | —CONHCO— | 10 | —COO— | 12 |
| 1(p-) | 2 | —CONHCO— | 6 | —NHCONH— | 17 |
| 1(p-) | 5 | —NHCOO— | 10 | —NHCO— | 12 |

The phenol compound represented by the structural formula (4) is preferably a compound of either the following structural formula (4-1) or (4-2):

Structural Formula (4-1)

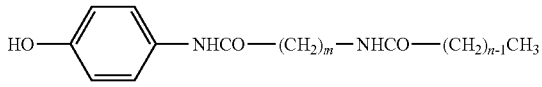

Structural Formula (4-2)

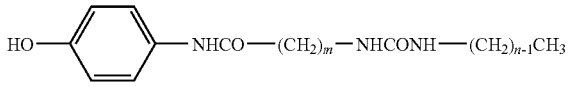

in the structural formulas (4-1) and (4-2), m represents 5 to 11 and n represents 8 to 22.

Specific examples of the phenol compounds represented by the structural formulas (4-1) and (4-2) include the followings.

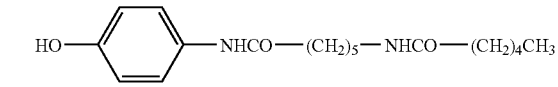

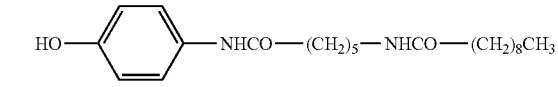

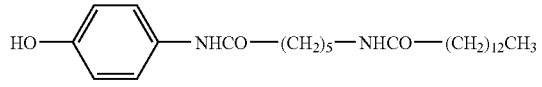

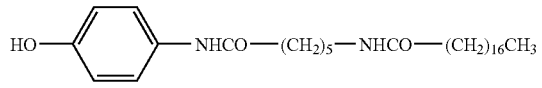

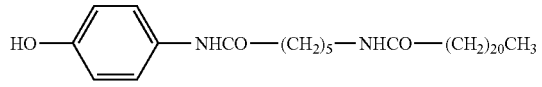

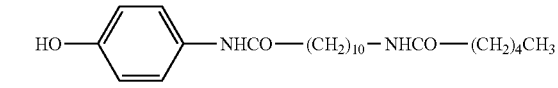

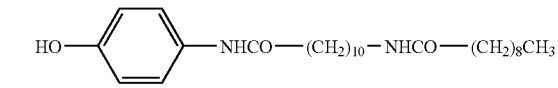

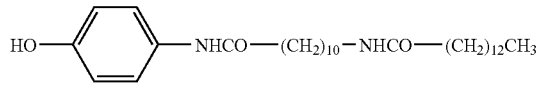

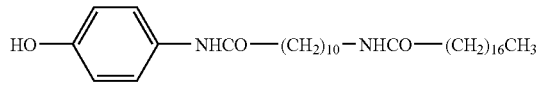

-continued

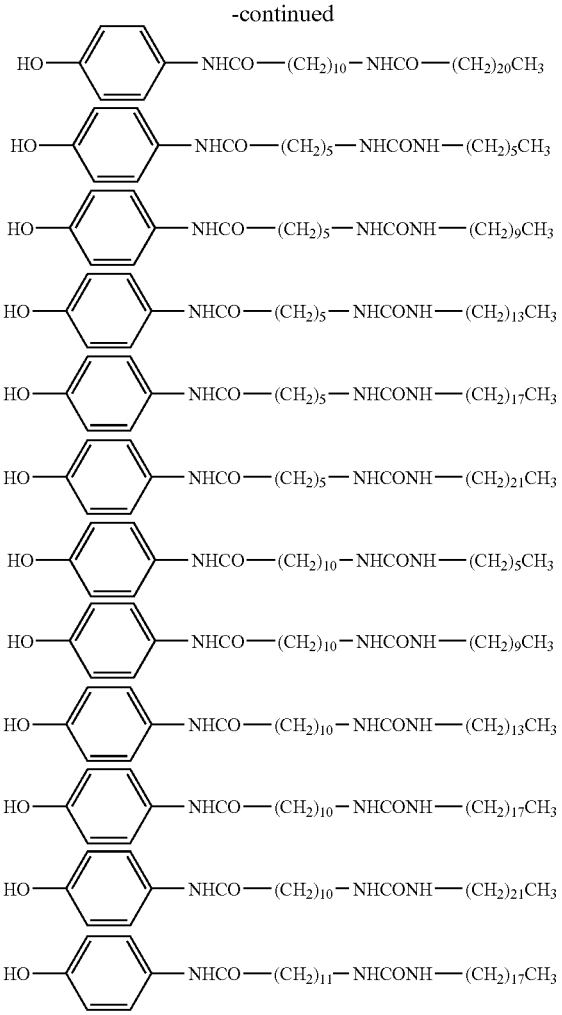

Electron Donative Coloring Compound

The electron donative coloring compound (color coupler) is not specifically limited and can be appropriately selected according to the purposes and is preferably a leuco dye.

The leuco dye is preferably a fluorine compound or an azaphthalide compound, and examples thereof include 2-anilino-3-methyl-6-diethylaminofluorane, 2-anilino-3-methyl-6-di(n-butylamino)fluorane, 2-anilino-3-methyl-6-(N-n-propyl-N-methylamino)fluorane, 2-anilino-3-methyl-6-(N-isopropyl-N-methylamino)fluorane, 2-anilino-3-methyl-6-(N-isobutyl-N-methylamino)fluorane, 2-anilino-3-methyl-6-(N-n-amyl-N-methylamino)fluorane, 2-anilino-3-methyl-6-(N-sec-butyl-N-methylamino)fluorane, 2-anilino-3-methyl-6-(N-n-amyl-N-ethylamino)fluorane, 2-anilino-3-methyl-6-(N-iso-amyl-N-ethylamino)fluorane, 2-anilino-3-methyl-6-(N-n-propyl-N-isopropylamino)fluorane, 2-anilino-3-methyl-6-(N-cyclohexyl-N-methylamino)fluorane, 2-anilino-3-methyl-6-(N-ethyl-p-toluidino)fluorane, 2-anilino-3-methyl-6-(N-methyl-p-toluidino)fluorane, 2-(m-trichloromethylanilino)-3-methyl-6-diethylaminofluorane, 2-(m-trifluoromethylanilino)-3-methyl-6-diethylaminofluorane, 2-(m-trichloromethylanilino)-3-methyl-6-(N-cyclohexyl-N-methylamino)fluorane, 2-(2,4-dimethylanilino)-3-methyl-6-diethylaminofluorane, 2-(N-ethyl-p-toluidino)-3-methyl-6-(N-ethylanilino)fluorane, 2-(N-ethyl-p-toluidino)-3-methyl-6-(N-propyl-p-toluidino)fluorane, 2-anilino-6-(N-n-hexyl-N-ethylamino)fluorane, 2-(o-chloroanilino)-6-diethylaminofluorane, 2-(o-chloroanilino)-6-dibutylaminofluorane, 2-(m-trifluoromethylanilino)-6-diethylaminofluorane, 2,3-dimethyl-6-dimethylaminofluorane, 3-methyl-6-(N-ethyl-p-toluidino)fluorane, 2-chloro-6-diethylaminofluorane, 2-bromo-6-diethylaminofluorane, 2-chloro-6-dipropylaminofluorane, 3-chloro-6-cyclohexylaminofluorane, 3-bromo-6-cyclohexylaminofluorane, 2-chloro-6-(N-ethyl-N-isoamylamino)fluorane, 2-chloro-3-methyl-6-diethylaminofluorane, 2-anilino-3-chloro-6-diethylaminofluorane, 2-(o-chloroanilino)-3-chloro-6-cyclohexylaminofluorane, 2-(m-trifluoromethylanilino)-3-chloro-6-diethylaminofluorane, 2-(2,3-dichloroanilino)-3-chloro-6-diethylaminofluorane, 1,2-benzo-6-diethylaminofluorane, 3-diethylamino-6-(m-trifluoromethylanilino)fluorane, 3-(1-ethyl-2-methylindol-3-yl)-3-(2-ethoxy-4-diethylaminophenyl)-4-azaphthalide, 3-(1-ethyl-2-methylindol-3-yl)-3-(2-ethoxy-4-diethylaminophenyl)-7-azaphthalide, 3-(1-octyl-2-methylindol-3-yl)-3-(2-ethoxy-4-diethylaminophenyl)-4-azaphthalide, 3-(1-ethyl-2-methylindol-3-yl)-3-(2-methyl-4-diethylaminophenyl)-4-azaphthalide, 3-(1-ethyl-2-methylindol-3-yl)-3-(2-methyl-4-diethylaminophenyl)-7-azaphthalide, 3-(1-ethyl-2-methylindol-3-yl)-3-(4-diethylaminophenyl)-4-azaphthalide, 3-(1-ethyl-2-methylindol-3-yl)-3-(4-N-n-amyl-N-methylaminophenyl)-4-azaphthalide, 3-(1-methyl-2-methylindol-3-yl)-3-(2-hexyloxy-4-diethylaminophenyl)-4-azaphthalide, 3,3-bis(2-ethoxy-4-diethylaminophenyl)-4-azaphthalide, and 3,3-bis(2-ethoxy-4-diethylaminophenyl)-7-azaphthalide.

As the electron donative coloring compound (color coupler), in addition to the fluorine compounds and the azaphthalide compound, conventionally known leuco dyes can be used, and examples thereof include 2-(p-acetylanilino)-6-(N-n-amyl-N-n-butylamino)fluorane, 2-benzylamino-6-(N-ethyl-p-toluidino)fluorane, 2-benzylamino-6-(N-methyl-2,4-dimethylanilino)fluorane, 2-benzylamino-6-(N-ethyl-2,4-dimethylanilino)fluorane, 2-benzylamino-6-(N-methyl-p-toluidino)fluorane, 2-benzylamino-6-(N-ethyl-p-toluidino)fluorane, 2-(di-p-methylbenzylamino)-6-(N-ethyl-p-toluidino)fluorane, 2-(α-phenylethylamino)-6-(N-ethyl-p-toluidino)fluorane, 2-methylamino-6-(N-methylanilino)fluorane, 2-methylamino-6-(N-ethylanilino)fluorane, 2-methylamino-6-(N-propylanilino)fluorane, 2-ethylamino-6-(N-methyl-p-toluidino)fluorane, 2-methylamino-6-(N-methyl-2,4-dimethylanilino)fluorane, 2-ethylamino-6-(N-ethyl-2,4-dimethylanilino)fluorane, 2-dimethylamino-6-(N-methylanilino)fluorane, 2-dimethylamino-6-(N-ethylanilino)fluorane, 2-diethylamino-6-(N-methyl-p-toluidino)fluorane, 2-diethylamino-6-(N-ethyl-p-toluidino)fluorane, 2-dipropylamino-6-(N-methylanilino)fluorane, 2-dipropylamino-6-(N-ethylanilino)fluorane, 2-amino-6-(N-methylanilino)fluorane, 2-amino-6-(N-ethylanilino)fluorane, 2-amino-6-(N-propylanilino)fluorane, 2-amino-6-(N-methyl-p-toluidino)fluorane, 2-amino-6-(N-ethyl-p-toluidino)fluorane, 2-amino-6-(N-propyl-p-toluidino)fluorane, 2-amino-6-(N-methyl-p-ethylanilino)fluorane, 2-amino-6-(N-ethyl-p-ethylanilino)fluorane, 2-amino-6-(N-propyl-p-ethylanilino)fluorane, 2-amino-6-(N-methyl-2,4-dimethylanilino)fluorane, 2-amino-6-(N-ethyl-2,4-dimethylanilino)fluorane, 2-amino-6-(N-propyl-2,4-dimethylanilino)fluorane, 2-amino-6-(N-methyl-p-chloroanilino)fluorane, 2-amino-6-(N-ethyl-p-chloroanilino)fluorane, 2-amino-6-(N-propyl-p-chloroanilino)fluorane, 1,2-benzo-6-(N-ethyl-N-isoamylamino)fluorane, 1,2-benzo-6-dibutylaminofluorane, 1,2-benzo-6-(N-methyl-N-cyclohexylamino)fluorane, and 1,2-benzo-6-(N-ethyl-N-toluidino)fluorine.

These compounds may be used alone or in combination. Also, a multi-color or full-color material can be produced by laminating a layer capable of developing colors having different color tones.

The ratio of the electron donative coloring compound (color coupler) to the electron acceptive compound (developer) is not unconditionally defined because a suitable range varies depending on a combination of compounds to be used, and a molar ratio of a developer to a color coupler is preferably 0.1/1 to 20/1, and more preferably 0.2/1 to 10/1. When the amount of the developer is more or less than the above range, density of the color developed state decreases and a problem may arise. Also, the color coupler and the developer can be used in the state of being encapsulated in a microcapsule.

—Color Erasure Accelerator—

In the present invention, by using the developer in combination with a compound having at least one of an amide group, an urethane group and an urea group in the molecule as a color erasure accelerator, an intermolecular interaction is induced between the color erasure accelerator and the developer in the process of forming the erased state, and thus making it possible to markedly increase the erasing rate.

The color erasure accelerator may be a compound having at least one selected from an amide group, a urethane group and a urea group in the molecule, and particularly preferable compounds are represented by the following structural formulas (5) to (11):

$R^5$—NHCO—$R^6$ Structural Formula (5)

$R^5$—NHCO—$R^7$—CONH—$R^6$ Structural Formula (6)

$R^5$—CONH—$R^7$—NHCO—$R^6$ Structural Formula (7)

$R^5$—NHCOO—$R^6$ Structural Formula (8)

$R^5$—NHCOO—$R^7$—OCONH—$R^6$ Structural Formula (9)

$R^5$—OCONH—$R^7$—NHCOO—$R^6$ Structural Formula (10)

Structural Formula (11)

$$R^5—NHCOO—\underset{\underset{OCONH—R^8}{|}}{R^9}—OCONH—R^6$$

in the structural formulas (5) to (11), $R^5$, $R^6$ and $R^8$ represent a linear alkyl group having 7 to 22 carbon atoms, a branched alkyl group or an unsaturated alkyl group, $R^7$ represents a divalent organic group having 1 to 10 carbon atoms, and $R^9$ represents a trivalent functional group having 4 to 10 carbon atoms.

Examples of $R^5$, $R^6$ and $R^8$ include heptyl group, octyl group, nonyl group, decyl group, undecyl group, dodecyl group, stearyl group, behenyl group, and oleyl group.

Examples of $R^6$ include methylene group, ethylene group, propylene group, butylene group, heptamethylene group, hexamethylene group, octamethylene group, —$C_3H_6OC_3H_6$— group, —$C_2H_4OC_2H_4$— group, and —$C_2H_4OC_2H_4OC_2H_4$— group.

Examples of $R^9$ include those represented by the following structural formulas.

$$C_2H_5—\overset{\overset{CH_2—}{|}}{C}\underset{\underset{CH_2—}{|}}{CH_2}—,\ \overset{\overset{CH_2—}{|}}{CH}\underset{\underset{CH_2—}{|}}{CH}—,\ \overset{\overset{CH_2CH_2—}{|}}{CH}\underset{\underset{CH_2CH_2—}{|}}{CH}—,\ \overset{\overset{CH_2—}{|}}{CH}\underset{\underset{C_4H_8—}{|}}{CH}—,$$

$$\overset{\overset{CH_2CH_2—}{|}}{C}H\underset{\underset{CH_2CH_2—}{|}}{CH_2}—,\ \overset{\overset{CH_2CH_2CH_2—}{|}}{C}H\underset{\underset{CH_2CH_2CH_2—}{|}}{CH_2}—,\ \overset{\overset{CH_2CH_2CH_2—}{|}}{C}H\underset{\underset{CH_2CH_2CH_2—}{|}}{CH_2}—$$

Specific examples of the compounds represented by the structural formulas (5) to (11) are preferably compounds represented by the following formulas (1) to (81):

$C_{11}H_{23}CONHC_{12}H_{25}$, (1)

$C_{15}H_{31}CONHC_{16}H_{33}$, (2)

$C_{17}H_{35}CONHC_{18}H_{37}$, (3)

$C_{17}H_{35}CONHC_{18}H_{35}$, (4)

$C_{21}H_{41}CONHC_{18}H_{37}$, (5)

$C_{15}H_{31}CONHC_{18}H_{37}$, (6)

$C_{17}H_{35}CONHCH_2NHCOC_{17}H_{35}$, (7)

$C_{11}H_{23}CONHCH_2NHCOC_{11}H_{23}$, (8)

$C_7H_{15}CONHC_2H_4NHCOC_{17}H_{35}$, (9)

$C_9H_{11}CONHC_2H_4NHCOC_9H_{11}$, (10)

$C_{11}H_{23}CONHC_2H_4NHCOC_{11}H_{23}$, (11)

$C_{17}H_{35}CONHC_2H_4NHCOC_{17}H_{35}$, (12)

$(CH_3)_2CHC_{14}H_{35}CONHC_2H_4NHCOC_{14}H_{35}(CH_3)_2$, (13)

$C_{21}H_{43}CONHC_2H_4NHCOC_{21}H_{43}$, (14)

$C_{17}H_{35}CONHC_6H_{12}NHCOC_{17}H_{35}$, (15)

$C_{21}H_{43}CONHC_6H_{12}NHCOC_{21}H_{43}$, (16)

$C_{17}H_{33}CONHCH_2NHCOC_{17}H_{33}$, (17)

$C_{17}H_{33}CONHC_2H_4NHCOC_{17}H_{33}$, (18)

$C_{21}H_{41}CONHC_2H_4NHCOC_{21}H_{41}$, (19)

$C_{17}H_{33}CONHC_6H_{12}NHCOC_{17}H_{33}$, (20)

$C_8H_{17}NHCOC_2H_4CONHC_{18}H_{37}$, (21)

$C_{10}H_{21}NHCOC_2H_4CONHC_{10}H_{21}$, (22)

$C_{12}H_{25}NHCOC_2H_4CONHC_{12}H_{25}$, (23)

$C_{18}H_{37}NHCOC_2H_4CONHC_{18}H_{37}$, (24)

$C_{21}H_{43}NHCOC_2H_4CONHC_{21}H_{43}$, (25)

$C_{18}H_{37}NHCOC_6H_{12}CONHC_{18}H_{37}$, (26)

$C_{18}H_{35}NHCOC_4H_8CONHC_{18}H_{35}$, (27)

$C_{18}H_{35}NHCOC_8H_{16}CONHC_{18}H_{35}$, (28)

$C_{12}H_{25}OCONHC_{18}H_{37}$, (29)

$C_{13}H_{27}OCONHC_{18}H_{37}$, (30)

$C_{16}H_{33}OCONHC_{18}H_{37}$, (31)

$C_{18}H_{37}OCONHC_{18}H_{37}$, (32)

$C_{21}H_{43}OCONHC_{18}H_{37}$, (33)

$C_{12}H_{25}OCONHC_{16}H_{33}$, (34)

$C_{13}H_{27}OCONHC_{16}H_{33}$, (35)

$C_{16}H_{33}OCONHC_{16}H_{33}$, (36)

$C_{18}H_{37}OCONHC_{16}H_{33}$, (37)

$C_{21}H_{43}OCONHC_{16}H_{33}$, (38)

$C_{12}H_{25}OCONHC_{14}H_{29}$, (39)

$C_{13}H_{27}OCONHC_{14}H_{29}$, (40)

$C_{16}H_{33}OCONHC_{14}H_{29}$, (41)

$C_{18}H_{37}OCONHC_{14}H_{29}$, (42)

$C_{22}H_{45}OCONHC_{14}H_{29}$, (43)

$C_{12}H_{25}OCONHC_{12}H_{37}$, (44)

$C_{13}H_{27}OCONHC_{12}H_{37}$, (45)

$C_{16}H_{33}OCONHC_{12}H_{37}$, (46)

$C_{18}H_{37}OCONHC_{12}H_{37}$, (47)

$C_{21}H_{43}OCONHC_{12}H_{37}$, (48)

$C_{22}H_{45}OCONHC_{18}H_{37}$, (49)

$C_{18}H_{37}NHCOOC_2H_4OCONHC_{18}H_{37}$, (50)

$C_{18}H_{37}NHCOOC_3H_6OCONHC_{18}H_{37}$, (51)

$C_{18}H_{37}NHCOOC_4H_8OCONHC_{18}H_{37}$, (52)

$C_{18}H_{37}NHCOOC_6H_{12}OCONHC_{18}H_{37}$, (53)

$C_{18}H_{37}NHCOOC_8H_{16}OCONHC_{18}H_{37}$, (54)

$C_{18}H_{37}NHCOOC_2H_4OC_2H_4OCONHC_{18}H_{37}$, (55)

$C_{18}H_{37}NHCOOC_3H_6OC_3H_6OCONHC_{18}H_{37}$, (56)

$C_{18}H_{37}NHCOOC_{12}H_{24}OCONHC_{18}H_{37}$, (57)

$C_{18}H_{37}NHCOOC_2H_4OC_2H_4OC_2H_4OCONHC_{18}H_{37}$, (58)

$C_{16}H_{33}NHCOOC_2H_4OCONHC_{16}H_{33}$, (59)

$C_{16}H_{33}NHCOOC_3H_6OCONHC_{16}H_{33}$, (60)

$C_{16}H_{33}NHCOOC_4H_8OCONHC_{16}H_{33}$, (61)

$C_{16}H_{33}NHCOOC_6H_{12}OCONHC_{16}H_{33}$, (62)

$C_{16}H_{33}NHCOOC_8H_{16}OCONHC_{16}H_{33}$, (63)

$C_{18}H_{37}OCOHNC_6H_{12}NHCOOC_{18}H_{37}$, (64)

$C_{16}H_{33}OCOHNC_6H_{12}NHCOOC_{16}H_{33}$, (65)

$C_{14}H_{29}OCOHNC_6H_{12}NHCOOC_{14}H_{29}$, (66)

$C_{12}H_{25}OCOHNC_6H_{12}NHCOOC_{12}H_{25}$, (67)

$C_{10}H_{21}OCOHNC_6H_{12}NHCOOC_{10}H_{21}$, (68)

$C_{8}H_{17}OCOHNC_6H_{12}NHCOOC_{8}H_{17}$, (69)

(70)

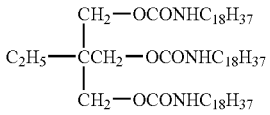

(71)

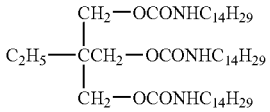

(72)

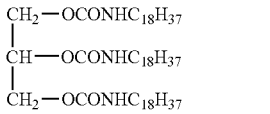

(73)

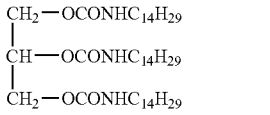

(74)

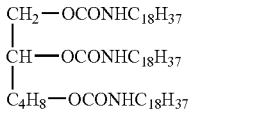

(75)

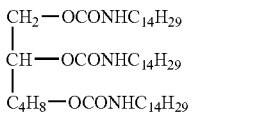

(76)

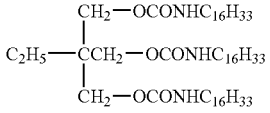

(77)

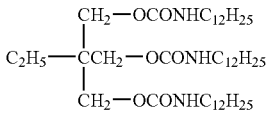

(78)

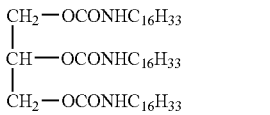

(79)

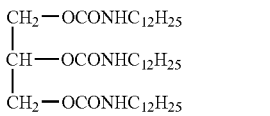

(80)

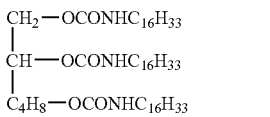

-continued (81)

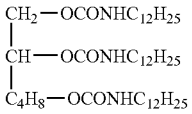

The amount of the color erasure accelerator to be added is preferably within a range from 0.1 parts by mass to 300 parts by mass, and more preferably from 3 parts by mass to 100 parts by mass, per 100 parts by mass of the developer. When the amount is less than 0.1 parts by mass, the effect of the addition of the color erasure accelerator may not be exerted. On the other hand, when the amount is more than 300 parts by mass, color development density may decrease.

The thermosensitive recording layer can contain, in addition to the above components, various additives which are use to improve coating characteristics of the thermosensitive recording layer and to improve color development and erasure characteristics, if necessary. Examples of the additives include crosslinking agents, crosslinking accelerators, fillers, lubricants, surfactants, conductant agents, bulking agents, antioxidants, photostabilizers, color development stabilizers, and plasticizers.

The binder resin is not specifically limited and can be appropriately selected according to the purposes, and examples thereof include polyvinyl chloride resins, polyvinyl acetate resins, vinyl chloride-vinyl acetate copolymer, ethyl cellulose, polystyrene resins, styrene copolymers, phenoxy resins, polyester resins, aromatic polyester resins, polyurethane resins, polycarbonate resins, polyacrylate ester resins, polymethacrylate ester resins, acrylic copolymers, maleic acid copolymers, polyvinyl alcohol resins, modified polyvinyl alcohol resins, hydroxyethyl cellulose, carboxymethyl cellulose and starches.

These binder resins play a role of maintaining the uniformly dispersed state without causing deviation of the respective materials of the composition uniformly due to heat application upon recording erasure. Therefore, as the binder resin, a resin having high heat resistance is preferably used. The binder resin to be used is preferably a curable resin, which can be cured by heat, ultraviolet ray or electron beam, obtained by adding a crosslinking agent (hereinafter also referred to as a "resin in a crosslinked state". When the thermosensitive recording layer contains the curable resin, the heat resistance and coating film strength of the thermosensitive recording layer are improved and repeated use durability of the reversible thermosensitive recording medium is improved.

The curable resin is not specifically limited and can be appropriately selected according to the purposes, and examples thereof include resins having a group capable of reacting with a crosslinking agent, such as acrylpolyol resins, polyesterpolyol resins, polyurethanepolyol resins, phenoxy resins, polyvinylbutyral resins, cellulose acetatepropionate, and cellulose acetate butyrate; and resins obtained by copolymerizing a monomer capable of reacting a crosslinking agent with the other monomer. Among these resins, acrylpolyol resins, polyesterpolyol resins, and polyurethanepolyol resins are particularly preferable.

Also, the hydroxyl value of the curable resin is preferably 70 KOHmg/g or more, and more preferably 90 KOHmg/g or more, so as to improve durability, surfaced hardness of coating film, and cracking resistance. The hydroxyl value exerts an influence on crosslink density and therefore control chemical resistance and physical properties of the coating film.

The acrylpolyol resin can be synthesized by a known solution polymerization method, suspension polymerization method or emulsion polymerization method using a (meth) acrylate ester monomer, an unsaturated monomer having a carboxylic acid group, an unsaturated monomer having a hydroxyl group, and the other ethylenically unsaturated monomer. Examples of the unsaturated monomer having a hydroxyl group include hydroxyethyl acrylate (HEA), hydroxypropyl acrylate (HPA), 2-hydroxyethyl methacrylate (HEMA), 2-hydroxypropyl methacrylate (HPMA), 2-hydroxybutyl monoacrylate (2-HBA), and 1,4-hydroxybutyl monoacrylate (1-HBA). Among these monomers, 2-hydroxyethyl methacrylate is used particularly preferably because the resulting coating film is excellent in cracking resistance and durability when a monomer having a primary hydroxyl group is used.

The crosslinking agent is not specifically limited and can be appropriately selected from conventionally known isocyanate compounds, amines, phenols, and epoxy compounds. Among these, isocyanate compounds are particularly preferable.

The isocyanate compound is not specifically limited and can be appropriately selected from known compounds according to the purposes, and examples thereof include modified materials such as modified urethane, modified allophanate, modified isocyanurate, modified burette, modified carbodiimide, and blocked isocyanate of an isocyanate monomer. Examples of the isocyanate monomer, which forms the modified material, include tolylene diisocyanate (TDI), 4,4'-diphenylmethane diisocyanate (MDI), xylylene diisocyanate (XDI), naphthylene diisocyanate (NDI), paraphenylene diisocyanate (PPDI), tetramethylxylylene diisocyanate (TMXDI), hexamethylene diisocyanate (HDI), dicyclohexylmethane diisocyanate (HMDI), isophorone diisocyanate (IPDI), lysine diisocyanate (LDI), isopropylidene bis(4-cyclohexylisocyanate) (IPC), cyclohexyl diisocyanate (CHDI), and tolidine diisocyanate (TODI).

As the crosslinking accelerator, catalysts used in this kind of the reaction may be used. Examples of the crosslinking accelerator include tertiary amines such as 1,4-diazabicyclo [2,2,2]octane, and metal compound such as organotin compound. The total amount of the crosslinking agent added may cause the crosslinking reaction or not. That is, the unreacted crosslinking agent may be present. Since this kind of the crosslinking reaction proceeds with time, the presence of the unreacted crosslinking agent does not suggest that the crosslinking reaction does not proceed at all. Even if the unreacted crosslinking agent is detected, it does not mean that the resin in a crosslinked state is not present. It can be confirmed by immersing the coating film in a solvent having high solubility whether or not the polymer is in the crosslinked state or the non-crosslinked state. In case of the polymer in the non-crosslinked state, the polymer in the solvent begins to dissolve and not remained in the solute, and therefore the presence or absence of a polymer structure of the solute may be confirmed. If the presence of the polymer structure is not confirmed in the solute, it is believed that the polymer is in the non-crosslinked state, and thus making it possible to distinguish from the polymer in the crosslinked state. Herein, it is possible to express by a gel fraction.

The gel fraction means a production ratio of a gel when the resin solute losses independent mobility by the interaction in the solvent to produce an aggregated and solidified state (gel). The gel fraction of the resin is preferably 30% or more, more preferably 50% or more, still more preferably 70% or more, and particularly preferably 80% or more. Since repeated use durability deteriorates when the gel fraction is small, the resin is mixed with a curable resin, which is curable with heat, ultraviolet irradiation (UV) or electron beam irradiation (EB), or crosslinking the resin itself so as to improve the gel fraction.

The gel fraction is measured in the following manner. That is, a film is separated from a support and an initial mass of the film is measured. Then, the film is interposed between 400 mesh wire gauzes, immersed in a solvent capable of dissolving g a resin before crosslinking for 24 hours and vacuum dried, and thus a mass after drying can be measured.

$$\text{Gel Fraction}(\%)=[\text{Mass after Drying (g)}/\text{Initial Mass (g)}]\times 100 \quad (1)$$

When the gel fraction is calculated using this equation, the calculation is conducted excluding the mass of organic low molecular substance particles other than the resin component in the thermosensitive recording layer. In this case, when the mass of the organic low molecular substance is not preliminary known, a mass ratio may be determined by an area ratio per unit area and each specific gravity of the resin and the organic low molecular substance through cross-section observation using a transmission electron microscope (TEM), scanning electron microscope (SEM) or the like, followed by calculation of a mass of the organic low molecular substance and further calculation of the gel fraction.

In case a thermosensitive recording layer is formed on a support and an the other layer such as protective layer is laminated thereon in the measurement, or the other layer is formed between the support and the thermosensitive recording layer, first, the thickness of the thermosensitive recording layer and that of the other layer are measured through cross-section observation using a transmission electron microscope (TEM), a scanning electron microscope (SEM) or the like, and the surface corresponding to the thickness of the other layer is shaving thereby exposing the surface of a thermosensitive recording layer, and then the thermosensitive recording layer is separated and the gel fraction is measured in the same manner as described above.

In the method for measuring the gel fraction, when a protective layer made of an ultraviolet curable resin is formed on the thermosensitive recording layer, an influence on the gel fraction must be prevented by shaving the thickness corresponding to the protective layer and slightly shaving the surface of the thermosensitive recording layer so as to prevent contamination of the protective layer as much as possible.

In the recording layer, inorganic fillers and/or organic fillers described in the protective layer may be used alone or in combination. In case of using them in combination, a combination of inorganic fillers and organic fillers is not specifically limited. Examples of the shape include spherical, granular, tabular, and needle-like shapes.

The content of the filler is preferably from 5 to 50% by volume in terms of a volume fraction.

The lubricant is not specifically limited and can be appropriately selected from known lubricants according to the purposes, and specific examples thereof include synthetic waxes such as ester wax, paraffin wax, and polyethylene wax; vegetable waxes such as hardened castor oil; animal waxes such as hardened beef tallow; higher alcohols such as stearyl alcohol and behenyl alcohol; higher fatty acids such as margaric acid, lauric acid, myristic acid, palmitic acid, stearic acid, and behenic acid; higher fatty acid esters such as sorbitan fatty acid esters; amides such as stearic acid amide, oleic acid amide, lauric acid amide, ethylenebisstearamide, methylenebisstearamide, methylolstearamide, and methylolstearamide.

The content of the lubricant in the thermosensitive recording layer is preferably from 0.1% by volume to 95% by volume, and more preferably from 1% by volume to 75% by volume.

The surfactant is not specifically limited and can be appropriately selected from known surfactants according to the purposes, and specific examples thereof include anionic surfactants, cationic surfactants, nonionic surfactant, and amphoteric surfactants.

The plasticizer is not specifically limited and can be appropriately selected according to the purposes, and examples thereof include phosphate esters, fatty acid esters, phthalate esters, dibasic acid esters, glycols, polyester plasticizers, and epoxy plasticizers.

The method for forming a thermosensitive recording layer is not specifically limited and can be appropriately selected, and examples thereof include (1) a method comprising coating a coating solution for a thermosensitive recording layer, which is prepared by dissolving or dispersing the binder resin, the electron donative coloring compound and the electron acceptive compound in a solvent, on a support, and vaporizing the solvent thereby to form into a sheet and to crosslink the sheet simultaneously or after forming into the sheet, (2) a method comprising coating a coating solution for a thermosensitive recording, which is prepared by dispersing the electron donative coloring compound and the electron acceptive compound in a solvent containing only the binder resin dissolved therein, on a support, and vaporizing the solvent thereby to form into a sheet and to crosslink the sheet simultaneously or after forming into the sheet, and (3) a method comprising melting the binder resin, the electron donative coloring compound and the electron acceptive compound with heating, mixing them, forming the molten mixture into a sheet, followed by cooling and further crosslinking. In these methods, it is also possible to form into a sheet-shaped reversible thermosensitive recording medium without using a support.

The solvent used in the method (1) or (2) varies depending on the kind of the binder resin, the electron donative coloring compound and the electron acceptive compound and can not be unconditionally defined, and examples thereof include tetrahydrofuran, methyl ethyl ketone, methyl isobutyl ketone, chloroform, carbon tetrachloride, ethanol, toluene, and benzene.

The electron acceptive compound is dispersed in the form of particles in the thermosensitive recording layer.

For the purpose of exhibiting high performances suited as a coating material, various pigments, defoamers, dispersing agents, slipping agents, antiseptics, crosslinking agents, and plasticizers may be added to the coating solution for a thermosensitive recording layer.

The method for coating a coating solution for a thermosensitive recording layer is not specifically limited and can be appropriately selected according to the purposes. For example, a roll-shaped continuous support or a support cut into a sheet is transferred and the coating solution is coated on the support using a known method such as blade coating, wire bar coating, spray coating, air knife coating, bead coating, curtain coating, gravure coating, kiss coating, reverse roll coating, dip coating, or die coating method.

The drying conditions of the coating solution for a thermosensitive recording layer are not specifically limited and can be appropriately selected according to the purposes and, for example, the coating solution is dried at a temperature within a range from room temperature to 140° C. for about 10 minutes to 1 hour.

The resin in the thermosensitive recording layer can be cured by heating, ultraviolet irradiation, or electron beam irradiation.

The ultraviolet irradiation is not specifically limited and can be conducted using a known ultraviolet irradiation device, and examples of the device include those equipped with light source, lighting fixture, power supply, cooling device, or transfer device.

Examples of the light source include mercury lamp, metal halide lamp, gallium lamp, mercury-xenon lamp, and flash lamp. The wavelength of the light source can be appropriately selected according to an ultraviolet absorption wavelength of photopolymerization initiators and photopolymerization accelerators added to a composition for a reversible thermosensitive recording medium.

The conditions of the ultraviolet irradiation are not specifically limited and can be appropriately selected according to the purposes and, for example, the lamp output and transfer speed may be decided according to irradiation energy required to crosslink the resin.

The electron beam irradiation can be conducted using a known electron beam irradiation device. The electron beam irradiation device can be roughly classified into scanning (scanbeam) and non-scanning (areabeam) type devices and the conditions can be selected according to the irradiation area and irradiation dose. Also, the electron beam irradiation conditions can be decided from the following equation 2 according to the radiation dose required to crosslink the resin taking account of the electron current, irradiation width and transfer speed:

$$D=(\Delta E/\Delta R)\cdot\eta\cdot I/(W\cdot V) \quad (2)$$

in the equation (2), D represents a required radiation dose (Mrad), CE/CR represents an average energy loss, η represents an efficiency, I represents an electron current (mA), W represents an irradiation width (cm), and V represents a transfer speed (cm/s).

From an industrial point of view, it is preferable that the equation (3) obtained by simplifying the equation (2).

$$D\cdot V=K\cdot I/W \quad (3)$$

Herein, device rating is represented by Mrad·m/min and about 20 mA to 500 mA is selected as electron current rating.

The thickness of the thermosensitive recording layer is not specifically limited and can be appropriately selected according to the purposes and, for example, the thickness is preferably from 1 μm to 20 μm, and more preferably from 3 μm to 15 μm.

Since the color development density decreases when the thickness of the thermosensitive recording layer is too small, contrast of images may become lower. On the other hand, when the thickness is too large, thermal distribution in the layer increases and the area, where color development is not attained because the temperature does not reach the color developing temperature, appears and thus it becomes impossible to obtain the objective color development density.

<Support>

The shape, structure and size of the support are not specifically limited and can be appropriately selected according to the purposes, and the shape includes, for example, a tabular shape, and the structure may be a single-layered structure or a multi-layered structure, and the size can be appropriately selected according to the size of the reversible thermosensitive recording medium.

Examples of the material of the support include inorganic material and organic material. Examples of the inorganic material include glass, quartz, silicone, silicon oxide, aluminum oxide, $SiO_2$, and metal. Examples of the organic material include paper, cellulose derivative such as cellulose triactate, synthetic paper polyethylene terephthalate, polycarbonate, polystyrene, and polymethyl methacrylate. These organic materials may be used alone or in combination.

Among these, polyethylene terephthalate and PET-G film each having Haze of a support alone (Haze defined in JIS K7105) of 10% or less are particularly preferable so as to obtain a sheet having high image clearness.

For the purpose of improving adhesion of the coating layer, the support is preferably modified by a corona discharge treatment, an oxidation treatment (chromic acid), an etching treatment, an easy adhesive treatment, or an antistatic treatment. The support is preferably whitened by adding a white pigment such as titanium oxide.

The thickness of the support is not specifically limited and can be appropriately selected according to the purposes, and is preferably from 10 μm to 2,000 μm, more preferably from 20 μm to 1,000 μm, still more preferably from 20 μm to 300 μm, and particularly preferably from 20 μm to 200 μm.

The support may have a magnetic thermosensitive recording layer on at least either the same surface as that of or the surface opposite to the thermosensitive recording layer. Also, the reversible thermosensitive recording medium of the present invention can be stuck to the other medium through a binder layer.

<Heat Insulating Layer>

The heat insulating layer is provided between the thermosensitive recording layer and the support for the purpose of attaining high sensitivity utilizing applied heat effectively, or improving adhesion between the support and the thermosensitive recording layer and preventing penetration of a thermosensitive recording layer material into the support, and also contain at least hollow particles penetrated therein, and contains a binder resin and, if necessary, other components.

Examples of the hollow particles include single hollow particles wherein one hollow portion is present in particles, and multihollow particles wherein a lot of hollow portions are present in particles. These hollow particles may be used alone or in combination.

As the binder resin, the same resin as in case of the thermosensitive recording layer can be used.

The heat insulating layer can contain at least either inorganic filler or various organic fillers, such as calcium carbonate, magnesium carbonate, titanium oxide, silicon oxide, aluminum hydroxide, kaolin, and talc.

The heat insulating layer can also contain lubricants, surfactants, and dispersing agents.

The thickness of the heat insulating layer is not specifically limited can be appropriately selected according to the purposes, and is preferably from 0.1 μm to 100 μm, more preferably from 1 μm to 80 μm, still more preferably from 5 μm to 50 μm, and particularly preferably from 5 μm to 40 μm.

In the present invention, the erasing energy region by a thermal head system can be extended by forming a heat insulating layer containing hollow particles and using, as the hollow particles, hollow particles having porosity of 70% or more and a maximum particle size (D100) of 5.0 μm to 10.0 μm, a ratio of the maximum particle size to a particle size (D50) at 50% frequency, (D100/D50), being from 2.0 to 3.0.

As used herein, the particle size at 50% frequency means the particle size wherein a cumulative percentage reaches 50% when particle size distribution is expressed in cumulative percentage.

In the present invention, the maximum particle size of hollow particles is preferably from 5 μm to 10 μm. When the maximum particle size is more than 10 μm, if a thermosensitive recording layer is provided on a heat insulating layer using the same, the portion large particles of the heat insulating layer includes the portion where the thermosensitive recording layer is not formed, and thus voids are likely to be generated when solid images are printed. On the other hand, when the maximum particle size is less than 5 μm, it becomes difficult to secure porosity of 70% or more and, as a result, sensitivity decreases. Therefore, the maximum particle size of hollow particles is preferably from 5 μm to 10 μm. Considering only increase of the color development density, the effect can be exerted when the porosity is 60% or more. However, the reversible thermosensitive recording medium includes an erasing process and the erasing system using a thermal head is characterized in that energy applied for erasure drastically decreases as compared with the system using a heated roller, and thus the degree of effective utilization of energy applied must be increased. Therefore, the porosity of hollow particles used in the heat insulating layer must be 70% or more so as to secure the increase of the erasing optical density and erasing energy region in the erasing system using the thermal head.

In the present invention, the ratio of the maximum particle size (D100) to a particle size (D50) at 50% frequency, (D100/D50), of hollow particles is preferably from 2.0 to 3.0. The ratio of more than 3.0 shows that particle size distribution is in a broad state and the proportion of microparticles having a particle size of 1 μm or less increases, and the heat insulating layer using the same shows uniform distribution of hollow particles therein, and thus causing a phenomenon of deteriorating sensitivity arises. On the other hand, when the ratio is less than 2.0, the resulting particles has very sharp particle size distribution and it is difficult to realize in view of synthesis conditions. Therefore, the ratio of the maximum particle size (D100) to a particle size (D50) at 50% frequency, (D100/D50), of hollow particles is preferably from 2.0 to 3.0.

In the present invention, the proportion of hollow particles having a particle size of 2 μm or less is preferably from 5% to 10%. When the proportion is more than 10%, the proportion of microparticles having a particle size of 1 μm or less increases and the heat insulating layer utilizing the same shows uniform distribution of hollow particles therein, and thus causing a phenomenon of deteriorating sensitivity arises. On the other hand, when the proportion is less than 5%, the resulting particles has very sharp particle size distribution and it is difficult to realize in view of synthesis conditions. Therefore, the proportion of hollow particles having a particle size of 2 μm is preferably from 5% to 10%.

The hollow particles are characterized by having porosity of 70% or more and a maximum particle size (D100) of 5.0 μm to 10.0 μm and satisfying that the ratio of the maximum particle size (D100) to a particle size (D50) at 50% frequency, (D100/D50), of hollow particles is from 2.0 to 3.0, and it has never been known that hollow particles satisfying these conditions are utilized in a reversible thermosensitive recording material. In the hollow particles, which have hitherto been used in the reversible thermosensitive recording material, a method of encapsulizing a volatile substance in a thermoplastic polymer, followed by expansion with volatilization so as to attain porosity of 60% or more. In order to decrease the particle size, particles having a particle size of 1 μm or less are present by discharging water from particles including water therein obtained by utilizing seed polymerization, but the porosity was only 50% or less. In the present invention, it is possible to obtain hollow particles, which satisfy porosity of 70% or more, a maximum particle size (D100) of 5.0 μm to 10.0 μm and a ratio of the maximum particle size (D100) to a particle size (D50) at 50% frequency, (D100/D50), of 2.0 to 3.0 by studying a shell material, a polymerization method and a volatile encapsulating agent, and performances are successively confirmed through repeated trials for applying to the reversible thermosensitive recording material for the first time, and thus good reversible thermosensitive recording material has been realized.

The glass transition temperature (Tg) of the hollow particles is preferably from 95° C. to 150° C., and more preferably from 95° C. to 120° C. When Tg is lower than 95° C., the heat insulating layer using the same is fused with the thermosensitive color developing layer upon printing using the thermal head, and thus there is recognized a phenomenon that it becomes difficult to conduct good printing because sticking occurs. On the other hand, when Tg is higher than 150° C., there is recognized a phenomenon that adhesion with the head deteriorates and sensitivity decreases because the heat insulating layer is in a rigid state upon printing using the thermal head and is insufficient in flexibility. Therefore, Tg of the hollow particles is preferably from 95° C. to 150° C.

As described above, hollow particles in the heat insulating layer of the reversible thermosensitive recording medium preferably has porosity of 70% or more and a maximum particle size (D100) of 10.0 μm or less, and more preferably 5.0 μm to 10.0 μm. The ratio of the maximum particle size (D100) to a particle size (D50) at 50% frequency, (D100/D50), is preferably 3.0 or less, and more preferably from 2.0 to 3.0. The proportion of hollow particles having a particle size of 2 μm or less is preferably 10% or less, and more preferably from 5% to 10%. The glass transition temperature (Tg) is preferably 95° C. or higher. By using hollow particles having the glass transition temperature of 95° C. to 150° C., since thermal insulating properties and adhesion with the head are improved and heat of the thermal head is efficiently conducted to the surface of the reversible thermosensitive recording medium, higher sensitivity is attained and the surface of the reversible thermosensitive recording medium is uniformly maintained, and thus formation of printing voids is prevented and uniformity of printed images is improved.

The value of the particle size was entirely measured using a laser diffraction type particle size distribution analyzer (manufactured by HORIBA, Ltd., LA-900). The median size is a particle size at 50% frequency and is referred to as D50, and the maximum particle size is a maximum particle size of distribution and is referred to as D100. Percentage of hollowness of the plastic spherical hollow fine particles is a ratio of an outer diameter to an inner diameter of hollow particles and is represented by the following equation:

$$\text{Percentage of Hollowness}(\%)=(\text{Inner Diameter of Hollow Particles}/\text{Outer Diameter of Hollow Particles})\times 100$$

Tg is glass transition temperature and represents Tg of a resin component of hollow particles. A solid was formed using the same resin as the resin component of hollow particles and the glass transition temperature (Tg) of the resulting solid was measured by a common method (DSC, DTA, TMA, etc.).

In the present invention, hollow particles function as a heat insulating material and have resilience and therefore improve color development sensitivity by efficiently making use of thermal energy from the thermal head. In view of sensitivity, porosity is preferably 70% or more, more preferably from 75% to 98%, and still more preferably from 85% to 95%. When the porosity is less than 70%, the above effect is reduced. On the other hand, when the porosity is more than 98%, the strength may decrease because of the thickness of the film decreases.

Various methods have been proposed as the method for producing hollow particles and, as the method for producing hollow particles of the present invention, a method comprising encapsulating a volatile substance as a core substance of a polymer, an outer layer being made of a thermoplastic polymer, followed by expansion with volatilization. Specific examples of the method include methods disclosed in WO99/46320 and JP-A No. 2000-24488. In this method, it is indispensable that the shell material has low permeability so as to adjust porosity to 70% or more upon thermal expansion. A conventional polymer containing vinylidene chloride has low permeability, but had an environmental problem. Therefore, the present inventors have found that it is possible to lower permeability and adjust the porosity to 70% or more by using, as the shell material of hollow particles having low permeability, a crosslinked vinyl polymer, rather than vinylidene chloride.

Examples of the vinyl polymer include monomers having carboxylic acid in the molecule, such as acrylate ester, ethylene, propylene, vinyl acetate, styrene, acrylonitrile, methacrylonitrile, acrylic acid, methacrylic acid, succinic acid, and itaconic acid; carboxylic acid metal salts such as magnesium acrylate, calcium acrylate, zinc acrylate, magnesium methacrylate, calcium methacrylate, and zinc methacrylate; N-methylolacrylamide having a group capable of reacting with carboxylic acid in the molecule, N-methylolmethacrylamide, glycidyl acrylate, glycidyl methacrylate, 2-hydroxyethyl(meth)acrylate, 2-hydroxypropyl (meth)acrylate, 2-hydroxybutyl(meth)acrylate, 2-hydroxy-3-phenoxypropyl acrylate, N,N-dimethylaminoethyl(meth)acrylate, N,N-dimethylaminopropyl methacrylate, magnesium monoacrylate, and zinc monoacrylate; and acrylamide, methacrylamide, N,N-dimethylacrylamide, N,N-dimethylmethacrylamide, methylmethacrylate, t-butylmethacrylate, isobornyl (meth) acrylate, cyclohexyl methacrylate, benzyl methacrylate, N-vinyl pyrrolidone, styrene, N-phenylmaleimide, N-naphthylmaleimide, N-cyclohexylmaleimide, and methylmaleimide.

When the porosity of the hollow particles increases, the thickness of the shell must decrease. If the shell becomes thin, the strength to pressure decreases and the shell is likely to be broken. When a trial of increasing the strength by hardening the shell, the shell tends to become brittle and is likely to be broken by bending. Therefore, balance between hardness and flexibility is required to the shell material and a preferable shell material having both hardness and flexibility includes, for example, acrylonitrile and methacrylonitrile. However, hollow particles having the above particle size and porosity can not realize only by using the specific shell material, polymerization method and volatile encapsulating agent, and can be realized by other means.

The hollow particles can also have a crosslinked structure. The material which forms a crosslinked structure, that is, a crosslinking agent can be obtained by copolymerizing a vinyl monomer with a bifunctional or polyfunctional monomer. A vinyl monomer or divinylbenzene having two or more vinyl groups per one molecule is preferable.

As the crosslinkable monomer, for example, there can be used common crosslinkable monomers such as ethylene glycol di(meth)acrylate, propylene glycol di(meth)acrylate, diethylene glycol di(meth)acrylate, 1,4-butanediol di(meth) acrylate, 1,6-hexanediol di(meth)acrylate, trimethylolpropane tri(meth)acrylate, glycerin di(meth)acrylate, triethylene glycol di(meth)acrylate, PEG#200 di(meth)acrylate, PEG#400 di(meth)acrylate, PEG#600 di(meth)acrylate, 1,3-butanediol di(meth)acrylate, neopentyl glycol di(meth)acrylate, 1,10-decanediol di(meth)acrylate, pentaerythritol tri (meth)acrylate, pentaerythritol tetra(meth)acrylate, pentaerythritol hexa(meth)acrylate 3-acroyloxyglycerin monoacrylate, dimethyloltricyclodecane di(meth)acrylate, triallylformal tri(meth)acrylate, polyethylene glycol dimethacrylate, triethylene glycol diacrylate, neopentyl glycol dimethacrylate, polypropylene glycol dimethacrylate, 2,2'-bis(4-acryloxydiethoxyphenyl)propane, trimethylolpropane trimethacrylate, diallyl phthalate, and divinylbenzene. As the crosslinkable monomer, those containing no halogen atom such as chlorine atom are used. To adjust the maximum particle size of the hollow particles to 10 μm or less, the hollow particles formed must have sharp particle size distribution, and a copolymer having an acryl monomer represented by the formula (1) has characteristics which enable sharp particle size distribution of particles so as to adjust the maximum particle size to the above range, and exerts excellent effect in this respect. Hydrogen is present at the end of a crossed bond of norbornane as the left ring of the formula (1), and a methyl group may be present at the end. The crosslinking agent in the present invention is preferably used in such an amount that that its content in the monomer is about 0.1% to 10%.

In actual production of a microcapsule, a conventional method for producing an expandable microcapsule is commonly used. That is, a colloidal silica gel is used as an aqueous dispersing agent. A water soluble polymer compound is used as an auxiliary dispersing agent.

As the water soluble polymer, an amphoteric or cationic water soluble polymer such as diethanolamineadipic acid condensate, polyethyleneimine or polyvinyl pyrrolidone polymer is used.

Also, to use a large amount of the water soluble monomer in the present invention, an inorganic metal salt is used. As the water soluble metal salt, a compound, which is dissolved in water in a neutral or acidic range, such as sodium chloride, magnesium chloride, or sodium sulfate is used.

The amount to be used is adjusted within a range from a saturation amount to an aqueous mixture to (saturation amount −5%). The pH of the mixture is adjusted within a range from 3 to 5 to prepare an aqueous system.

An oil phase is uniformly mixed before use. A monomer mixture having a radical reactive unsaturated double bond, a solvent mixture having a boiling point suited for the synthesis, and a radical initiator mixture can be used as the oil phase. As the solvent, an organic solvent having a boiling point lower than the temperature suited for the synthesis is used and any solvent can be used as long as it does not dissolve in an outer wall polymer and has high expansion efficiency. To use at high temperature, a hydrocarbon type solvent having a boiling point within a range from 50° C. to 200° C. is suitable. For example, n-hexane, isohexane, n-heptane, n-octane, isooctane, n-decane, isodecane, and a petroleum fraction are appropriately used. When a solvent having comparatively low boiling point is used, the expansion initiation temperature tends to decrease.

As the radical initiator, two or more kinds of radical initiators are used in combination. To or more kinds of radical initiators, a difference in a ten-hour half-life temperature between them being 20° C. or higher in combination, are preferably used in combination so as to eliminate the remained acrylonitrile monomer. The usable catalyst may be either a peroxide or azobis type catalyst, and ten-hour half-life temperature is preferably from 0° C. to 130° C., and more preferably from 20° C. to 100° C.

Specifically, diisopropyl peroxycarbonate, dioctyl peroxydicarbonate, t-butyl peroxylaurate, lauroyl peroxide, dioctanoyl peroxide, benzoyl peroxide, azobisisobutyronitrile, azobis(2,4-dimethylvaleronitrile), 1,1-azobis(cyclohexane-1-carbonitrile), and dimethyl-2,2'-azobis(2-methylpropionate) are used, and azobisisobutyronitrile and 1,1-azobis (cyclohexane-1-carbonitrile), or azobis(2,4-dimethylvaleronitrile) and 1,1-azobis(cyclohexane-1-carbonitrile) are more preferably used in combination.

In the present invention, hollow particles are used so as to improve sensitivity as one of characteristics of the particles, and a hydrophobic emulsion resin, an ultraviolet curable resin and a water soluble resin are used as the binder and the content of the binder is preferably from 100 parts by mass to 300 parts by mass, and more preferably from 100 parts by mass to 200 parts by mass, per on 100 parts by mass of the hollow particles. It was found that sensitivity can be remarkably improved thereby. This reason is considered that surface smoothness of an intermediate layer was further improved by filling voids of hollow particles with which a heat insulating layer is packed. When the amount of the binder is less than 100 parts by mass, voids of the hollow particles are remained, and therefore color development density may deteriorate. On the other hand, when the amount is more than 300 parts by mass, the proportion of hollow particles in the heat insulating layer decreases and therefore thermal insulating properties of the heat insulating layer deteriorate and sensitivity may decrease.

Examples of the hydrophobic resins used in the heat insulating layer include styrene/butadiene copolymers, latex of styrene/butadiene/acrylester copolymer, and emulsions of vinyl acetate, vinyl acetate/acrylic acid copolymers, styrene/acryl ester copolymers, acryl ester resins and polyurethane resins.

Examples of the ultraviolet curable resins used in the heat insulating layer include urethaneacrylate water soluble ultraviolet curable resins, epoxy acrylate water soluble ultraviolet curable resins, alkoxyacrylate ultraviolet curable resins, polyurethaneacrylate ultraviolet curable emulsions, acrylic monomers, urethaneacrylic oligomer, ether urethane acrylate oligomer, ester urethane acrylate oligomers, and polyester acrylate oligomers.

Examples of the water soluble resins used in the heat insulating layer include various modified polyvinyl alcohols such as completely saponified polyvinyl alcohol, carboxyl-modified polyvinyl alcohol, partially saponified polyvinyl alcohol, sulfonic acid-modified polyvinyl alcohol, silyl-modified polyvinyl alcohol, acetoacetyl-modified polyvinyl alcohol, and diacetone-modified polyvinyl alcohol.

In the present invention, known water soluble polymers can be used in combination as long as quality such as sensitivity is not adversely affected. Examples of binders such as known water soluble polymers and aqueous polymer emulsions include starch and derivatives thereof; cellulose derivatives such as methoxycellulose, hydroxyethyl cellulose, carboxymethyl cellulose, methyl cellulose, and ethyl cellulose; sodium polyacrylate, polyvinyl pyrrolidone, acrylamide/acrylate ester copolymer, alkali salts of styrene/maleic anhydride, alkali salts of isobutylene/maleic anhydride copolymer, polyacrylamide, sodium alginate, gelatin, and casein. Examples of the water soluble emulsions include emulsions of styrene/butadiene copolymers, latex of styrene/butadiene/acryl ester copolymers, vinyl acetate, vinyl acetate/acrylic acid copolymers, styrene/acrylester copolymers, acrylester resin, and polyurethane resins.

In the present invention, alkali thickeners can also be used in the heat insulating layer so as to improve head matching. The alkali thickener means a binder which thickens under alkali conditions. Typical examples of the alkali thickening binder include an emulsion latex containing a styrene-butadiene copolymer as a main component. In the present invention, an alkali thickening binder can also be used alone and, for example, a carboxylated latex as a copolymer of an unsaturated carboxylic acid is preferably used so as to make a binder component to be stably present as dispersed particles. As the pH becomes higher, the carboxylated latex is thickened because a highly carboxylated polymer on the surface of particles dissolves, and therefore thickening properties of the binder can be further improved. With the constitution described above, since dispersion stability of plastic hollow microparticles enhanced in the heat insulating layer of the present invention, it is not necessary to add thickeners such as sodium montmorillonite or modified polyacrylic acid, which are commonly added in the prior art. Since the alkali thickening binder strongly bind hollow particles with each other, in addition to the thickening action, matching with the thermal head is remarkably improved when the thickener is used.

The amount of the alkali thickening binder is preferably from 1 parts by mass to 80 parts by mass, and more preferably from 5 parts by mass to 50 parts by mass per 100 parts by mass of the hollow particles. The binder is preferably a styrene-butadiene copolymer but is not limited thereto, and may be any one as long as it is thickened under alkali conditions. Also, pH adjustors are required so as to maintain a heat insulating layer solution under alkali conditions and, for example, $NH_3$ water is used as the pH adjustor and is not limited thereto as long as it does not adversely affect the color development. To the heat insulating layer, in addition to the plastic hollow microparticles and alkali thickening binder, auxiliary additive components used commonly in this kind of a reversible thermosensitive recording medium, for example, heat fusible substances and surfactants can be added, if necessary. In this case, specific examples of the heat fusible substance include those described hereinafter in relation with the thermosensitive recording layer component.

To the heat insulating layer, auxiliary additive components used commonly in this kind of a reversible thermosensitive recording medium, for example, fillers, thermally fusible components, and surfactants can be used in combination with the hollow particles and binder, if necessary. To coat these heat insulating layer components uniformly and quickly, viscosity at a liquid temperature of 20° C. of an aqueous 20% dispersion of hollow particles is preferably 200 mPa·s or less. When the viscosity is more than 200 mPa·s, the viscosity of the coating solution prepared as described above increases and coating unevenness occurs. To make the surface of heat insulating layer formed on the support smoother, the surface may be smoothed by subjecting to a calendering treatment after forming the heat insulating layer.

<Intermediate Layer>

For the purpose of improving adhesion between the thermosensitive recording layer and the protective layer, preventing deterioration of the thermosensitive recording layer caused by coating the protective layer, and preventing migration of an additive in the protective layer to the thermosensitive recording layer, an intermediate layer is preferably provided between the thermosensitive recording layer and the protective layer, thereby making it possible to improve storage stability of color developed images.

In case the intermediate layer is a layer in contact with the surface of the support side of the protective layer, it preferably contains either an acrylate compound having a pentaerythritol group or an acrylate compound having a dipentaerythritol group and, specifically, it contains an acrylate compound (C) represented by the following structural formula (5), a binder resin and an ultraviolet absorber, and further contains other components, if necessary:

Structural Formula (5)

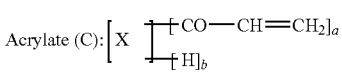

in the structural formula (5), X represents a pentaerythritol group or a dipentaerythritol group, a represents 1 to 5, and b represents 1 to 5.

As the binder resin, resins used in the thermosensitive recording layer can be used. By adding a curable resin among these resins, heat resistance of the reversible thermosensitive recording medium is further improved and good repeated use durability is obtained.

Examples of the ultraviolet absorbers include organic ultraviolet absorbers such as benzotriazole ultraviolet absorbers, benzophenone ultraviolet absorber, salicylate ester ultraviolet absorber, cyanoacrylate ultraviolet absorber and cinnamic acid ultraviolet absorbers. Among these ultraviolet absorbers, benzotriazole ultraviolet absorbers are preferable.

The content of the ultraviolet absorber is preferably within a range from 0.5 parts by mass to 80 parts by mass per 100 parts by mass of the resin component of the intermediate layer. The intermediate layer may contain ultraviolet absorptivity or shielding inorganic compounds, and additives such as conventionally known surfactants, leveling agents and antistatic agents.

In the intermediate layer, inorganic fillers and/or organic fillers described in the protective layer may be used alone or in combination. In case of using them in combination, a combination of inorganic fillers and organic fillers is not specifically limited. Examples of the shape include spherical, granular, tabular, and needle-like shapes. The content of the filler is preferably from 5% to 50% by volume.

As a solvent used in a coating solution of the intermediate layer, a dispersing device of a coating solution, a method of forming an intermediate layer by coating, and a drying method and a curing method of the intermediate layer, for example, known methods used in the thermosensitive recording layer and the protective layer can be used.

The thickness of the intermediate layer is not specifically limited and can be appropriately selected according to the purposes, and is preferably from 0.1 μm to 20 μm, and more preferably from 0.5 μm to 5 μm.

The reversible thermosensitive recording medium of the present invention is not specifically limited and can be processed into any shape according to the applications. For example, the reversible thermosensitive recording medium is formed into a sheet, label or roll.

A sheet-shaped one having a general document size such as A4 size obtained by processing can be used of trial printing by using a printing/erasing device. Also, sheet-shaped one having a sheer size larger than a card size can be widely used in temporary output applications such as general document, instruction book for process management, circulating document and conference materials, because printing range is widen.

A roll-shaped one thus obtained can be used in a display board, a notice board or an electronic blackboard by mounting into a device equipped with a printing/erasing section. Such a display unit is preferably used in a clean room because dust and garbage do not occur.

In the reversible thermosensitive recording medium of the present invention, a non-reversible thermosensitive recording layer may be used in combination. In this case, developed color tone of each thermosensitive recording layer may be the same or different. Also, a colored layer capable of forming irreversible information such as any pattern by printing (printable section) such as offset printing or gravure printing, or an inkjet printer, a thermal transfer printer or a sublimation type printer on a portion or the entire surface of the same surface as that of the thermosensitive recording layer of the reversible thermosensitive recording medium, or a portion of the opposite surface. Furthermore, an OP varnish layer made mainly of a curable resin may be provided on a portion or the entire surface of the colored layer. Examples of any pattern include character, figure, design, photograph, and information detected with infrared rays. Also, any of the respective constituent layers can be simply colored by adding dyes or pigments.

Furthermore, the reversible thermosensitive recording medium of the present invention can be provided with a hologram for security. It can also be provided with design such as human image, company mark or symbol mark by forming relief or intaglio irregularity so as to impart design properties.

Formation and erasure of images to the reversible thermosensitive recording medium can be conducted using a known image processing apparatus and are preferably conducted using an image processing apparatus of the present invention described hereinafter.

The image processing apparatus includes, for example, an image processing apparatus comprising an image forming configured to form images to a reversible thermosensitive recording medium, and an image erasing configured to erase the images, and is preferably an image processing apparatus comprising an image forming/erasing unit which simultaneously serve as the image forming unit and the image erasing unit in view of a short processing time. Specific examples thereof include an image processing apparatus capable of processing images by changing energy applied to a thermal head using the thermal head, and an image processing apparatus wherein the image forming unit is a thermal head and image erasing unit is selected from press contact type unit for bonding a heating element such as thermal head, ceramic heater (a heating element obtained by screen printing of a heat element on an alumina support), hot stamp, heat roller, or heat block, and non-contact type unit using warm air or infrared rays.

(Reversible Thermosensitive Recording Member)

The reversible thermosensitive recording member of the present invention comprises an information storage section and a reversible display section, and the reversible display section comprises the reversible thermosensitive recording medium of the present invention and comprises the other member, if necessary.

When a thermosensitive recording layer and an information storage section, each capable of reversibly displaying, are provided on the same card (integrated) and a portion of storage information of the information storage section is displayed on the thermosensitive recording layer, a card owner can confirm the information only by having a look of the card without using a special device, and it is convenient. When the contents of the information storage section are rewritten, the reversible thermosensitive recording medium can be repeatedly used by rewriting the display of the reversible thermosensitive recording section. The member comprising the information storage section and the reversible display section is roughly classified into the following two members:

(1) a member wherein a thermosensitive recording layer is directly formed using a portion of a member comprising an information recording section as a support of a reversible thermosensitive recording medium, and (2) a member wherein the surface of a support of a reversible thermosensitive recording medium having a thermosensitive recording layer on the support, which is separately formed, is bonded on a member comprising an information recording section.

In case of these members (1) and (2), it is necessary to be set so that the information storage section and the reversible display section can exert each function, thereby making it possible to provide the information storage section on the surface opposite to the surface on which the thermosensitive recording layer of the support in the reversible thermosensitive recording medium is provided, or to provide between the support and the thermosensitive recording layer, or provided on a portion of the thermosensitive recording layer.

The information storage section is not specifically limited and, for example, a magnetic thermosensitive recording layer, a magnetic stripe, an IC memory, an optical memory, an RF-ID tag, and hologram are preferably used. In a sheet medium having a size lager than a card size, an IC memory and an RF-ID tag are preferably used. The RF-ID tag is composed of an IC chip, and an antenna connected to the IC chip.

The magnetic thermosensitive recording layer is formed on a support by coating using a common iron oxide or barium ferrite, and vinyl chloride resin, urethane resin or nylon resin, or formed by vapor deposition or sputtering without using any of these resins. The magnetic thermosensitive recording layer may be provided on the surface opposite to the surface of the support on which a thermosensitive recording layer is provided, or provided between the support and the thermosensitive recording layer, or provided on a portion of the thermosensitive recording layer. Also, a reversible thermosensitive material used for display may be used in the storage section by a bar code or a two-dimensional code. Among these, magnetic recording and IC are more preferable.

As the hologram, a rewritable one is preferable and includes, for example, a rewritable hologram wherein interference light is written in a polymer azobenzene liquid crystal film.

Examples of the member comprising the information recording section include card, disk, disk cartridge, and tape cassette. Specific examples thereof include thick cards such as IC cards or optical cards; disc cartridges incorporating therein a photomagnetic recording disc (MD) or a disk capable of overwriting, such as DVD-RAM; discs using no disk cartridge, such as CD-RW; recordable discs such as CD-R; optical recording media (CD-RW) using a phase change recording material; and video tape cassettes.

The member comprising both a reversible display section and an information storage section will now be described by way of a card as an example. That is, by displaying a portion of information stored in the information storage section in the thermosensitive recording layer, the information can be confirmed only by having a look of the card without using a special device, and thus convenience is remarkably improved as compared with a card to which no reversible thermosensitive recording medium is applied.

The information storage section is not specifically limited as long as it can store required information and can be appropriately selected according to the purposes and, for example, magnetic recording, contact type IC, non-contact type IC, or optical memory is useful.

The magnetic thermosensitive recording layer is formed on a support by coating using commonly used a metal compound such as iron oxide or barium ferrite, and vinyl chloride resin, urethane resin nylon resin, or formed by vapor deposition or sputtering without using the resin. Also, the thermosensitive recording layer used for display can be used as the storage section by the method such as bar code or two-dimensional code.

More specifically, the following reversible thermosensitive recording label, reversible thermosensitive recording member, image processing apparatus and image processing method of the present invention can be used particularly preferably. In the present invention, the surface of the reversible thermosensitive recording medium means the surface of the thermosensitive recording layer side and is not limited to the protective layer, and also means the entire or partial surface which is brought into contact with the thermal head, for example, the surface of the printing layer and the surface of the OP layer in case of printing or erasing.

The reversible thermosensitive recording member of the present invention comprises a thermosensitive recording layer and an information storage section, each capable of reversibly displaying, and the information storage section is preferably an RF-ID tag.

Figure 2:
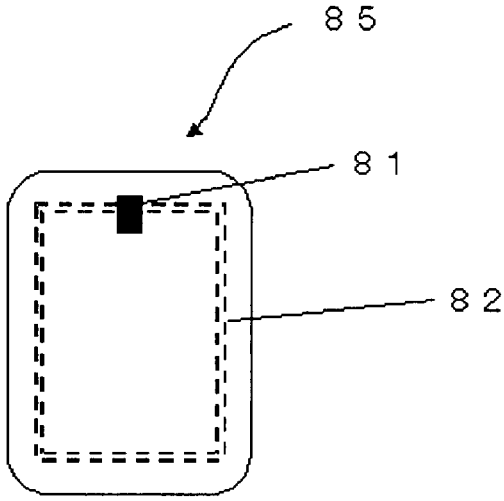
FIG. 2 is a schematic view showing an example of an RF-ID tag.

FIG. 2 is a schematic view showing an RF-ID tag 85. This RF-ID tag 85 is composed of an IC chip 81, and an antenna 82 connected to the IC chip. The IC chip 81 is divided into four sections: storage section, power supply adjustment section, transmission section and reception section, and each section takes over a portion of the function and performs communication. Transfer of data is conducted by communication of the RF-ID tag 85 communicates with an antenna of a reader/writer. Specifically, the antenna 82 of RF-ID receives electric wave from the reader/writer and electromotive force is generated by a resonance action through electromagnetic induction. As a result, the IC chip 81 in the RF-ID tag is started and signalizes information in the chip, and then a signal is received from the RF-ID tag 85. This information is received by the antenna at reader/writer side and recognized by a data-processing device, followed by data processing at software side.

Figure 3:
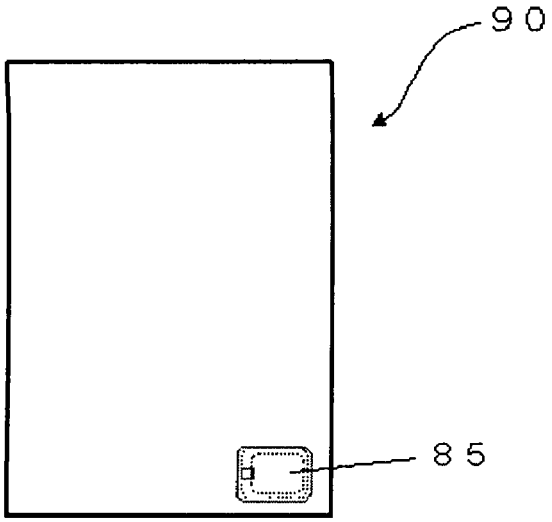
FIG. 3 is a schematic view showing the state of sticking an RF-ID tag on the back layer side of a reversible thermosensitive recording medium.

The RF-ID tag 85 is processed into a label or card and, as shown in FIG. 3, the RF-ID tag 85 can be attached to the reversible thermosensitive recording medium 90 of the present invention. The RF-ID tag 85 can be attached to the surface of the thermosensitive recording layer or that of the back layer, but is preferably attached to the surface of the back layer. To bond the RF-ID tag 85 to the reversible thermosensitive recording medium, a known adhesive or binder can be used.

Figure 4A:
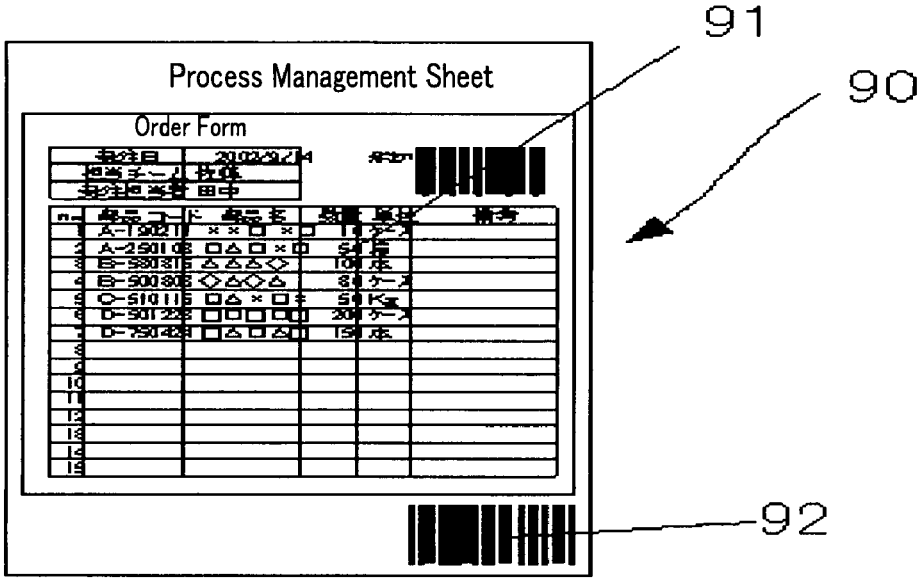
FIG. 4A is a schematic view showing an example of an industrial rewritable sheet (reversible thermosensitive recording medium).
Figure 4B:
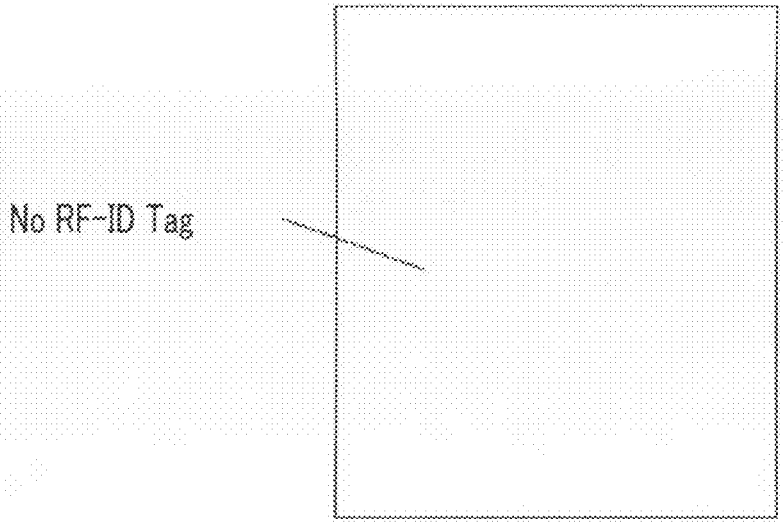
FIG. 4B is a schematic view showing the back side of FIG. 4A.

FIGS. 4A and 4B show an example wherein a reversible thermosensitive recording medium is applied to an industrial rewritable sheet (reversible thermosensitive recording member) 90. As shown in FIG. 4A, a rewritable display section 91 is provided on the side of the thermosensitive recording layer (front side) and an RF-ID tag may not be laminated on the back side (back layer) as shown in FIG. 4B. As shown in FIG. 3, the RF-ID tag 85 may be stuck, but the RF-ID tag 85 is preferably provided in view of improving convenience. In FIG. 4A, 92 represents bar code printing.

Figure 5:
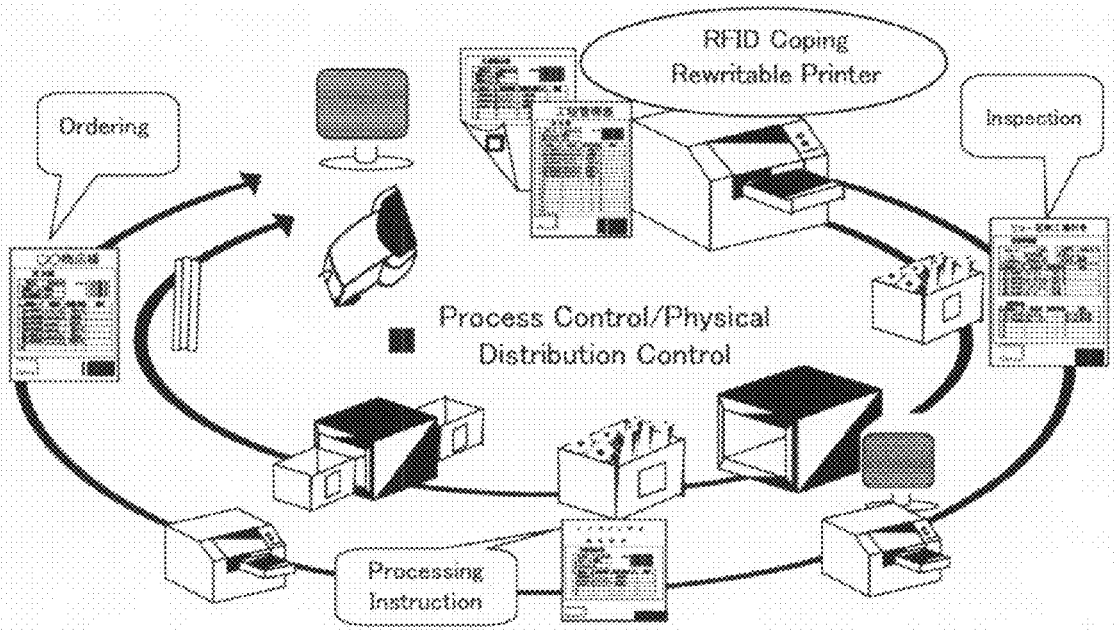
FIG. 5 is a schematic view showing how to use an industrial rewritable sheet (reversible thermosensitive recording medium).

FIG. 5 is a schematic view showing how to use an industrial rewritable sheet using the reversible thermosensitive recording medium of the present invention (rewritable sheet) and the RF-ID tag. First, information such as name and quantity of articles as materials delivered is recorded on the sheet and the RF-ID tag and attached to a tote box, followed by inspection. In the following process, processing instruction is given to the delivered materials and information is recorded on the rewritable sheet and the RF-ID tag to obtain a processing instruction book, followed by proceeding to the processing process. Then, on the processed commodity, the rewritable sheet and the RF-ID tag as an ordering instruction book, on which ordering information is recorded, and the rewritable sheet is recovered after commodity shipment and shipment information is read, and it is used again as an ordinary bill.

(Reversible Thermosensitive Recording Label)

The reversible thermosensitive recording label of the present invention comprises at least either an adhesive layer or a binder layer on the surface opposite to the surface the reversible thermosensitive recording medium of the present invention on which an image is to be formed (in case of comprising the thermosensitive recording layer on the support, the surface opposite to the surface on which the thermosensitive recording layer of the support is formed, and further comprises the other layer selected appropriately, if necessary. In case of the reversible thermosensitive recording medium using a heat fusible support as the support, it is not necessarily to form an adhesive layer or a binder layer on the surface opposite to the surface on which the thermosensitive recording layer of the support is formed.

The shape, structure and size of the adhesive layer or the binder layer are not specifically limited. The shape includes, for example, a sheet or a film, and the structure may be a single-layered structure or a multi-layered structure, and the size may be larger or smaller than that of the thermosensitive recording layer.

The material of the adhesive layer or the binder layer is not specifically limited and can be appropriately selected according to the purposes, and examples thereof include urea resins, melamine resins, phenol resins, epoxy resins, vinyl chloride resins, vinyl acetate-acrylic copolymers, ethylene-vinyl acetate copolymer, acrylic resin, polyvinylether resin, vinyl chloride-vinyl acetate copolymer, polystyrene resin, polyester resins, polyurethane resins, polyamide resins, chlorinated polyolefin resins, polyvinylbutyral resins, acrylate ester copolymers, methacrylate ester copolymers, natural rubbers, cyanoacrylate resins, and silicone resins. These materials may be used alone or in combination. The material may be a hot melt type material, and a release paper or a non-release type paper may be used.

The reversible thermosensitive recording label is commonly attached to a support sheet when used. The reversible thermosensitive recording label may be attached to the entire surface or a portion of the surface of the support sheet, or may be provided on one or both surfaces of the support sheet, and is appropriately selected.

The shape, structure and size of the base material sheet are not specifically limited and can be appropriately selected according to the purposes, and the shape includes, for example, a tabular shape, and the structure may be a single-layered structure or a multi-layered structure, and the size can be appropriately selected according to the size of the reversible thermosensitive recording medium. For example, a sheet made of a material such as chlorine-containing polymer, polyester resin or biodegradable plastic resin, and a laminate thereof are used.

The chlorine-containing polymer is not specifically limited and can be appropriately selected according to the purposes, and examples thereof include polyvinyl chloride, vinyl chloride-vinyl acetate copolymer, vinyl chloride-vinyl acetate-vinyl alcohol copolymer, vinyl chloride-vinyl acetate-maleic acid copolymer, vinyl chloride-acrylate copolymer, polyvinylidene chloride, vinylidene chloride-vinyl chloride copolymer, and vinylidene chloride-acrylonitrile copolymer.

Examples of the polyester resin include polyethylene terephthalate resin (PET), polybutylene terephthalate resin (PBT), or a condensed ester resin (for example, PETG: trade mark of Eastman Chemical Company) of an acid component such as terephthalic acid or isophthalic acid and an alcohol component such as ethylene glycol or cyclohexanedimethanol.

Examples of the biodegradable plastic resins include polylactic acid resins, natural polymer resins composed of starch and modified polyvinyl alcohol, and a microbially produced resin composed of β-hydroxybutyric acid and β-hydroxyvaleric acid.

The material of the base material sheet further includes a synthetic resin sheet or a synthetic paper made of poly acetate resin, polystyrene (PS) resin, epoxy resin, polyvinyl chloride (PVC) resin, polycarbonate (PC) resin, polyamide resin, acrylic resin, or silicone resin. These materials may be appropriately used in combination, or these materials may be laminated.

Examples of the laminate include a laminate obtained by laminating a 100 μm thick transparent polyvinyl chloride resin sheet as an over sheet on both surfaces of a core sheet formed by laminating two 250 μm thick white polyvinyl chloride resin sheets, and a laminate obtained by laminating a 100 μm thick transparent PETG sheet as an over sheet on both surfaces of a core sheet formed by laminating two 250 μm thick white PETG sheets.

Figure 6:
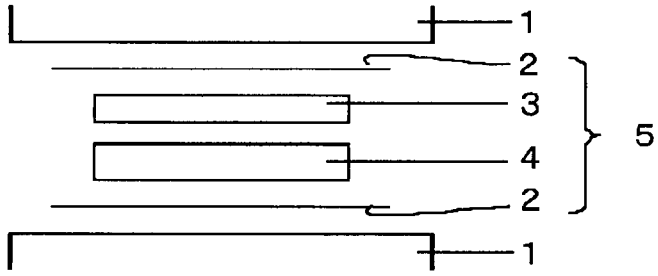
FIG. 6 is a view showing an example of the step of thermocompression bonding of a reversible thermosensitive recording label and a support sheet in the present invention.
Figure 7:
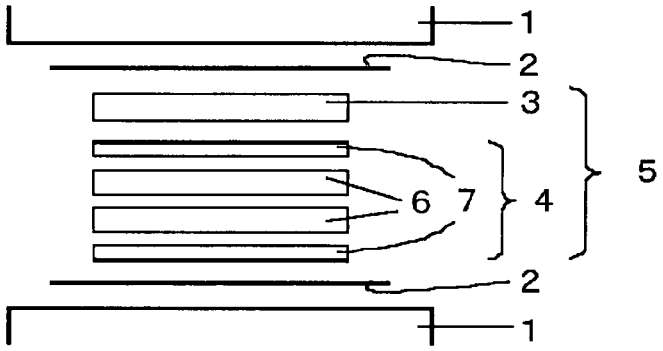
FIG. 7 is a view showing another example of the step of thermocompression bonding of a reversible thermosensitive recording label and a support sheet in the present invention.

The support sheet and the reversible thermosensitive recording label are laminated by laying a reversible thermosensitive recording label 3 and a support sheet 4 one upon another so as to face with each other, followed by interposing between two mirror plates 2 and further pressing while applying heat using a hot plate 1, as shown in FIG. 6. As shown in FIG. 7, lamination can be conducted in the same manner as in FIG. 6, except for using a support sheet 4 formed by laying a core sheet 6 and an over sheet 7 one upon another.

Thermocompression bonding is conducted under pressure of commonly from 5 $kgf/cm^2$ to 70 $kgf/cm^2$, preferably from 10 $kgf/cm^2$ to 50 $kgf/cm^2$ at a temperature within a range from 80° C. to 170° C., preferably from 90° C. to 150° C., using known means, for example, hot pressing machine equipped with a hot plate 1.

When a laminate with a layer configuration of transparent polyvinyl chloride sheet/white polyvinyl chloride sheet/white polyvinyl chloride sheet/transparent polyvinyl chloride sheet is used as the support sheet, the heating temperature upon thermocompression bonding is preferably from about 130° C. to 150° C. When using a laminate with a layer configuration of transparent PETG/white PETG/white PETG/transparent PETG, the heating temperature is preferably from about 100° C. to 130° C.

Another method of laminating the reversible thermosensitive recording label with the support sheet can be conducted by laminating after preliminary thermobonding. The thermobonding is conducted by pressing a rubber roll against them and is completed after heat laminating.

The conditions of the thermobonding are not specifically limited and optimum conditions are decided by the support sheet to be used, and the thermobonding can be conducted in the state of maintaining at a temperature of 90° C. to 130° C. for one hour or less, for example, 1 to 50 minutes.

In the present invention, in case of thermocompression bonding of a reversible thermosensitive recording label having a protective layer with the surface roughened by a filler on a support sheet such as card, the filler on the surface of the protective layer is pushed into the protective layer or the lower layer as a result of thermocompression bonding and thus surface gloss increases and the effect of the filler is lost, resulting in deterioration of repeated use durability. Furthermore, printing and erasing are repeated in the state of increased surface gloss, gloss of the area where printing and erasing were conducted decreases, and thus a difference in gloss with the non printed/erased area is recognized as gloss unevenness. However, such a problem can be solved by providing the protective layer of the reversible thermosensitive recording medium of the present invention. In this case, the surface roughness of the reversible thermosensitive recording medium is preferably 0.15 μm or less because higher gloss feeling is obtained.

When the reversible thermosensitive recording label comprises at least either the adhesive layer or the binder layer, it can be attached to the entire surface or a portion of the surface of a thick support made of vinyl chloride card with a magnetic stripe, on which the thermosensitive recording layer is not easily formed, and thus making it possible to display a portion of information stored magnetically.

The reversible thermosensitive recording label can be used as a substitute for thick card such as IC card or optical card; disc cartridge incorporating disc capable of rewriting storage information, such as flexible disk, photomagnetic recording disc (MD) or DVD-RAM; disc using no disk cartridge such as CD-RW; recordable disc such as CD-R; optical recording medium (CD-RW) using a phase change recording material, and display label on a video tape cassette.

Figure 8:
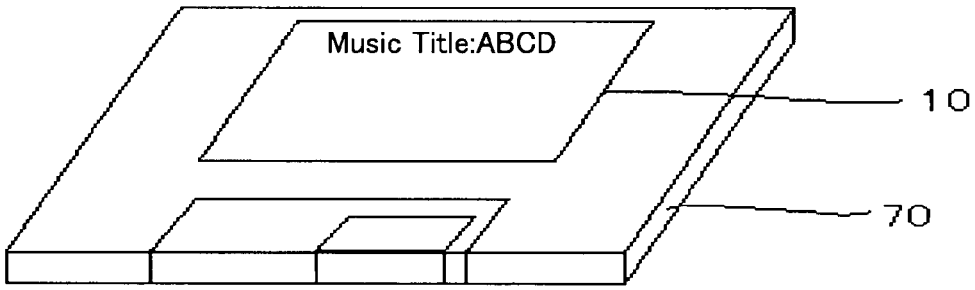
FIG. 8 is a schematic view showing an example of the state of sticking the reversible thermosensitive recording label of the present invention on a disk cartridge of MD.

FIG. 8 is a schematic view showing an example wherein a reversible thermosensitive recording label 10 of the present invention is attached to a disk cartridge 70 of MD. In this case, it is possible to widely use to the application wherein the contents of display are automatically changed according to the change of the contents to be stored to MD. In case of a disk which does not use a disk cartridge such as CD-RW, the reversible thermosensitive recording label of the present invention may be directly attached to a disc.

Figure 9:
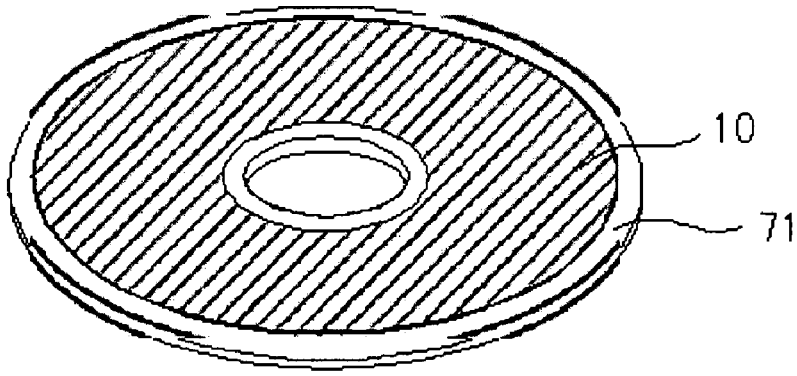
FIG. 9 is a schematic view showing an example of sticking a reversible thermosensitive recording label of the present invention on an optical recording medium (CD-RW).

FIG. 9 is a schematic view showing an example wherein a reversible thermosensitive recording label 10 of the present invention is attached to CD-RW 71. In this case, it is possible to display a portion of storage information recorded additionally on CD-R by sticking the reversible thermosensitive recording label 10 to a recordable disc in place of CD-RW 71.

Figure 10:
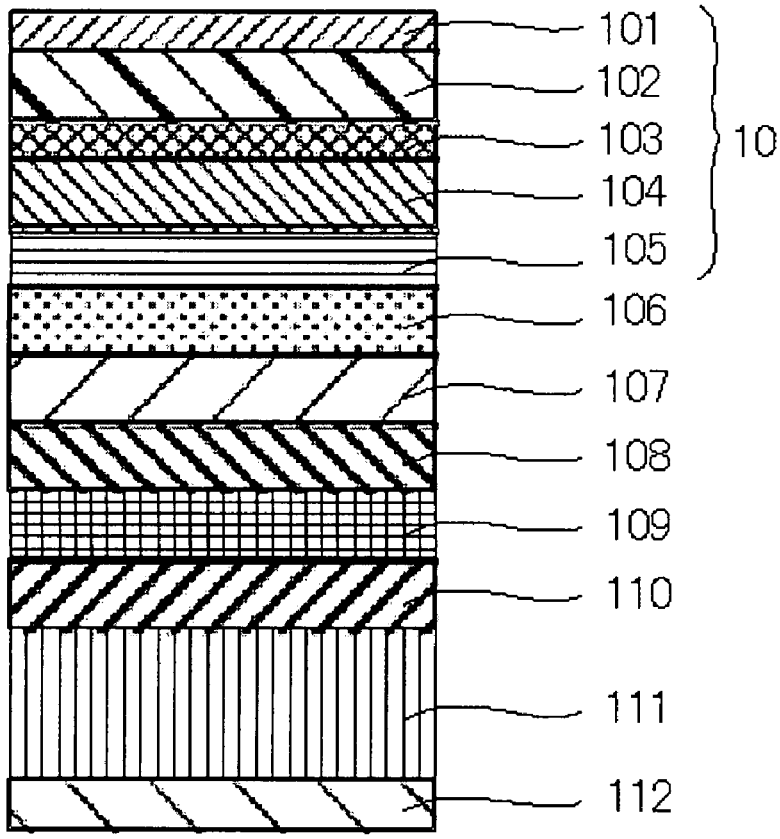
FIG. 10 is a schematic sectional view showing an example of the state of sticking a reversible thermosensitive recording label of the present invention on an optical recording medium (CD-RW).

FIG. 10 is a schematic sectional view showing an example wherein a reversible thermosensitive recording label 10 of the present invention is attached to an optical recording medium (CD-RW) using a AgInSbTe phase change recording material. A basic configuration of this D-RW is as follows: a first dielectric layer 110, a photoinformation memory layer 109, a second dielectric layer 108, a reflective heat radiation layer 107 and an intermediate layer 106 are provided in this order on a support 111 with a groove, and a hardcoat layer 112 is provided on the backside of the support 111. On the intermediate layer 106 of CD-RW, the reversible thermosensitive recording label of the present invention 10 is stuck. The reversible thermosensitive recording label 10 comprises a layer 105 of either an adhesive or a binder layer, a back layer 104, a support 103, a thermosensitive recording layer 102 and a protective layer 101 in this order. It is not necessarily to provide the dielectric layer on both surfaces of the photoinformation memory layer. In case the support is made of a material having low heat resistance, like a polycarbonate resin, a first dielectric layer 110 is preferably provided.

Figure 11:
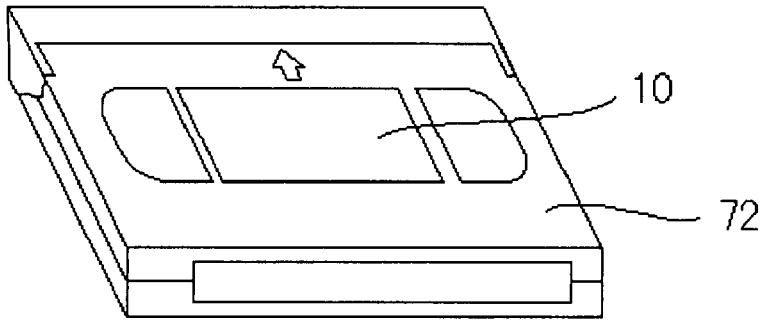
FIG. 11 is a schematic view showing an example of the state of sticking a reversible thermosensitive recording label of the present invention on a video cassette.

FIG. 11 is a schematic view showing an example wherein a reversible thermosensitive recording label 10 of the present invention is attached to a video cassette 72. In this case, it is possible to widely use to the application wherein the contents of display are automatically changed according to the change of the contents to be stored to the video tape cassette 72.

Examples of the method of imparting the reversible thermosensitive recording function on any of a card, a disk, a disk cartridge and a tape cassette include, in addition to a method of sticking a reversible thermosensitive recording label, a method of directly forming the thermosensitive recording layer thereon by coating, and a method of preliminary forming the thermosensitive recording layer on another support and transferring the thermosensitive recording layer onto the card, the disk, the disk cartridge and the tape cassette. In case of the method of transferring the thermosensitive recording layer, the hot melt type adhesive layer or binder layer may be provided on the thermosensitive recording layer. In case the reversible thermosensitive recording label is attached to the thermosensitive recording layer is provided on a rigid one such as the card, the disk, the disk cartridge and tape cassette, it is preferable to provide a layer or sheet, which is resilient and serves as a cushion, between a rigid support and a label or the thermosensitive recording layer so as to improve contact with the thermal head thereby uniformly forming images.

Figure 12:
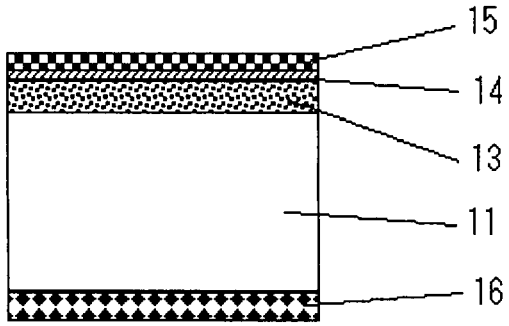
FIG. 12 is a schematic sectional view showing an example of a layer configuration of a reversible thermosensitive recording medium of the present invention.
Figure 13:
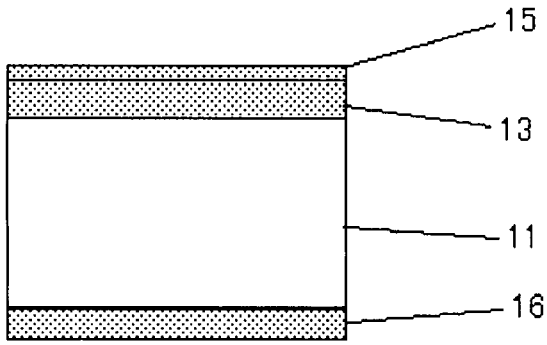
FIG. 13 is a schematic sectional view showing another example of a layer configuration of a reversible thermosensitive recording medium of the present invention.

The reversible thermosensitive recording medium of the present invention can include an aspect such as film comprising a support 11, a reversible thermosensitive recording layer 13, an intermediate layer 14 and a protective layer 15 formed on the support, and a back layer 16 formed on the back side of the support 11, as shown in FIG. 12, or a film comprising a support 11, a reversible thermosensitive recording layer 13 and a protective layer 15 formed on the support 11, and a back layer 16 formed on the back side of the support 11, as shown in FIG. 13.

Figure 14A:
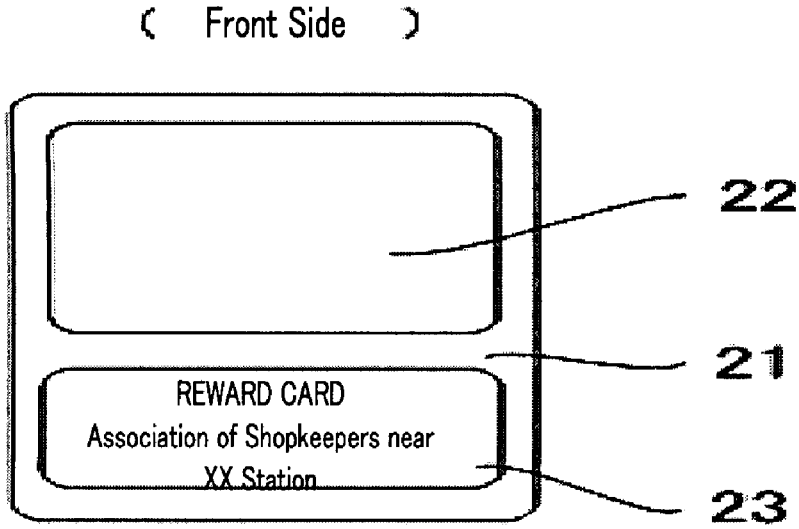
FIG. 14A is a schematic view showing the front side of an example of a reversible thermosensitive recording medium of the present invention processed into a card.
Figure 14B:
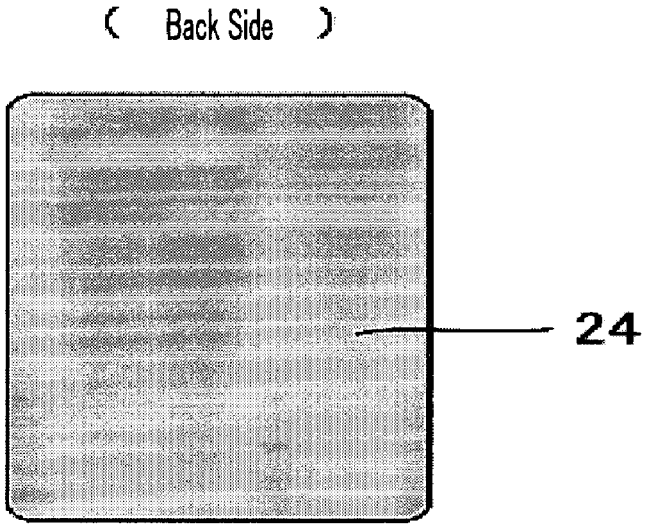
FIG. 14B is a schematic view showing the back side of FIG. 14A.

These films (reversible thermosensitive recording media) of these aspects can be preferably used in various industrial rewritable sheets provided with the RF-ID tag 85 shown in FIG. 4. For example, as shown in FIG. 14A, it can be used as a form processed into a reversible thermorecording card 21 having a printing display section 23. As shown in FIG. 14B, on the back side of the card, a magnetic recording section is formed and a back layer 24 is formed on the magnetic recording section.

Figure 15A:
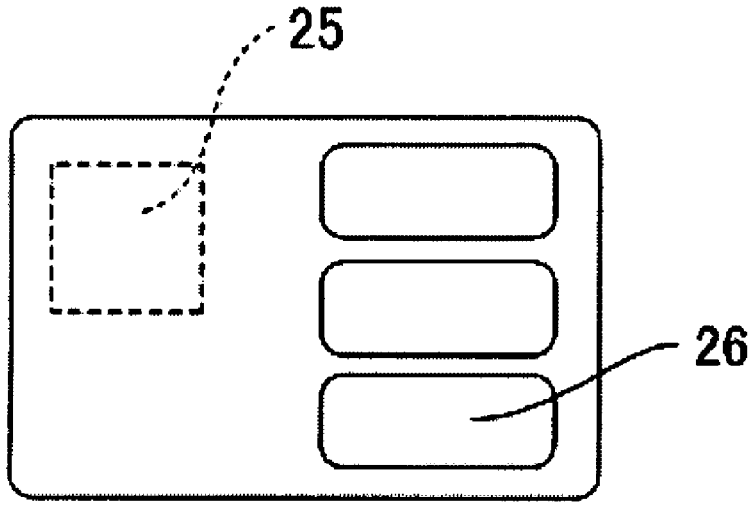
FIG. 15A is a schematic view showing a reversible thermosensitive recording medium of the present invention processed into another card.
Figure 15B:
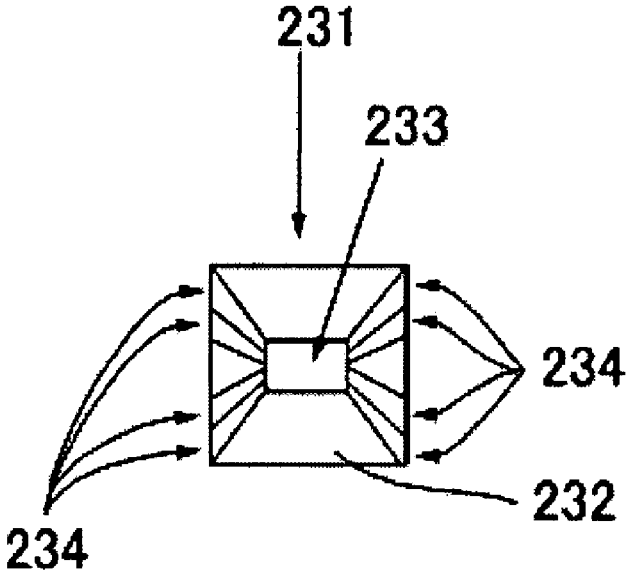
FIG. 15B is a schematic view showing an IC chip to be embedded in a recessed portion for IC chip of FIG. 15A.

A reversible thermosensitive recording member (card) shown in FIG. 15A is obtained by processing a film comprising a support, and a reversible thermosensitive recording layer and a protective layer formed on the support into a card, and forming recessed portion 25 containing an IC chip. In FIG. 15A, a card-shaped reversible thermosensitive recording medium is provided with a rewriting recording section 26 by label processing, and also a recessed portion 25 for embedding an IC chip is formed at the predetermined position on the back side of the card. As shown in FIG. 15B, a wafer 231 is assembled and fixed into the recessed portion 25. In the wafer 231, an integrated circuit 233 is provided on a wafer substrate 232 and plural contact terminals 234 connected electrically to the integrated circuit 233 are provided on the wafer substrate 232. This contact terminal 234 is exposed on the back side of the wafer substrate 232 and an exclusive printer (reader/writer) serves to read or rewrite predetermined information by bringing into electrically contact with the contact terminal 234.

The function of the reversible thermorecording card will now be described with reference to FIG. 16.

Figure 16A:
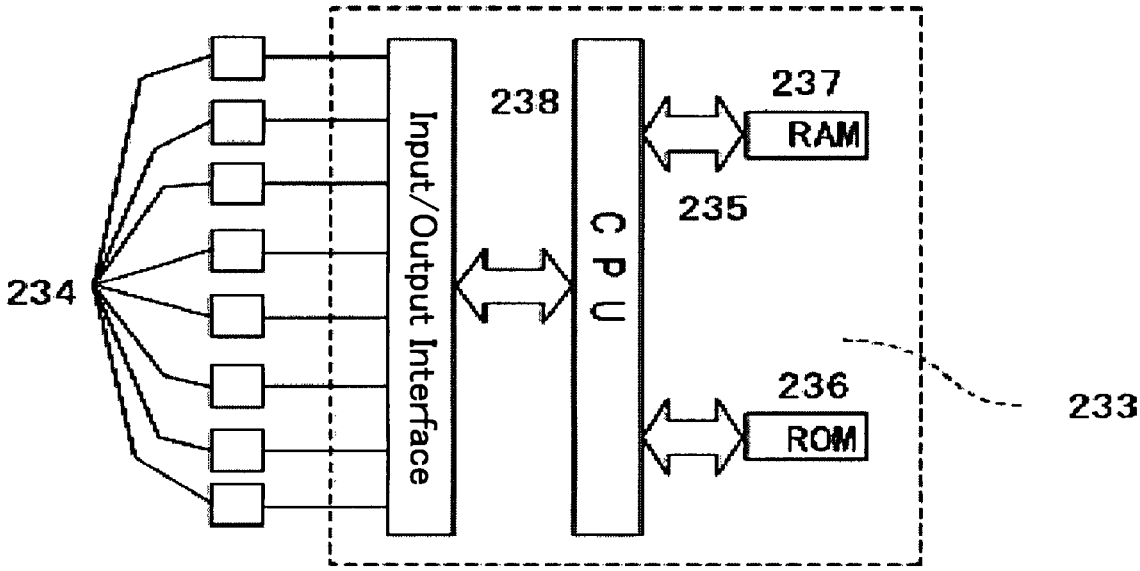
FIG. 16A is a schematic constituent block diagram showing an integrated circuit.
Figure 16B:
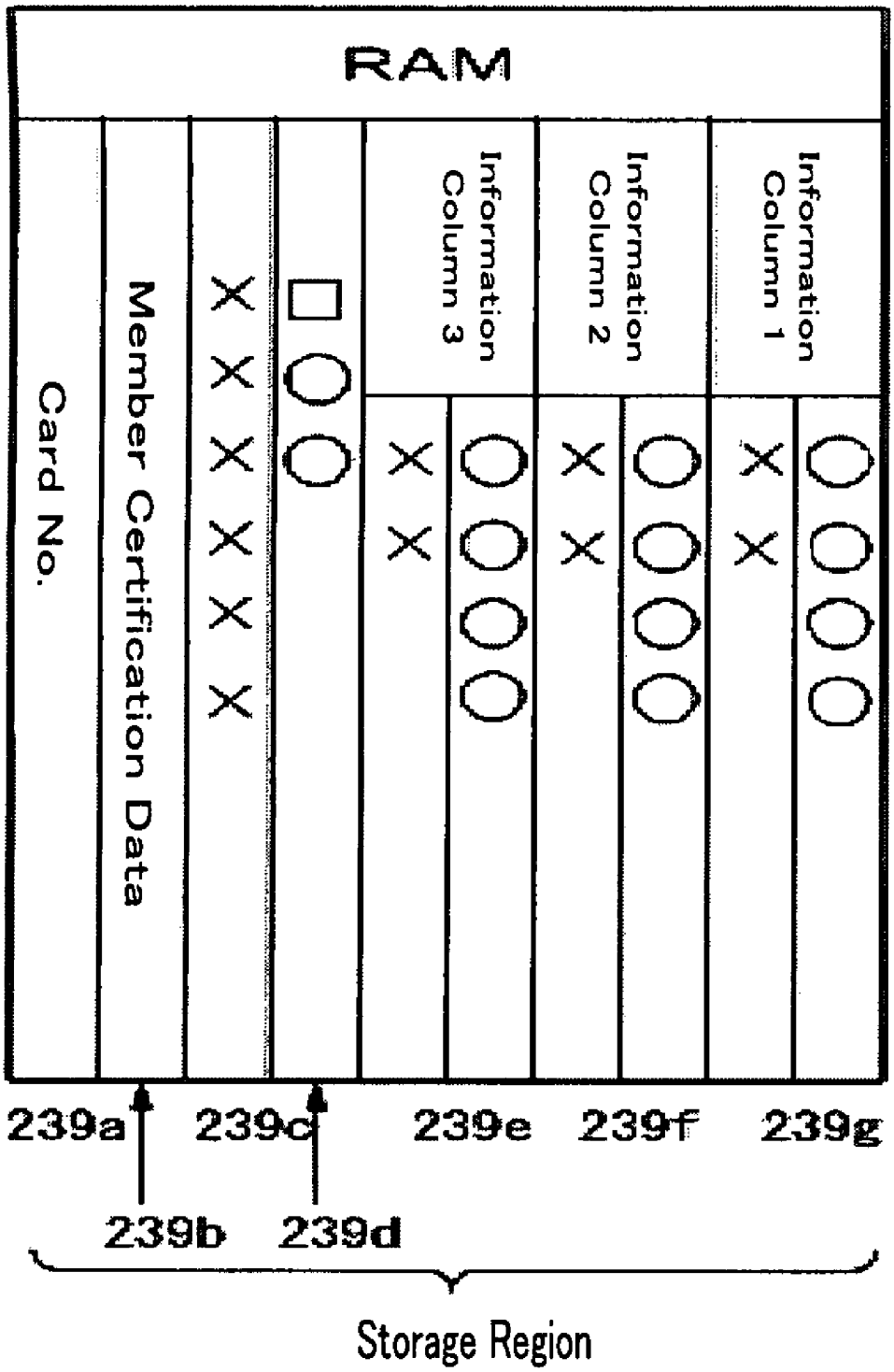
FIG. 16B is a schematic view showing that RAM includes plural storage regions.

FIG. 16A is a schematic constituent block diagram showing an integrated circuit 233. Also, FIG. 16B is a constituent block diagram showing an example of stored data of RAM. The integrated circuit 233 is composed, for example, of LSI and includes CPU 235 capable of carrying out a control operation by the predetermined procedure, ROM 236 for housing action programming data of CPU 235, and RAM 237 capable of writing and reading required data. Furthermore, the integrated circuit 233 includes an input/output interface 238 which receives an input signal to provide the input data to CPU 235 and also receives an output signal from CPU 235 to output to the outside, and a power-on-reset circuit, a clock generating circuit, a pulse divider circuit (interruption pulse generating circuit) and an address decoding circuit (these circuits are not shown).

CPU 235 can carry out the operation of interruption control routine according to an interruption pulse applied periodically from a pulse divider circuit. Also, an address decoding circuit decodes address data from CPU 235 to provide a signal to ROM 236, RAM 237 and an input/output interface 238. To the input/output interface 238, plural (eight contact terminals in FIG. 16A) contact terminals 234 are connected, and predetermined data from an exclusive printer (reader/writer) are inputted into CPU 235 from the contact terminal 234 via the input/output interface 238. CPU 235 responds to an input signal and carries out each operation in accordance with program data housed in ROM 236, and also outputs predetermined data and signals to a sheet reader/writer via the input/output interface 238.

As shown in FIG. 16B, RAM 237 includes a plurality of storage regions 239*a* to 239*g*. For example, sheet numbers are stored in the storage region 239*a*. For example, ID data such as name, position and telephone number of a sheet controller are stored in the storage region 239*b*. For example, residual margin which can be used by a user and information concerning handling are stored in a storage region 239*c*. For example, information concerning ex-manager and ex-user is stored in the storage region 239*d*, the storage region 239*e*, the storage region 239*f* and the storage region 239*g*.

At least either the reversible thermosensitive recording label or the reversible thermosensitive recording member of the present invention is not specifically limited and image processing can be conducted by various image processing methods and image processing apparatuses, and also images are preferably formed and erased using an image processing apparatus of the present invention described hereinafter.

(Image Processing Method and Image Processing Apparatus)

The image processing apparatus of the present invention comprises at least either an image forming unit or an image erasing unit, and further comprises additional unit(s) selected appropriately, if necessary, for example, a transferring unit and controlling unit.

The image processing method of the present invention comprises at least either an image forming step of heating the reversible thermosensitive recording medium of the present invention thereby forming images on the reversible thermosensitive recording medium, or an image erasing step of heating the reversible thermosensitive recording medium of the present invention thereby erasing images formed on the reversible thermosensitive recording medium, and further comprises other steps, if necessary, for example, a transferring step and a controlling step.

The image processing method of the present invention can be preferably carried out by the image processing apparatus of the present invention, and at least either formation or erasure of images by heating the reversible thermosensitive recording medium of the present invention can be conducted by at least either an image forming unit or an image erasing unit, and the other step can be conducted by the other units.

—Image Forming Unit and Image Erasing Unit—

The image forming unit is a configured to heat the reversible thermosensitive recording medium of the present invention thereby forming images. Also, the image erasing unit is a configured to heat the reversible thermosensitive recording medium of the present invention thereby erasing the images.

The image forming unit is not specifically limited and can be appropriately selected according to the purposes, and examples thereof include thermal head and laser. These image forming units may be used alone or in combination.

The image erasing unit is a configured to heat the reversible thermosensitive recording medium of the present invention thereby erasing the images, and examples thereof include hot stamp, ceramic heater, heat roller, heat block, hot air, thermal head, and laser irradiation device. Among these image erasing units, a ceramic heater is preferable. By using the ceramic heater, the size of the apparatus can be reduced, and also a stable erased state can be obtained and images with good contrast can be obtained. The setting temperature of the ceramic heater is not specifically limited and can be appropriately selected according to the purposes, and is preferably 110° C. or higher, more preferably 112° C. or higher, and particularly preferably 115° C. or higher.

By using the thermal head, further size reduction of the apparatus can be conducted, and also power consumption can be decreased and a battery driving handy type apparatus can be used. Also, it is possible to use one thermal head which can simultaneously record and erase images. In this case, further size reduction of the apparatus can be conducted. In case of recording and erasing using one thermal head, new images may be recorded after entirely erasing old images, or it is also use an overwriting system wherein old images are erased at a time by changing energy every image and then new images are recorded. According to the overwriting system, the recording speed increased because the total time of recording and erasing the images decreases.

When using a reversible thermosensitive recording member (card) comprising the thermosensitive recording layer and the information storage section, the apparatus also includes a configured to read out the storage of the information storage section and a configured to rewrite the stored information.

The transferring unit is not specifically limited as long as it has a function of sequentially transferring the reversible thermosensitive recording medium and can be appropriately selected according to the purposes, and examples thereof include a transfer belt, a transfer roller, and a combination of a transfer belt and a transfer roller.

The controlling unit is not specifically limited as long as it has a function of controlling each step, and can control each step, and examples thereof include equipment such as sequencers and computers.

An aspect of carrying out the image processing method of the present invention using the image processing apparatus of the present invention will now be described with reference to FIG. 17 to FIG. 19.

Figure 17:
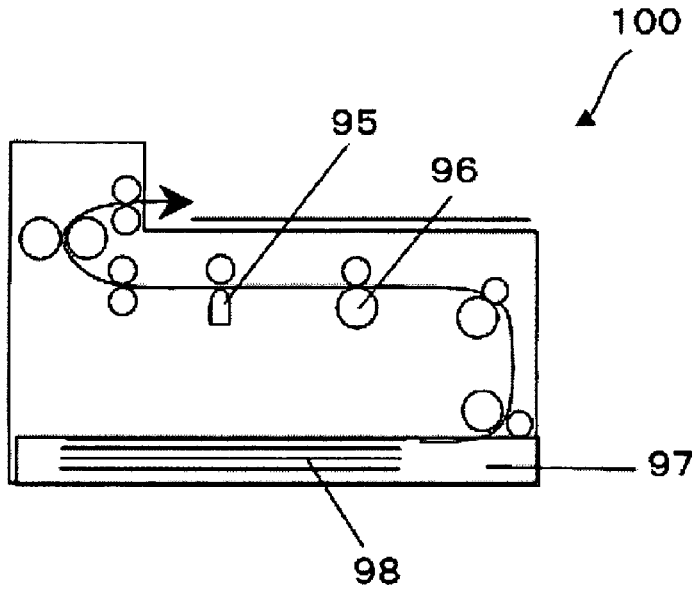
FIG. 17 is a schematic view showing an example of an image processing apparatus used in an image processing method of the present invention.

As shown in FIG. 17, an image processing apparatus 100 comprises a heat roller 96, a thermal head 95, and a transfer roller. In this image processing apparatus, the images recorded on the thermosensitive recording layer are erased with heating at the heat roller 96. Then, processed new information is recorded on the thermosensitive recording layer by the thermal head 95. In FIG. 17, the numeral 97 denotes a paper feed tray, and the numeral 98 denotes a rewritable sheet (reversible thermosensitive recording medium).

Figure 18:
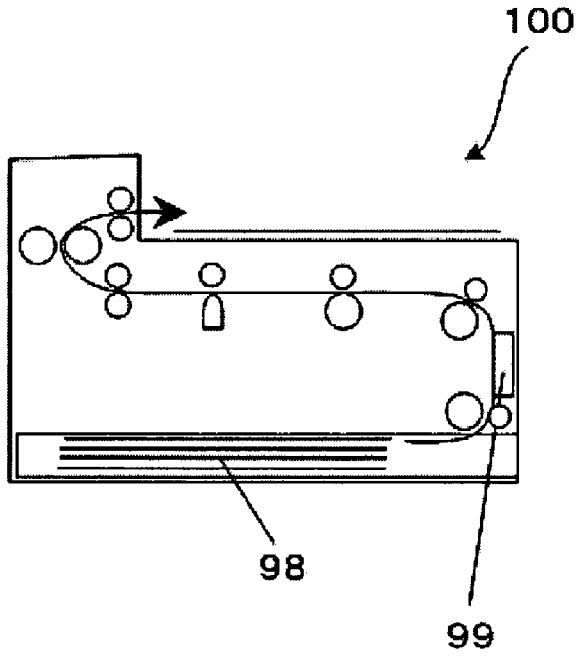
FIG. 18 is a schematic view showing another example of an image processing apparatus to be used in an image processing method of the present invention.
Figure 19:
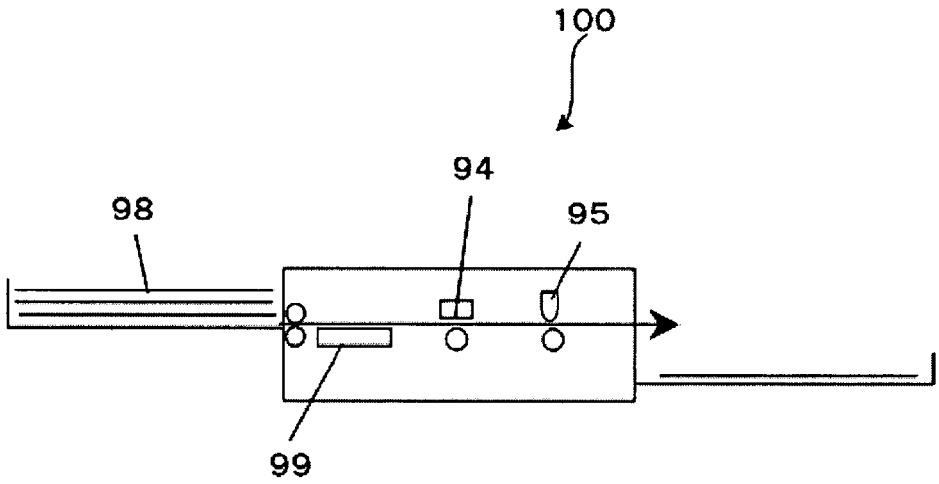
FIG. 19 is a schematic view showing still another example of an image processing apparatus to be used in an image processing method of the present invention.

In case the reversible thermosensitive recording medium comprises an RF-ID tag, as shown in FIG. 18 and FIG. 19, it is further provided with an RF-ID reading device 99. In this case, there is also included an aspect of a parallel type image processing apparatus shown in FIG. 19.

As shown in FIG. 18 and FIG. 19, in this image processing apparatus 100, first, information of the RF-ID tag attached to the reversible thermosensitive recording medium is read by an RF-ID reader/writer 99 and, after inputting new information into RF-ID, the images recorded on a thermosensitive recording layer by a heat roller are erased with heating. Furthermore, processed new information is recorded on the thermosensitive recording layer by a thermal head based on the information which was read and rewritten by the RF-ID reader/writer.

In addition to the RF-ID reader/writer, a bar code reading device and a magnetic head may be used. In case of the bar code reading device, bar code information, which has already recorded on the reversible thermosensitive recording layer, is read and bar code and visualized information recorded on the reversible thermosensitive recording layer is erased by the heat roller, and then new information processed based on the information read from the bar code is recorded as bar code and visualized information on the reversible thermosensitive recording layer by the thermal head.

Image processing apparatuses shown in FIG. 17 or FIG. 18 are provided with a tray in which a reversible thermosensitive recording medium is stacked, and a medium is picked up one by one from the tray by a paper feeding method of a friction pad system. The transferred medium is transferred by a transfer roller and then sent to the RF-ID reader/writer section, where data are read and written. Furthermore, a reversible thermosensitive recording medium is transferred to the heat roller section as an erasing unit by the transfer roller and visualized information recorded on the medium is erased. After transferred to the thermal head section, new information is recorded on the reversible thermosensitive recording medium. Then, the reversible thermosensitive recording medium is transferred by the transfer roller the medium is discharged from an upper paper ejecting section.

The setting temperature of the heat roller is preferably set to the temperature suited for the erasing temperature of the reversible thermosensitive recording medium. For example, the temperature of the surface of the heat roller is preferably 100° C. or higher and 190° C. or lower, more preferably 110° C. or higher and 180° C. or lower, and still more preferably 115° C. or higher and 170° C. or lower.

Figure 20A:
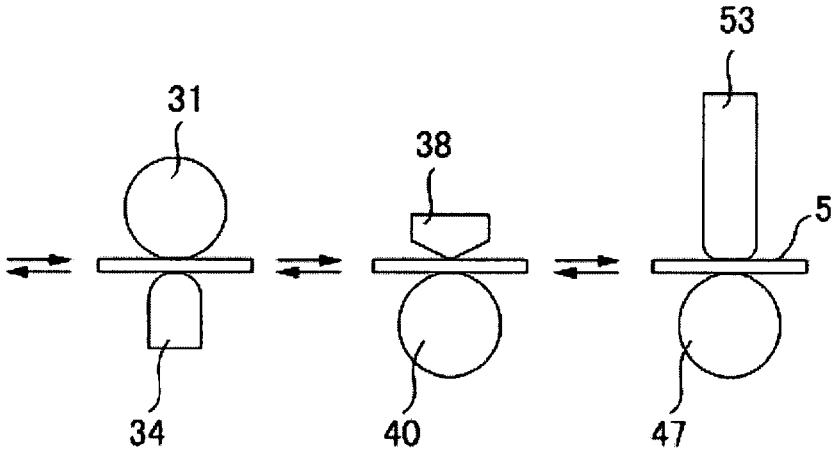
FIG. 20A is a schematic view showing an image processing apparatus in case images are erased by a ceramic heater and images are formed by a thermal head, respectively.
Figure 20B:
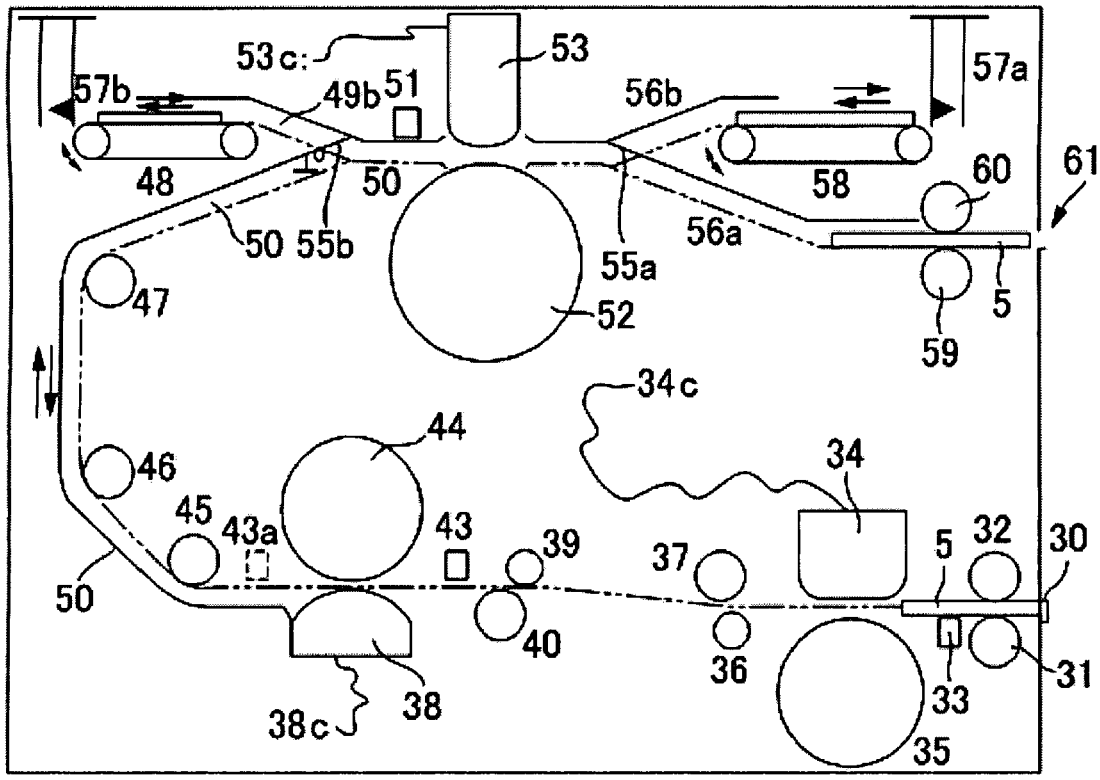
FIG. 20B is a schematic view showing an example of an image processing apparatus of the present invention.

Furthermore, description is made with reference to FIG. 20A and FIG. 20B. An image processing apparatus shown in FIG. 20A comprises a thermal head 53 as the heat treating unit, a ceramic heater 38, a magnetic head 34, and transfer rollers 31, 40 and 47.

As shown in FIG. 20A, in this image processing apparatus, first, information stored in a magnetic thermosensitive recording layer of a reversible thermosensitive recording medium is read by a magnetic head. Then, the images recorded on the reversible thermosensitive recording layer by a ceramic heater are erased with heating. Furthermore, processed new information is recorded on the reversible thermosensitive recording layer by the thermal head based on the information read by the magnetic head. Then, the information of the magnetic thermosensitive recording layer is rewritten as new information.

In the image processing apparatus shown in FIG. 20A, a reversible thermosensitive recording medium 5 wherein a magnetic thermosensitive recording layer is provided on the surface opposite to a thermosensitive recording layer is transferred along a transfer path shown by opposing arrows, or transferred along the transfer path in a reverse direction in the apparatus. The reversible thermosensitive recording medium 5 is subjected to magnetic recording or erasing on the magnetic thermosensitive recording layer between a magnetic head 34 and a transfer roller 31 and heat treated between a ceramic heater 38 and a transfer roller 40 so as to erase the images, and then images are formed between a thermal head 53 and a region transfer roller 47. Thereafter, the reversible thermosensitive recording medium is discharged out of the apparatus. As described hereinabove, the setting temperature of the ceramic heater 38 is preferably 110° C. or higher, more preferably 112° C. or higher, and particularly preferably 115° C. or higher. The magnetic recording may be rewritten by the ceramic heater before or after erasing the images. If desired, after passing through the ceramic heater 38 and the transfer roller 40 or passing through the thermal head 53 and the transfer roller 47, the medium is transferred in the transfer path in the reverse direction. It is possible to subject again to the heat treatment by the ceramic heater 38 and the printing treatment by the thermal head 53.

In an image processing apparatus shown in FIG. 20B, the reversible thermosensitive recording medium 5 inserted through an outlet/inlet 30 proceeds along a transfer path 50 shown by the dotted line, or proceeds along the transfer path 50 in the reverse direction in the apparatus. The reversible thermosensitive recording medium 5 inserted through the outlet/inlet 30 is transferred in a recording device by a transfer roller 31 and a guide roller 32. When the medium reached the predetermined position of the transfer path 50, its presence is recognized by a sensor 33 through controlling unit 34*c*. After magnetic recording or erasing is conducted on the magnetic thermosensitive recording layer between a magnetic head 34 and a platen roller 35, the medium is passed between a guide roller 36 and a transfer roller 37, passed between a guide roller 39 and a transfer roller 40, heat treated between a ceramic heater 38 and a platen roller 44, which operate by recognition of its presence by a sensor 43, through ceramic heater controlling unit 38*c* so as to erase the images, transferred in a transfer path 50 by transfer rollers 45, 46 and 47. After forming images between a thermal head 53 and a platen roller 52, which operate by recognition of its presence by a sensor 51, through thermal head controlling unit 53*c* at the predetermined position, the medium is discharged out of the apparatus through the transfer path 56*a* by a transfer roller 59 and a guide roller 60 via an outlet 61. The setting temperature of the ceramic heater 38 is not specifically limited and can be appropriately selected according to the purposes, and is preferably 110° C. or higher, more preferably 112° C. or higher, and particularly preferably 115° C. or higher.

If desired, after introducing into a transfer path 56*b* by switching transfer path switching unit 55*a*, the reversible thermosensitive recording medium 5 is heat treated again between a thermal head 53 and a platen roller 52 by a transfer belt 58 moving in the reverse direction through the operation of a limit switch 57*a* inputted by pressing the reversible thermosensitive recording medium 5, transferred in the forward direction through a transfer path 49*b* opened by switching the transfer path switching unit 55*b*, a limit switch 57*b* and a transfer belt 48, and then discharged out of the apparatus through the transfer path 56*a* by a transfer roller 59 and a guide roller 60 via an outlet 61. Furthermore, the branched transfer path and a transfer switching unit can also be provided at both ends of the ceramic heater 38. In that case, a sensor 43*a* is preferably provided between a platen roller 44 and a transfer roller 45.

As is apparent from the following detailed and concrete descriptions, the present invention exerts extremely excellent effect capable of providing a reversible thermosensitive recording medium which does not cause surface cracking even when handled like a paper and does not curl when used repeatedly, and also can keep compatibility between printability, adhesion and transferability of a conventional medium and can repeatedly conduct color development and erasure, and to a reversible thermosensitive recording label, a reversible thermosensitive recording member, an image processing apparatus and an image processing method, each using the reversible thermosensitive recording medium.

EXAMPLES

Examples of the present invention will now be described, but the present invention is not limited in scope to the following Examples. Note also in that "part(s)" means "part(s) by mass" unless otherwise indicated.

Example 1

Preparation of Reversible Thermosensitive Recording Medium

Formation of Thermosensitive Recording Layer

The following components were ground and dispersed so as to adjust an average particle size within a range from 0.1 μm to 1.0 μm using a ball mill.

2-anilino-3-methyl-6-dibutylaminofluorane (solid content: 100%): 1 part

Electron acceptive compound (developer, solid content: 100%) represented by the following structural formula:

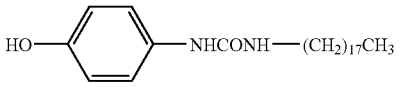

4 parts

Dialkylurea (manufactured by Nippon Kasei Chemical Co., Ltd., Hacreen SB, solid content: 100%):

1 part 40 mass % acrylpolyol resin solution (manufactured by Mitsubishi Rayon Co., Ltd., LR327):

10 parts

Methyl ethyl ketone:

80 parts

To the resulting dispersion solution, 4 parts by mass of isocyanate (manufactured by Nippon Polyurethane Industry Co., Ltd., Coronate HL, solid content: 75%) was added, followed by thorough stirring to prepare a coating solution for thermosensitive recording layer. Then, the resulting coating solution for thermosensitive recording layer was coated on a 188 μm thick opaque polyester film (manufactured by Teijin DuPont Co., Ltd., Tetoron film) using a wire bar, dried at 100° C. for 2 minutes and heated at 60° C. for 24 hours to form a thermosensitive recording layer having a thickness of 12 μm to 13 μm.

—Formation of Protective Layer—

The following components were ground and dispersed so as to adjust an average particle size within a range from 2 to 3 μm using a ball mill to prepare a coating solution for a protective layer.

Compound represented by the structural formula (1)

Dipentaerythritol acrylate (manufactured by Nippon Kayaku Co., Ltd., KAYARAD DPHA, solid content: 100%):

4 parts compound represented by the structural formula (2)

Dipentaerythritol acrylate (manufactured by Nippon Kayaku Co., Ltd., KAYARAD DPCA-60):

21 parts

Compound of the structural formula (1)/compound of the structural formula (2)=1.6/8.4 (mass ratio)

Silica (manufactured by MIZUSAWA INDUSTRIAL CHEMICALS, LTD, P-526):

2 parts

Photopolymerization initiator (manufactured by Nihon Ciba-Geigy K.K., Irgacure 184):

1 part

Isopropyl alcohol:

60 parts

Toluene:

10 parts

The resulting coating solution for a protective layer was coated on the thermosensitive recording layer using a wire bar, dried with heating at 90° C. for 1 minute and then crosslinked under a ultraviolet lamp at irradiation energy of 80 W/cm to form a 3 μm thick protective layer. Thus, a reversible thermosensitive recording medium of Example 1 was produced.

Example 2

Production of Reversible Thermosensitive Recording Medium

—Preparation of Thermosensitive Recording Layer—

The following components were ground and dispersed so as to adjust an average particle size within a range from 0.1 μm to 1.0 μm using a ball mill.

2-anilino-3-methyl-6-dibutylaminofluorane:

1 part

Electron acceptive compound (developer) represented by the following structural formula:

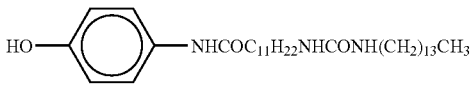

4 parts

Dialkylurea (manufactured by Nippon Kasei Chemical Co., Ltd., Hacreen SB)

1 part

40 Mass % acrylpolyol resin solution manufactured by Mitsubishi Rayon Co., Ltd., LR327)

10 parts

Methyl ethyl ketone 80 parts

To the resulting dispersion solution, 4 parts by mass of isocyanate (manufactured by Nippon Polyurethane Industry Co., Ltd., Coronate HL) was added, followed by thorough stirring to prepare a coating solution for thermosensitive recording layer. Then, the resulting coating solution for thermosensitive recording layer was coated on a 125 μm thick opaque polyester film (manufactured by Teijin DuPont Co., Ltd., Tetoron film U2L98W) using a wire bar, heated at 100° C. for 2 minutes and dried at 60° C. for 24 hours to form a thermosensitive recording layer having a thickness of 12 μm to 13 μm.

—Preparation of Protective Layer—

The following components were ground and dispersed so as to adjust an average particle size within a range from 2 μm to 3 μm using a ball mill to prepare a coating solution for a protective layer.

Compound represented by the structural formula (1)

Dipentaerythritol acrylate (manufactured by Nippon Kayaku Co., Ltd., KAYARAD DPHA):

7 parts

Compound represented by the structural formula (2)

Dipentaerythritol acrylate (manufactured by Nippon Kayaku Co., Ltd., KAYARAD DPEA-12):

18 parts

Compound of the structural formula (1)/compound of the structural formula (2)=2.8/7.2 (mass ratio):

Silica (manufactured by MIZUSAWA INDUSTRIAL CHEMICALS, LTD, P-527)

3 parts

Photopolymerization initiator (manufactured by Nihon Ciba-Geigy K.K., Irgacure 184):

1 part

Isopropyl alcohol:

60 parts

Toluene:

10 parts

The resulting coating solution for a protective layer was coated on the thermosensitive recording layer using a wire bar, dried with heating at 90° C. for one minute and then crosslinked under a ultraviolet lamp at irradiation energy of 80 W/cm to form a 3 μm thick protective layer. Thus, a reversible thermosensitive recording medium of Example 2 was produced.

Example 3

Production of Reversible Thermosensitive Recording Medium

Formation of Thermosensitive Recording Layer

The following components were ground and dispersed so as to adjust an average particle size within a range from 0.1 μm to 1.0 μm using a ball mill.

2-Anilino-3-methyl-6-dibutylaminofluorane:

1 part

Electron acceptive compound (developer) represented by the following structural formula:

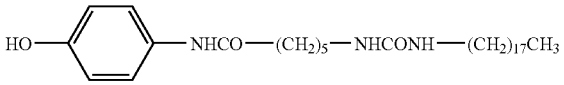

4 parts

Dialkylurea (manufactured by Nippon Kasei Chemical Co., Ltd., Hacreen SB):

1 part

40 Mass % acrylpolyol resin solution manufactured by Mitsubishi Rayon Co., Ltd., LR340):

10 parts

Methyl ethyl ketone:

80 parts

To the resulting dispersion solution, 4 parts by mass of isocyanate (manufactured by Nippon Polyurethane Industry Co., Ltd., Coronate HL) was added, followed by sufficient stirring to prepare a coating solution for a thermosensitive recording layer. Then, the resulting coating solution for a thermosensitive recording layer was coated on a 100 μm thick opaque polyester film (manufactured by Toray Industries, Inc., Tetoron film) using a wire bar, heated at 100° C. for 2 minutes and dried at 60° C. for 24 hours to form a thermosensitive recording layer having a thickness of 12 μm to 13 μm.

—Preparation of Protective Layer—

The following components were ground and dispersed so as to adjust an average particle size within a range from 2 μm to 3 μm using a ball mill to prepare a coating solution for a protective layer.

Compound represented by the structural formula (1)

Dipentaerythritol acrylate (manufactured by Nippon Kayaku Co., Ltd., KAYARAD DPHA):

9 parts

Compound represented by the structural formula (2)

Pentaerythritol acrylate (manufactured by Nippon Kayaku Co., Ltd., KAYARAD THE-330):

16 parts

Compound of the structural formula (1)/compound of the structural formula (2)=3.6/6.4 (mass ratio)

Talc (manufactured by FUJI TALC INDUSTRIAL CO., LTD., LMS-300):

3 parts

Photopolymerization initiator (manufactured by Nihon Ciba-Geigy K.K., Irgacure 184):

1 part

Isopropyl alcohol:

60 parts

Toluene:

10 parts

The resulting coating solution for a protective layer was coated on the thermosensitive recording layer using a wire bar, dried with heating at 90° C. for one minute and then crosslinked under a ultraviolet lamp at irradiation energy of 80 W/cm to form a 3 μm thick protective layer. Thus, a reversible thermosensitive recording medium of Example 3 was produced.

Example 4

Production of Reversible Thermosensitive Recording Medium

—Preparation of Thermosensitive Recording Layer—

The following components were ground and dispersed so as to adjust an average particle size within a range from 0.1 μm to 1.0 μm using a ball mill.

2-Anilino-3-methyl-6-dibutylaminofluorane 1 part

Electron acceptive compound (developer) represented by the following structural formula:

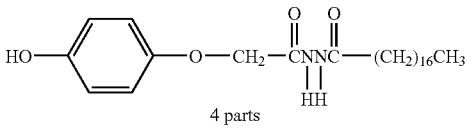

4 parts

Dialkylurea (manufactured by Nippon Kasei Chemical Co., Ltd., Hacreen SB):

1 part

40 Mass % acrylpolyol resin solution manufactured by Mitsubishi Rayon Co., Ltd., LR340):

10 parts

Methyl ethyl ketone:

80 parts

To the resulting dispersion solution, 4 parts by mass of isocyanate (manufactured by Nippon Polyurethane Industry Co., Ltd., Coronate HL) was added, followed by sufficient stirring to prepare a coating solution for a thermosensitive recording layer. Then, the resulting coating solution for a thermosensitive recording layer was coated on a 75 μm thick opaque polyester film (manufactured by Teijin DuPont Co., Ltd., Tetoron film U3L99W) using a wire bar, heated at 100° C. for 2 minutes and dried at 60° C. for 24 hours to form a thermosensitive recording layer having a thickness of 12 μm to 13 μm.

—Preparation of Protective Layer—

The following components were ground and dispersed so as to adjust an average particle size within a range from 2 μm to 3 μm using a ball mill to prepare a coating solution for a protective layer.

Compound represented by the structural formula (1)

Dipentaerythritol acrylate (manufactured by Nippon Kayaku Co., Ltd., KAYARAD DPHA):

12 parts

Compound represented by the structural formula (2)

Pentaerythritol acrylate (manufactured by Nippon Kayaku Co., Ltd., KAYARAD TPA-330):

13 parts

Compound of the structural formula (1)/compound of the structural formula (2)=4.8/5.2 (mass ratio)

Talc (manufactured by FUJI TALC INDUSTRIAL CO., LTD., LMS-300):

3 parts

Photopolymerization initiator (manufactured by Nihon Ciba-Geigy K.K., Irgacure 184):

1 part

Isopropyl alcohol:

60 parts

Toluene:

10 parts

The resulting coating solution for a protective layer was coated on the thermosensitive recording layer using a wire bar, dried with heating at 90° C. for one minute and then crosslinked under a ultraviolet lamp at irradiation energy of 80 W/cm to form a 3 μm thick protective layer. Thus, a reversible thermosensitive recording medium of Example 4 was produced.

Example 5

Production of Reversible Thermosensitive Recording Medium

—Preparation of Thermosensitive Recording Layer—

In the same manner as in Example 1, except that dipentaerythritol acrylate (manufactured by Nippon Kayaku Co., Ltd., KAYARAD DPHA, solid content: 100%) was added to the dispersion solution obtained in Example 1 so as to adjust the mass ratio to 0.01, a thermosensitive recording layer was formed.

—Preparation of Protective Layer—

In the same manner as in Example 1, except that dipentaerythritol acrylate (manufactured by Nippon Kayaku Co., Ltd., KAYARAD D-310) as the compound represented by the structural formula (1) was used in place of dipentaerythritol acrylate (manufactured by Nippon Kayaku Co., Ltd., KAYARAD DPHA) as the compound represented by the structural formula (1) in Example 1, a reversible thermosensitive recording medium of Example 5 was produced.

Example 6

Production of Reversible Thermosensitive Recording Medium

—Preparation of Thermosensitive Recording Layer—

In the same manner as in Example 2, a thermosensitive recording layer was formed.

—Formation of Intermediate Layer—

A coating solution for an intermediate layer prepared by mixing the following components with stirring was coated on the thermosensitive recording layer using a wire bar and then dried with heating at 100° C. to form a 1.5 μm thick intermediate layer.

Zinc oxide (manufactured by Sumitomo Osaka Cement Co., Ltd., ZS303, solid content: 32%):

4 parts

Thermosetting resin (manufactured by Mitsubishi Rayon Co., Ltd., LR503, solid content: 50%):

2 parts

Coronate HL (manufactured by Nippon Polyurethane Industry Co., Ltd., solid content: 75%):

0.5 parts

Methyl ethyl ketone:

4 parts

Dipentaerythritol acrylate (manufactured by Nippon Kayaku Co., Ltd., KAYARAD DPHA, solid content: 100%) was added so as to adjust the mass ratio to 0.02.

Dipentaerythritol acrylate (manufactured by Nippon Kayaku Co., Ltd., KAYARAD DPHA):

0.02 parts

—Preparation of Protective Layer—

In the same manner as in Example 2, except that dipentaerythritol acrylate (manufactured by Nippon Kayaku Co., Ltd., KAYARAD D-310) as the compound represented by the structural formula (1) was used in place of dipentaerythritol acrylate (manufactured by Nippon Kayaku Co., Ltd., KAYARAD DPHA) as the compound represented by the structural formula (1) in Example 2, a protective layer was formed.

Formation of Back Layer

The following components were mixed to prepare a coating solution for a back layer using a conventional method.

Pentaerythritol hexaacrylate (manufactured by Nippon Kayaku Co., Ltd., KAYARAD DPHA):

3 parts

Ultraviolet curable antistatic agent (manufactured by Shin-Nakamura Chemical Co., Ltd., U-201PA-60):

7 parts

Photopolymerization initiator (manufactured by Nihon Ciba-Geigy K.K., Irgacure 184):

0.5 parts

Silica (manufactured by MIZUSAWA INDUSTRIAL CHEMICALS, LTD, P-526):

1 part

Isopropyl alcohol:

17.5 parts

Then, the coating solution for a back layer was coated on the surface on the coated support on which the thermosensitive recording layer, the intermediate layer and the protective layer are not formed, dried at 100° C. for 2 minutes and cured at 60° C. for 24 hours to form a 4 μm thick back layer, and thus a reversible thermosensitive recording medium was produced.

Example 7

Production of Reversible Thermosensitive Recording Medium

—Preparation of Thermosensitive Recording Layer—

In the same manner as in Example 3, a thermosensitive recording layer was formed.

—Preparation of Intermediate Layer—

In the same manner as in Example 6, an intermediate was formed.

—Preparation of Protective Layer—

In the same manner as in Example 3, except that dipentaerythritol acrylate (manufactured by Nippon Kayaku Co., Ltd., KAYARAD D-310) as the compound represented by the structural formula (1) was used in place of dipentaerythritol acrylate (manufactured by Nippon Kayaku Co., Ltd., KAYARAD DPHA) as the compound represented by the structural formula (1) in Example 3, a protective layer was formed.

—Preparation of Back Layer—

In the same manner as in Example 6, a back layer was formed and thus a reversible thermosensitive recording medium was produced.

Example 8

Production of Reversible Thermosensitive Recording Medium

—Preparation of Thermosensitive Recording Layer—

In the same manner as in Example 4, a thermosensitive recording layer was formed.

—Preparation of Intermediate Layer—

In the same manner as in Example 6, an intermediate layer was formed.

—Preparation of Protective Layer—

In the same manner as in Example 4, except that dipentaerythritol acrylate (manufactured by Nippon Kayaku Co., Ltd., KAYARAD D-310) as the compound represented by the structural formula (1) was used in place of dipentaerythritol acrylate (manufactured by Nippon Kayaku Co., Ltd., KAYARAD DPHA) as the compound represented by the structural formula (1) in Example 4, a protective layer was formed.

—Preparation of Back Layer—

In the same manner as in Example 6, a back layer was formed and thus a reversible thermosensitive recording medium was produced.

Example 9

Production of Reversible Thermosensitive Recording Medium

—Preparation of Heat Insulating Layer—

The following components were ground and dispersed until hollow particles are sufficiently distributed to prepare a coating solution for a heat insulating layer. Then, the resulting coating solution for a heat insulating layer was coated on a 188 μm thick opaque polyester film (manufactured by Teijin DuPont Co., Ltd., Tetoron film) sing a wire bar and dried at 110° C. for 4 minutes to form a heat insulating layer having a thickness of 22 μm to 24 μm.

Aqueous dispersion of hollow particles (solid content: 30%):

30 parts

Hollow particles: glass transition temperature (Tg): 105° C., porosity: 89%, D100=10 μm, D100/D50=2.2

Polyurethane resin emulsion:

28 parts (solid content: 35%, manufactured by Dai-Ichi Kogyo Seiyaku Co., Ltd., Superflex 150)

Aqueous completely saponified alcohol solution (solid content: 16%):

9 parts

Water:

50 parts

—Preparation of Thermosensitive Recording Layer—

In the same manner as in Example 5, a thermosensitive recording layer was formed.

—Preparation of Intermediate Layer—

In the same manner as in Example 6, except that 0.05% by mass of pentaerythritol acrylate (manufactured by Nippon Kayaku Co., Ltd., KAYARAD PET-30, solid content: 100%) was added so as to adjust the mass ratio to 0.05 in place of adding 0.02% by mass of dipentaerythritol acrylate (manufactured by Nippon Kayaku Co., Ltd., KAYARAD DPHA) in the formation of the intermediate layer in Example 6, an intermediate layer was formed.

—Preparation of Protective Layer—

In the same manner as in Example 5, except that dipentaerythritol acrylate (manufactured by Negami Chemical Industries Co., Ltd., UN-3320HA) was used in place of dipentaerythritol acrylate (manufactured by Nippon Kayaku Co., Ltd., KAYARAD D-310) as the components of the protective layer in Example 5, a protective layer was formed.

—Preparation of Back Layer—

In the same manner as in Example 6, a back layer was formed and thus a reversible thermosensitive recording medium was produced.

Example 10

Production of Reversible Thermosensitive Recording Medium

—Preparation of Heat Insulating Layer—

In the same manner as in Example 9, except that a 125 μm thick opaque polyester film (manufactured by Teijin DuPont Co., Ltd., Tetoron film U2L98W) was used in place of the 188 μm thick opaque polyester film (manufactured by Teijin DuPont Co., Ltd., Tetoron film) in Example 9, a heat insulating layer was formed.

—Preparation of Thermosensitive Recording Layer—

In the same manner as in Example 6, a thermosensitive recording layer was formed.

—Preparation of Intermediate Layer—

In the same manner as in Example 6, except that 0.06% by mass of pentaerythritol acrylate (manufactured by Nippon Kayaku Co., Ltd., KAYARAD PET-30) was added in place of adding 0.02% by mass of dipentaerythritol acrylate (manufactured by Nippon Kayaku Co., Ltd., KAYARAD DPHA) in Example 6, an intermediate layer was formed.

—Preparation of Protective Layer—

In the same manner as in Example 6, except that dipentaerythritol acrylate (manufactured by Negami Chemical Industries Co., Ltd., UN-3320HA) was used in place of dipentaerythritol acrylate (manufactured by Nippon Kayaku Co., Ltd., KAYARAD D-310) as the components of the protective layer in Example 6, a protective layer was formed.

—Preparation of Back Layer—

In the same manner as in Example 6, a back layer was formed and thus a reversible thermosensitive recording medium was produced.

Example 11

Production of Reversible Thermosensitive Recording Medium

—Preparation of Heat Insulating Layer—

In the same manner as in Example 9, except that a 100 μm thick opaque polyester film (manufactured by Toray Industries, Inc.) was used in place of the 188 μm thick opaque polyester film (manufactured by Teijin DuPont Co., Ltd., Tetoron film) in Example 9, a heat insulating layer was formed.

—Preparation of Thermosensitive Recording Layer—

In the same manner as in Example 7, a thermosensitive recording layer was formed.

—Preparation of Intermediate Layer

In the same manner as in Example 7, except that 0.07% by mass of pentaerythritol acrylate (manufactured by Nippon Kayaku Co., Ltd., KAYARAD PET-30) was added in place of adding 0.02% by mass of dipentaerythritol acrylate (manufactured by Nippon Kayaku Co., Ltd., KAYARAD DPHA) in Example 7, an intermediate layer was formed.

—Preparation of Protective Layer—

In the same manner as in Example 7, except that dipentaerythritol acrylate (manufactured by Negami Chemical Industries Co., Ltd., UN-3320HA) was used in place of dipentaerythritol acrylate (manufactured by Nippon Kayaku Co., Ltd., KAYARAD D-310) as the components of the protective layer in Example 7, a protective layer was formed.

—Preparation of Back Layer—

In the same manner as in Example 7, a back layer was formed and thus a reversible thermosensitive recording medium was produced.

Example 12

Production of Reversible Thermosensitive Recording Medium

—Preparation of Heat Insulating Layer—

In the same manner as in Example 9, except that a 75 μm thick opaque polyester film (manufactured by Teijin DuPont Co., Ltd., Tetoron film U3L99W) was used in place of the 188 μm thick opaque polyester film (manufactured by Teijin DuPont Co., Ltd., Tetoron film) in Example 9, a heat insulating layer was formed.

—Preparation of Thermosensitive Recording Layer—

In the same manner as in Example 8, a thermosensitive recording layer was formed.

—Preparation of Intermediate Layer—

In the same manner as in Example 8, except that 0.08% by mass of pentaerythritol acrylate (manufactured by Nippon Kayaku Co., Ltd., KAYARAD PET-30) was added in place of adding 0.02% by mass of dipentaerythritol acrylate (manufactured by Nippon Kayaku Co., Ltd., KAYARAD DPHA) in Example 8, an intermediate layer was formed.

—Preparation of Protective Layer—

In the same manner as in Example 8, except that dipentaerythritol acrylate (manufactured by Negami Chemical Industries Co., Ltd., UN-3320HA) was used in place of dipentaerythritol acrylate (manufactured by Nippon Kayaku Co., Ltd., KAYARAD D-310) as the components of the protective layer in Example 8, a protective layer was formed.

—Preparation of Back Layer—

In the same manner as in Example 8, a back layer was formed and thus a reversible thermosensitive recording medium was produced.

Comparative Example 1

In the same manner as in Example 1, except that 25 parts by mass of dipentaerythritol acrylate (manufactured by Nippon Kayaku Co., Ltd., KAYARAD DPHA) was used in place of 4 parts by mass of dipentaerythritol acrylate (manufactured by Nippon Kayaku Co., Ltd., KAYARAD DPHA) and 21 parts by mass of dipentaerythritol acrylate (manufactured by Nippon Kayaku Co., Ltd., KAYARAD DPCA-60) as the components of the protective layer in Example 1, an reversible thermosensitive recording medium was produced.

Comparative Example 2

In the same manner as in Example 2, except that 25 parts by mass of dipentaerythritol acrylate (manufactured by Negami Chemical Industries Co., Ltd., UN-3320HA) was used in place of 7 parts by mass of dipentaerythritol acrylate (manufactured by Nippon Kayaku Co., Ltd., KAYARAD DPHA) and 18 parts by mass of dipentaerythritol acrylate (manufactured by Nippon Kayaku Co., Ltd., KAYARAD DPEA-12) as the components of the protective layer in Example 2, a reversible thermosensitive recording medium was produced.

Comparative Example 3

In the same manner as in Example 3, except that 4 parts by mass of dipentaerythritol acrylate (manufactured by Nippon Kayaku Co., Ltd., KAYARAD DPHA) and 21 parts by mass of dipentaerythritol acrylate (manufactured by Negami Chemical Industries Co., Ltd., UN-3320HA) were used in place of 9 parts by mass of dipentaerythritol acrylate (manufactured by Nippon Kayaku Co., Ltd., KAYARAD DPHA) and 16 parts by mass of pentaerythritol acrylate (manufactured by Nippon Kayaku Co., Ltd., KAYARAD THE-330) as the components of the protective layer in Example 3, a reversible thermosensitive recording medium was produced.

Comparative Example 4

In the same manner as in Example 4, except that 25 parts by mass of dipentaerythritol acrylate (manufactured by Nippon Kayaku Co., Ltd., KAYARAD DPCA-60) was used in place of 12 parts by mass of dipentaerythritol acrylate (manufactured by Nippon Kayaku Co., Ltd., KAYARAD DPHA) and 13 parts by mass of pentaerythritol acrylate (manufactured by Nippon Kayaku Co., Ltd., KAYARAD TPA-330) as the components of the protective layer in Example 4, a reversible thermosensitive recording medium was produced.

Comparative Example 5

In the same manner as in Example 3, except that 9 parts by mass of dipentaerythritol acrylate (manufactured by Nippon Kayaku Co., Ltd., KAYARAD DPCA-60) and 16 parts by mass of dipentaerythritol acrylate (manufactured by Nippon Kayaku Co., Ltd., KAYARAD DPCA-12) were used in place of 9 parts by mass of dipentaerythritol acrylate (manufactured by Nippon Kayaku Co., Ltd., KAYARAD DPHA) and 16 parts by mass of pentaerythritol acrylate (manufactured by Nippon Kayaku Co., Ltd., KAYARAD THE-330) as the components of the protective layer in Example 3, a reversible thermosensitive recording medium was produced.

Examples 1 to 12 and Comparative Examples 1 to 5 are summarized in the following Table 2-1 to Table 2-3.

TABLE 2

Details of Examples described above are summarized as follows.

| | Monomer (A) in which ester bond-containing polymerizable group is directly bonded Monomer (B) bonded via chain hydrocarbon group | Ratio (A)/(B) | Content of acrylate having pentaerythritol group of layer in contact with protective layer |
|---|---|---|---|
| Example 1 | (A) = KAYARAD DPHA<br>(B) = KAYARAD DPCA-60 | (A)/(B) =<br>1.6/8.4 ≈ 0.19 | None |
| Example 2 | (A) = KAYARAD DPHA<br>(B) = KAYARAD DPEA-12 | (A)/(B) =<br>2.8/7.2 ≈ 0.39 | None |
| Example 3 | (A) = KAYARAD DPHA<br>(B) = KAYARAD THE-330 | (A)/(B) =<br>3.6/6.4 ≈ 0.563 | None |
| Example 4 | (A) = KAYARAD DPHA<br>(B) = KAYARAD TPA-330 | (A)/(B) =<br>4.8/5.2 ≈ 0.923 | None |
| Example 5 | Modification of Example 1<br>(A) = KAYARAD D-310<br>(in place of DPHA)<br>(B) = KAYARAD DPCA-60 | (A)/(B) =<br>1.6/8.4 ≈ 0.19 | Thermosensitive layer 0.01 |
| Example 6 | Modification of Example 2<br>(A) = KAYARAD D-310<br>(in place of DPHA)<br>(B) = KAYARAD DPCA-12 | (A)/(B) =<br>2.8/7.2 ≈ 0.39 | Intermediate layer 0.02 |
| Example 7 | Modification of Example 3<br>(A) = KAYARAD D-310<br>(in place of DPHA)<br>(B) = KAYARAD THE-330 | (A)/(B) =<br>3.6/6.4 ≈ 0.563 | Intermediate layer 0.02 |
| Example 8 | Modification of Example 4<br>(A') = KAYARAD D-310<br>(in place of DPHA)<br>(B) = KAYARAD TPA-330 | (A)/(B) =<br>4.8/5.2 ≈ 0.923 | Intermediate layer 0.02 |
| Example 9 | Modification of Example 5<br>(A) = UN-3320HA<br>(in place of DPHA)<br>(B) = KAYARAD DPCA-60 | (A)/(B) =<br>1.6/8.4 ≈ 0.19 | Intermediate layer 0.05 |
| Example 10 | Modification of Example 6<br>(A') = UN-3320HA<br>(in place of D-310)<br>(B) = KAYARAD DPCA-12 | (A)/(B) =<br>2.8/7.2 ≈ 0.39 | Intermediate layer 0.06 |
| Example 11 | Modification of Example 7<br>(A') = UN-3320HA<br>(in place of D-310)<br>(B) = KAYARAD THE-330 | (A)/(B) =<br>3.6/6.4 ≈ 0.563 | Intermediate layer 0.07 |
| Example 12 | Modification of Example 8<br>(A') = UN-3320HA<br>(in place of D-310)<br>(B) = KAYARAD TPA-330 | (A)/(B) =<br>4.8/5.2 ≈ 0.923 | Intermediate layer 0.02 |
| Comparative | Modification of Example 1 | (A)/(B) = 10/0 | None |

TABLE 2-continued

Details of Examples described above are summarized as follows.

| | Monomer (A) in which ester bond-containing polymerizable group is directly bonded Monomer (B) bonded via chain hydrocarbon group | Ratio (A)/(B) | Content of acrylate having pentaerythritol group of layer in contact with protective layer |
|---|---|---|---|
| Example 1 | (A) = KAYARAD DPHA<br>(B) = none | (A)/(B) ≈ ∝ | |
| Comparative Example 2 | Modification of Example 2<br>(A) = UN-3320HA<br>(B) = none | (A)/(B) = 10/0 | None |
| Comparative Example 3 | Modification of Example 3<br>(A) = A1 + A2<br>(B) = none<br>(A1) = KAYARAD DPHA<br>(9 parts were replaced by 4 parts)<br>(A2) = UN-3320HA (25 parts) | (A)/(B) = 25/0 | None |
| Comparative Example 4 | Modification of Example 4<br>(A) = none<br>(B) = KAYARAD DPCA-60 (21 parts) | (A)/(B) = 0/25 | None |
| Comparative Example 5 | Modification of Example 3<br>(A) = none<br>(B) = B1 + B2<br>(B1) = KAYARAD DPCA-60 (9 parts)<br>(B2) = KAYARAD DPCA-12 (16 parts) | (A)/(B) = 0/25 | None |

Then, regarding the respective reversible thermosensitive recording media, cracking, curl, printability, adhesion, transferability, chemical resistance, and repeating erasing and printing test were evaluated by the following procedures. The results are shown in Table 3.

<Cracking>

Each of the reversible thermosensitive recording media thus produced was wound around an iron tube having a diameter of 4 mm and the surface of the recording medium was visually observed, followed by evaluation based on the following evaluation criteria.

[Evaluation Criteria]

A: The surface of the recording medium was normal and was free from cracking.

B: Slight cracking occurred on the surface of the recording medium.

C: Cracking occurred on the surface of the recording medium.

D: Severe cracking occurred on the surface of the recording medium and the surface was broken.

<Curl>

Using each of the reversible thermosensitive recording media thus obtained, images were repeatedly formed and erased 100 times by a sheet printer (Prepeat 3100) manufactured by Sanwa Newtec Co., Ltd. and curl of each recording medium was measured by a ruler, followed by evaluation based on the following evaluation criteria.

[Evaluation Criteria]

A: Curl of the recording medium was scarcely observed.

B: Curl of the recording medium was 1 to less than 5 mm.

C: Curl of the recording medium was 5 to less than 10 mm.

D: Curl of the recording medium was 10 mm or more.

<Printability>

On each of the reversible thermosensitive recording media thus obtained, OP varnish (manufactured by T&K TOKA Co., UP2L) was coated to a thickness of 1 μm using an RI tester and crosslinked using an ultraviolet lamp at 80 w/cm, followed by printing. The condition of spread of printing was evaluated according to the following evaluation criteria.

[Evaluation Criteria]

B: Printing was expectedly conducted and the coating film was not peeled off by scratching with nails.

C: Printing was expectedly conducted but the coating film was peeled off by scratching with nails.

D: Printing could not be conducted.

<Adhesion>

On the surface of each of the reversible thermosensitive recording media thus obtained, cut lines were formed by the blade of a cutter using a cross cut-tape testing machine, followed by adhering an adhesive cellophane tape (manufactured by Nichiban Co., Ltd.) thereonto, and separating the tape to evaluate the state of the protective layer according to the following evaluation criteria.

A: No peeling

B: Peeling of 90% or less

C: Peeling of 50% or less

D: Peeling of 50% or more

<Transferability>

Using each of the reversible thermosensitive recording media thus obtained, images were repeatedly formed and erased 100 times by a card printer (R28000) manufactured by PCC Co. and the surface of the recording medium was visually observed, followed by evaluation based on the following evaluation criteria.

[Evaluation Criteria]

B: The surface of the recording medium was normal and scratch was not formed.

C: Scratch was formed on the surface of the recording medium.

D: Severe scratch was formed on the surface of the recording medium and the surface was broken.

<Durability>

Using each of the reversible thermosensitive recording media thus obtained, images were repeatedly formed and erased 100 times by a card printer (R28000) manufactured by PCC Co., and then image densities of the color developed area and color erased area were measured using a Macbeth densitometer RD-914, X-Rite938.

TABLE 3

| | Cracking | Curl | Printability | Adhesion | Transferability | Durability | |
|---|---|---|---|---|---|---|---|
| | | | | | | Color development density | Color erasing density |
| Example 1 | B | B | B | B | B | 1.1 | 0.09 |
| Example 2 | B | B | B | B | B | 1.3 | 0.09 |
| Example 3 | B | B | B | B | B | 1.3 | 0.09 |
| Example 4 | B | B | B | B | B | 1.3 | 0.09 |
| Example 5 | A | A | B | A | B | 0.9 | 0.07 |
| Example 6 | A | A | B | A | B | 1.2 | 0.06 |
| Example 7 | A | A | B | A | B | 1.1 | 0.06 |
| Example 8 | A | A | B | A | B | 1.1 | 0.06 |
| Example 9 | A | A | B | A | B | 1.2 | 0.06 |
| Example 10 | A | A | B | A | B | 1.6 | 0.04 |
| Example 11 | A | A | B | A | B | 1.5 | 0.04 |
| Example 12 | A | A | B | A | B | 1.3 | 0.04 |
| Comparative Example 1 | D | D | D | B | B | 0.8 | 0.10 |
| Comparative Example 2 | D | D | B | D | B | 1.2 | 0.12 |
| Comparative Example 3 | D | D | B | D | B | 1.2 | 0.10 |
| Comparative Example 4 | B | D | D | B | D | 0.8 | 0.15 |
| Comparative Example 5 | B | D | D | B | D | 0.8 | 0.20 |

As is apparent from the results shown in Table 3, the reversible thermosensitive recording media of Examples 1 to 12, wherein the protective layer contains two kinds of acrylate compounds, that is, one compound is an acrylate compound (A) in which a pentaerythritol group or a dipentaerythritol group is directly bonded with a polymerizable group having an ester bond, while the other compound is an acrylate compound (B) having a hydrocarbon group, which may have a substituent having an ester bond, between a pentaerythritol group or a dipentaerythritol group and a polymerizable group having an ester bond, have excellent effect on cracking, curl, printability, adhesion, transferability, chemical resistance and repeating erasing and printing test.

The reversible thermosensitive recording medium of the present invention is widely used in the form of a card or a sheet having a size larger than that of the card, and can be used as a general document and an instruction book for process control. Therefore, the reversible thermosensitive recording medium of the present invention can be widely used as an admission ticket or a sticker for a frozen food container, industrial product, every type of chemical container or the like, or large screen and various displays for physical distribution control, manufacturing process management or the like.

What is claimed is:

1. A reversible thermosensitive recording medium comprising:

a support, a thermosensitive recording layer formed on the support, and a protective layer formed on the thermosensitive recording layer, wherein the thermosensitive recording layer contains an electron donative coloring compound and an electron acceptive compound, and the color tone reversibly changes depending on the temperature, wherein the protective layer contains a polymer of a composition containing two kinds of acrylate compounds selected from an acrylate compound having a pentaerythritol group and an acrylate compound having a dipentaerythritol group, and wherein, among the two kinds of acrylate compounds, one compound is an acrylate compound (A) in which either a pentaerythritol group or a dipentaerythritol group is directly bonded to a polymerizable group having an ester bond, and the other compound is an acrylate compound (B) having a chain hydrocarbon group which may have a substituent having an ester bond, between either a pentaerythritol group or a dipentaerythritol group and a polymerizable group having an ester bond.

2. The reversible thermosensitive recording medium according to claim 1, wherein the mixing mass ratio of the two kinds of acrylate compounds (A) and (B), (A)/(B), is from 1.0/9.0 to 5.0/5.0.

3. The reversible thermosensitive recording medium according to claim 1, wherein the two kinds of acrylate compounds are represented by the following structural formulas (1) and (2):

Structural Formula (1)

Acrylate (A): $\left[X\left\{\begin{matrix}CO-CH=CH_2]_a \\ Z]_b\end{matrix}\right.\right.$ -continued Structural Formula (2)

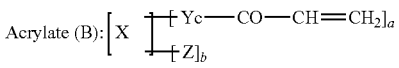

in the structural formulas (1) and (2), X represents a pentaerythritol group or a dipentaerythritol group, Y represents —$CH_2O$—, —$CH_2CH_2O$—, —$CH_2CH_2CH_2O$—, —$CH_2CH_2CH_2CH_2O$—, —$CH_2CH_2CH_2CH_2CH_2O$—, —$CH_2CH(CH_3)O$—, or —CO—$CH_2CH_2CH_2CH_2CH_2O$—, Z represents —H or —CO—CH=$CH_2$, a represents 1 to 5, b represents 1 to 5, and c represents 1 to 12.

4. The reversible thermosensitive recording medium according to claim 1, wherein the electron acceptive compound is a phenol compound represented by one of the following structural formulas (3) and (4):

Structural Formula (3)

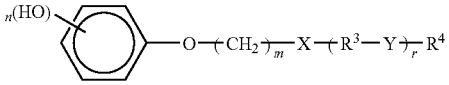

in the structural formula (3), X and Y represent a divalent organic group containing a hetero atom, $R^3$ represents a divalent hydrocarbon which may have a substituent, $R^4$ represents a monovalent hydrocarbon group which may have a substituent, n represents an integer of 1 to 3, m represents an integer of 1 to 20, and r represents an integer of 0 to 3; and Structural Formula (4)

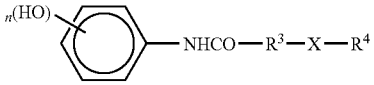

in the structural formula (4), n represents an integer of 1 to 3, X represents a divalent organic group containing a hetero atom, $R^3$ represents a divalent hydrocarbon which may have a substituent, and $R^4$ represents a monovalent hydrocarbon group which may have a substituent.

5. The reversible thermosensitive recording medium according to claim 1, wherein a layer in contact with the surface of the support side of the protective layer contains an acrylate compound having either a pentaerythritol group or a dipentaerythritol group.

6. The reversible thermosensitive recording medium according to claim 5, wherein the acrylate compound having either a pentaerythritol group or a dipentaerythritol group is an acrylate compound (C) represented by the following structural formula (5):

Structural Formula (5)

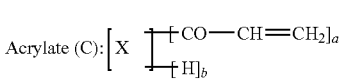

in the structural formula (5), X represents a pentaerythritol group or a dipentaerythritol group, a represents 1 to 5, and b represents 1 to 5.

7. The reversible thermosensitive recording medium according to claim 6, wherein the content of the acrylate compound (C) corresponds to a ratio, dry mass of the acrylate compound (C)/dry mass of the layer containing the acrylate compound (C), of 0.01 to 0.10.

8. The reversible thermosensitive recording medium according to claim 5, wherein the layer in contact with the surface of the support side of the protective layer is a thermosensitive recording layer.

9. The reversible thermosensitive recording medium according to claim 5, wherein the layer in contact with the surface of the support side of the protective layer is an intermediate layer between the thermosensitive recording layer and the protective layer.

10. The reversible thermosensitive recording medium according to claim 1, which comprises at least a heat insulating layer containing hollow particles between the thermosensitive recording layer and the support.

11. The reversible thermosensitive recording medium according to claim 10, wherein the hollow particles has porosity of 70% or more and have a maximum particle size (D100) of 5.0 μm to 10 μm, and also a ratio of the maximum particle size to a particle size (D50) at 50% frequency, (D100/D50), is from 2.0 to 3.0 and the material constituting the hollow particles is a copolymer containing at least one of acrylonitrile and methacrylonitrile as a monomer unit.

12. The reversible thermosensitive recording medium according to claim 1, wherein the reversible thermosensitive recording medium is processed into a form of label, sheet or roll.

13. The reversible thermosensitive recording medium according to claim 1, wherein the reversible thermosensitive recording medium comprises at least one of irreversible visual information and a printable section in at least a portion of at least one of the surface of the reversible thermosensitive recording medium on which an image is to be formed and the opposite surface thereof.

14. A reversible thermosensitive recording label comprising:

a support, a thermosensitive recording layer formed on the support, and a protective layer formed on the thermosensitive recording layer, wherein the thermosensitive recording layer contains an electron donative coloring compound and an electron acceptive compound, and the color tone reversibly changes depending on the temperature, and wherein the protective layer contains a polymer of a composition containing two kinds of acrylate compounds selected from an acrylate compound having a pentaerythritol group and an acrylate compound having a dipentaerythritol group, and wherein, among the two kinds of acrylate compounds, one compound is an acrylate compound (A) in which either a pentaerythritol group or a dipentaerythritol group is directly bonded to a polymerizable group having an ester bond, and the other compound is an acrylate compound (B) having a chain hydrocarbon group which may have a substituent having an ester bond, between either a pentaerythritol group or a dipentaerythritol group and a polymerizable group having an ester bond, and wherein the support comprises one of an adhesive layer and a binder layer on the surface opposite to the surface on which the recording layer is formed.

15. A reversible thermosensitive recording member comprising:

an information storage section, and a reversible display section, the reversible display section comprising a support, a thermosensitive recording layer formed on the support, and a protective layer formed on the thermosensitive recording layer, wherein the thermosensitive recording layer contains an electron donative coloring compound and an electron acceptive compound, and the color tone reversibly changes depending on the temperature, and wherein the protective layer contains a polymer of a composition containing two kinds of acrylate compounds selected from an acrylate compound having a pentaerythritol group and an acrylate compound having a dipentaerythritol group, and wherein, among the two kinds of acrylate compounds, one compound is an acrylate compound (A) in which either a pentaerythritol group or a dipentaerythritol group is directly bonded to a polymerizable group having an ester bond, and the other compound is an acrylate compound (B) having a chain hydrocarbon group which may have a substituent having an ester bond, between either a pentaerythritol group or a dipentaerythritol group and a polymerizable group having an ester bond, and wherein the support comprises one of an adhesive layer and a binder layer on the surface opposite to the surface on which the recording layer is formed.

16. The reversible thermosensitive recording member according to claim 15, wherein the information storage section is any one selected from a magnetic thermosensitive recording layer, a magnetic stripe, an IC memory, an optical memory, a hologram, an RF-ID tag card, a disc, a disc cartridge, and a tape cassette.

17. An image processing apparatus comprising:

a reversible thermosensitive recording medium, and at least one of an image forming unit configured to heat the reversible thermosensitive recording medium to thereby form an image on the reversible thermosensitive recording medium, and an image erasing unit configured to heat the reversible thermosensitive recording medium to thereby erase an image formed on the reversible thermosensitive recording medium, wherein the reversible thermosensitive recording medium comprises:

a support, a thermosensitive recording layer formed on the support, and a protective layer formed on the thermosensitive recording layer, wherein the thermosensitive recording layer contains an electron donative coloring compound and an electron acceptive compound, and the color tone reversibly changes depending on the temperature, wherein the protective layer is a reversible thermosensitive recording medium containing a polymer of a composition containing two kinds of compounds selected from acrylate compounds having either a pentaerythritol group or a dipentaerythritol group, and wherein, among the two kinds of acrylate compounds, one compound is an acrylate compound (A) in which either a pentaerythritol group or a dipentaerythritol group is directly bonded to a polymerizable group having an ester bond, and the other compound is an acrylate compound (B) having a chain hydrocarbon group which may have a substituent having an ester bond, between either a pentaerythritol group or a dipentaerythritol group and a polymerizable group having an ester bond.

18. The image processing apparatus according to claim 17, wherein the image forming unit is one of a thermal head and a laser irradiation device.

19. The image processing apparatus according to claim 17, wherein the image erasing unit is any one selected from a thermal head, a ceramic heater, a heat roll, a hot stamp, a heat block, and a laser irradiation device.

20. An image processing method comprising:

at least one of heating a reversible thermosensitive recording medium to thereby form an image on the reversible thermosensitive recording medium, and heating a reversible thermosensitive recording medium to thereby erase an image formed on the reversible thermosensitive recording medium, wherein the reversible thermosensitive recording medium comprises: a support, a thermosensitive recording layer formed on the support, and a protective layer formed on the thermosensitive recording layer, wherein the thermosensitive recording layer contains an electron donative coloring compound and an electron acceptive compound, and the color tone reversibly changes depending on the temperature, and wherein the protective layer contains a polymer of a composition containing two kinds of compounds selected from an acrylate compound having a pentaerythritol group and an acrylate compound having a dipentaerythritol group, wherein, among the two kinds of acrylate compounds, one compound is an acrylate compound (A) in which either a pentaerythritol group or a dipentaerythritol group is directly bonded to a polymerizable group having an ester bond, and the other compound is an acrylate compound (B) having a chain hydrocarbon group which may have a substituent having an ester bond, between either a pentaerythritol group or a dipentaerythritol group and a polymerizable group having an ester bond.

21. The image processing method according to claim 20, wherein the image is formed using one of a thermal head and a laser irradiation device.

22. The image processing method according to claim 20, wherein the image is erased using any one selected from a thermal head, a ceramic heater, a heat roll, a hot stamp, a heat block, and a laser irradiation device.

23. The image processing method according to claim 21, further comprising forming a new image while erasing the image using the thermal head.

* * * * *